US008135534B2

(12) United States Patent
Langham

(10) Patent No.: US 8,135,534 B2
(45) Date of Patent: Mar. 13, 2012

(54) HYDRAULIC ENGINE

(76) Inventor: J. Michael Langham, Peru, IL (US)

( * ) Notice: Subject to any disclaimer, the term of this patent is extended or adjusted under 35 U.S.C. 154(b) by 632 days.

(21) Appl. No.: 12/374,630

(22) PCT Filed: Jul. 26, 2007

(86) PCT No.: PCT/US2007/074476

§ 371 (c)(1),
(2), (4) Date: Jan. 21, 2009

(87) PCT Pub. No.: WO2008/014399

PCT Pub. Date: Jan. 31, 2008

(65) Prior Publication Data

US 2009/0271088 A1 Oct. 29, 2009

Related U.S. Application Data

(60) Provisional application No. 60/833,344, filed on Jul. 26, 2006.

(51) Int. Cl.
*F02D 43/00* (2006.01)
*F02M 37/04* (2006.01)

(52) U.S. Cl. ..... 701/102

(58) Field of Classification Search ..... 701/102, 701/101, 115; 123/495, 406.19
See application file for complete search history.

(56) References Cited

U.S. PATENT DOCUMENTS 2,914,909 A 12/1959 Kubik
2,978,986 A 4/1961 Carder et al.
3,024,591 A 3/1962 Ehrat et al.
3,089,305 A 5/1963 Hobbs
3,119,230 A 1/1964 Kosoff
3,769,788 A 11/1973 Korper
4,033,304 A * 7/1977 Luria ..... 123/316
4,087,205 A 5/1978 Heintz
(Continued)

FOREIGN PATENT DOCUMENTS

DE 3214516 A1 10/1983
(Continued)

OTHER PUBLICATIONS

International Appln. No. PCT/US07/74476; Notification of Transmittal of the International Search Report and the Written Opinion of the International Searching Authority; May 27, 2008; 9 pages.
(Continued)

*Primary Examiner* — Hieu T Vo
(74) *Attorney, Agent, or Firm* — Whyte Hirschboeck Dudek S.C.

(57) ABSTRACT

An internal combustion engine and method of operating such an engine are disclosed. In some embodiments, the engine includes a piston provided within a cylinder, wherein a combustion chamber is defined within the cylinder at least in part by a face of the piston, and an intake valve within the cylinder capable of allowing access to the combustion chamber. The engine further includes a source of compressed air, where the source is external of the cylinder and is coupled to the cylinder by way of the intake valve, and where the piston does not ever operate so as to compress therewithin an amount of uncombusted fuel/air mixture, whereby the engine is capable of operating without a starter. In further embodiments, the piston is rigidly coupled to another, oppositely-orientated second piston, and the two pistons move in unison in response to combustion events to drive hydraulic fluid to a hydraulic motor.

54 Claims, 15 Drawing Sheets

U.S. PATENT DOCUMENTS

| | | | | |
|---|---|---|---|---|
| 4,098,144 | A | 7/1978 | Besel et al. | |
| 4,215,545 | A | 8/1980 | Morello et al. | |
| 4,326,380 | A | 4/1982 | Rittmaster et al. | |
| 4,345,437 | A * | 8/1982 | Dineen | 60/521 |
| 4,369,021 | A | 1/1983 | Heintz | |
| 4,507,924 | A | 4/1985 | Hemphill | |
| 4,589,380 | A | 5/1986 | Coad | |
| 4,741,410 | A | 5/1988 | Tunmore | |
| 4,760,697 | A | 8/1988 | Heggie et al. | |
| 4,791,786 | A | 12/1988 | Stuyvenberg | |
| 4,813,510 | A | 3/1989 | Lexen | |
| 4,891,941 | A | 1/1990 | Heintz | |
| 5,036,667 | A | 8/1991 | Thatcher | |
| 5,540,194 | A | 7/1996 | Adams | |
| 5,647,734 | A | 7/1997 | Milleron | |
| 5,894,730 | A | 4/1999 | Mitchell | |
| 6,293,231 | B1 | 9/2001 | Valentin | |
| 6,318,316 | B1 * | 11/2001 | Tsukui et al. | 123/193.3 |
| 6,463,895 | B2 | 10/2002 | Bailey | |
| 6,470,677 | B2 | 10/2002 | Bailey | |
| 6,543,225 | B2 | 4/2003 | Scuderi | |
| 6,551,076 | B2 | 4/2003 | Boulware | |
| 6,582,204 | B2 | 6/2003 | Gray | |
| 6,609,371 | B2 | 8/2003 | Scuderi | |

FOREIGN PATENT DOCUMENTS

| | | | |
|---|---|---|---|
| DE | 3238105 | A1 | 4/1984 |
| DE | 19835708 | A1 | 2/2000 |
| WO | 8300187 | A1 | 1/1983 |

OTHER PUBLICATIONS

EP Appln. No. 07799851.6, First Office Action, dated Jun. 28, 2010; 3 pages.

CN Appl No. 200780028155.4, First Office Action dated Aug. 30, 2010; 8 pages.

European Patent Application No. 07799851.6; Supplementary Partial European Search Report and opinion; dated Oct. 14, 2010; 7 pages.

Boudette, N. E., New Engine Design Sparks Interest, The Wall Street Journal, Apr. 21, 2009.

Achten, P.A.J.; Van Den Oever, P.J.; Potma, J; Vael, G.E.M.; Society of Automotive Engineers, Inc., Horsepower with brains: The design of the CHIRON Free Piston Engine, 2000; 17 pages.

Achten, P.A.J.; The Development of the Innas Free Piston Engine: The art of choosing the right moment; Netherlands, 20 pages; 1995.

* cited by examiner

HYDRAULIC ENGINE

CROSS-REFERENCE TO RELATED APPLICATIONS

This application claims the benefit of U.S. provisional patent application No. 60/833,344 entitled "Linear Hydraulic Engine" filed on Jul. 26, 2006, which is hereby incorporated by reference herein.

STATEMENT REGARDING FEDERALLY SPONSORED RESEARCH OR DEVELOPMENT

Field of the Invention

The present invention relates to engines, and more particularly to internal combustion engines employing one or more pistons and cylinders, as can be employed in vehicles as well as in relation to a variety of other applications.

BACKGROUND OF THE INVENTION

Internal combustion engines are ubiquitous in the modern world and used for numerous applications. Internal combustion engines are the most common type of engine utilized for imparting motion to automobiles, propeller-driven aircraft, boats, and a variety of other types of vehicles, as well as a variety of types of motorized work vehicles ranging from agricultural equipment to lawn mowers to snow blowers. Internal combustion engines also find application in numerous types of devices that are not necessarily mobile including, for example, various types of pumping mechanisms, power washing systems, and electric generators.

Many different types of internal combustion engines have been designed and built over the years. Among the most common such engines are engines in which one or more pistons are mounted within one or more corresponding cylinders arranged about a crankshaft, where the pistons are coupled to the crankshaft by way of one or more connecting rods such that linear movement of the pistons is converted into rotational movement of the crankshaft. In terms of automotive engines, typically such crankshaft-based engines are "Otto engines" in which each engine piston repeatedly moves through a series of four strokes (cycles), namely, a series of intake, compression, combustion and exhaust strokes.

Although such conventional, crankshaft-based four stroke engines are popular and are undergoing continuing improvement, such engines nevertheless suffer from several limitations. First, the fuel efficiencies that can be achieved by such engines continue to limited, something which is disadvantageous particularly insofar as the world's supply of fossil fuels is limited, insofar as demand (and consequently price) for fossil fuels continues to increase, and insofar as concerns over the impact of fossil fuel-based internal combustion engines upon the global environment continue to grow. The fuel efficiencies of such engines are limited for a variety of reasons including, for example, the weight of such engines, and frequent operation of such engines in an idling manner when no load power is truly required (e.g., when an automobile is at a stop light). A further factor that limits the fuel efficiencies of many such engines that employ spark plugs in combination with high octane fuels (rather than diesel engines) is that such engines, in order to avoid undesirable pre-ignition combustion events during the compression strokes of such engines, are restricted to designs with relatively modest (e.g., 9-to-1 or 10-to-1) compression ratios.

Second, because combustion strokes in such engines only occur during one of every four movements of a given piston, such engines by their nature require that an external input force/torque be applied to impart initial rotational momentum to the crankshaft of the engine in order for the engine to attain a steady state of operation in which the engine (and its crankshaft) is naturally able to advance to successive positions at which combustion events can take place. For this reasons, such engines typically employ an electrically-driven starter motor that initially drives the engine until the engine is able to attain its own steady state of operation. Relatedly, to maintain such steady state rotational operation, and also to reduce the degree to which output torque provided by the engine varies as combustion events occur and then pass, such engines typically require a flywheel that tends to maintain the rotational momentum of the engine at a constant level.

Although such starter and flywheel components employed in conventional crankshaft-based four stroke internal combustion engines are commonly used, and well-understood in terms of their operation, the inclusion of such devices within such engines adds complexity and/or significant weight (as does a crankshaft) to the engine that, consequently, can increase the cost of designing or building the engine, increase the complexity of maintaining or repairing the engine, and/or further reduce the fuel-efficiency of the engine. Further, depending upon how effective the starter of the engine is in terms of starting the engine, the need for a starter can further be an impediment to effective (and enjoyable) operation of the engine. For example, it can be particularly frustrating to an operator when a starter mechanism fails or otherwise is incapable of starting an automobile engine in a short amount of time, particularly when the operating environment is cold such as during wintertime.

Various other types of internal combustion engines likewise suffer from various limitations that may be the same, similar to, or different from the limitations described above. For example, while many of the above-described crankshaft-based 4 stroke internal combustion engines are able to run fairly cleanly in terms of their engine exhaust emissions, in contrast many diesel engines as well as conventional crankshaft-based 2 stroke engines under at least some operating circumstances are unable to effectively combust all of the fuel that is delivered into the cylinders of those engines and consequently emit fairly high levels of undesirable exhaust emissions. This is problematic particularly as there continues to be increasing concern over environmental pollution, and various governmental entities are continuing to enact legislation and regulations tending to require that such engine exhaust emissions be restricted to various levels. Such crankshaft-based engines also still require starters and flywheel mechanisms to allow for starting and proper operation of the engines.

Although most conventional internal combustion engines employ a piston-driven crankshaft, other designs for internal combustion engines have also been developed. It is known, for example, to construct an engine in which the linear motion of pistons is transformed into rotational motion at an engine output not by way of connecting rods and a crankshaft, but rather by way of utilizing the pistons to drive hydraulic fluid toward a hydraulic motor that rotates in response to receiving such hydraulic fluid. Yet even this type of engine can suffer from some of the same types of limitations described above. In particular, such engines typically also are limited in their efficiency, and/or require additional components such as a starter and/or flywheel in order to allow the engine to begin running in a steady-state manner, and to continue running in such a manner.

For at least these reasons, it would be advantageous if an improved internal combustion engine could be developed that did not suffer from one or more of the above-described limitations to as great a degree. In particular, it would be advantageous if, in at least some embodiments, such an improved internal combustion engine was capable of operating in a more fuel-efficient manner than some or all of the above-described conventional engines. Further, it would be advantageous if, in at least some embodiments, such an improved internal combustion engine could be designed to operate in such a manner that one or more commonly-employed components (e.g., a starter or a flywheel) were not needed.

SUMMARY OF THE INVENTION

The present inventor has recognized the desirability of an improved internal combustion engine having greater fuel-efficiency. The present inventor has further recognized that engine efficiency can be enhanced in any one or more of a variety of manners including, for example, by increasing the compression ratio (or alternatively, the "expansion ratio") of an engine, by reducing engine fuel consumption when output power is not needed (e.g., when a vehicle is standing still), among others. The present inventor has additionally recognized the disadvantages associated with the use of various components of many conventional engines including, for example, crankshafts and associated components (e.g., connecting rods designed to link to crankshafts), camshafts and associated valve-train components (including, for example, timing chains, rocker arms, etc.), starters, flywheels, and various other engine components commonly employed in conventional internal combustion engines.

With one or more of these considerations in mind, the present inventor has conceived of a new engine design that employs one or more pairs of cylinders having oppositely-directed pistons that, in response to combustion events, drive hydraulic fluid toward a hydraulic motor, thereby converting linear piston motional energy into rotational energy. In contrast to conventional engines, rather than employing piston movement in the form of compression strokes to achieve compressed air as is required for the combustion process, in such embodiments pre-compressed air is instead supplied to the cylinders from a source outside of the cylinders. Consequently, in such embodiments, the engine is a two stroke engine in which only combustion strokes and exhaust strokes are performed by the pistons.

Further with respect to such embodiments, by physically linking the pistons of each pair to form an overall piston assembly, and appropriately controlling the provision of compressed air and fuel into the piston cylinders and the combustion events within those cylinders, every movement of the pistons of each pair is a powered movement caused by a combustion event in one of those pistons. Thus, in such an engine design, each piston assembly is always in a state where it is possible to perform a new combustion event. For this reason, such engines have no need for any starter to initially power the engine, nor any flywheel to guarantee that the engine continues to advance to successive positions at which combustion events can occur. Rather, such engines can be repeatedly turned on and off without any involvement by any starter or any flywheel.

As a result of such characteristics, improved engines in accordance with such embodiments are able to achieve higher fuel efficiencies on any one or more of several counts. To begin with, such engines need not have any starter and/or flywheel, and consequently can be lighter than many conventional engines. Further, because the engines can be turned on and off repeatedly without any involvement by any starter and/or flywheel, the engines need not remain running when output power is not needed (e.g., when a vehicle within which the engine is operating is stopped at a stop light). Also, because of the particular piston arrangement, and particularly because the engines do not require any compression strokes involving the compression of fuel/air mixtures that could involve spontaneous pre-ignition, greater compression ratios (or "expansion ratios") and correspondent fuel efficiency improvements are possible. Additionally, because compression strokes are not ever performed within the piston cylinders, no corresponding loss of rotational momentum and energy occurs as a result of such strokes.

More particularly, in at least some embodiments, the present invention relates to an internal combustion engine. The engine includes first and second cylinders having first and second hydraulic chambers, respectively, first and second combustion chambers, respectively, and first and second intake valves, respectively, the intake valves being capable of governing flow into the respective combustion chambers. The engine further includes first and second pistons positioned within the first and second cylinders, respectively, the first and second pistons being rigidly coupled to one another in a manner such that the pistons are substantially aligned with one another and oppositely-directed relative to one another. The engine additionally includes at least one hydraulic link at least indirectly connecting the first and second hydraulic chambers with a hydraulic motor so as to convey hydraulic fluid driven from the first and second hydraulic chambers by the first and second pistons to the hydraulic motor. The engine also includes at least one source of compressed air that is linked at least indirectly to the first and second combustion chambers by way of the respective intake valves, the compressed air being provided to the combustion chambers in anticipation of combustion strokes whereby, due to the providing of the compressed air from the at least one source, the first and second pistons need not perform any compression strokes in order for combustion events to occur therewithin.

Further, in at least some embodiments, the present invention relates to an internal combustion engine. The engine includes a first piston provided within a first cylinder, wherein a first combustion chamber is defined within the cylinder at least in part by a face of the piston, and a first intake valve within the first cylinder capable of allowing access to the first combustion chamber. The engine further includes a source of compressed air, where the source is external of the first cylinder and is coupled to the cylinder by way of the first intake valve, and where the first piston does not ever operate so as to compress therewithin an amount of uncombusted fuel/air mixture, whereby the engine is capable of operating without a starter.

Additionally, in at least some embodiments, the present invention relates to a method in an internal combustion engine. The method includes (a) providing a cylinder assembly having first and second cylinders and a piston assembly including first and second pistons that are coupled to one another by rigid structure and positioned within the first and second cylinders, respectively, where inner and outer chambers are formed within each of the first and second cylinders, the inner chambers being positioned inwardly of the respective pistons along the rigid structure and outer chambers being positioned outwardly of the respective pistons relative to the inner chambers, and wherein the inner chambers are configured to receive hydraulic fluid while the outer chambers are configured to receive amounts of fuel and air. The method further includes (b) causing a first exhaust valve associated with the outer chamber of the first cylinder to close and a second exhaust valve associated with the outer chamber of the second cylinder to open. The method additionally includes (c) opening a first intake valve associated with the outer chamber of the first cylinder to open, and (d) providing compressed air along with fuel into the outer chamber of the first cylinder upon the opening of the first intake valve. The method also includes (e) closing the first intake valve, and (f) causing a combustion event to occur within the outer chamber of the first cylinder, the combustion event tending to drive the piston assembly in a manner tending to expand the outer chamber of the first cylinder.

DETAILED DESCRIPTION OF THE PREFERRED EMBODIMENT

Figure 1:
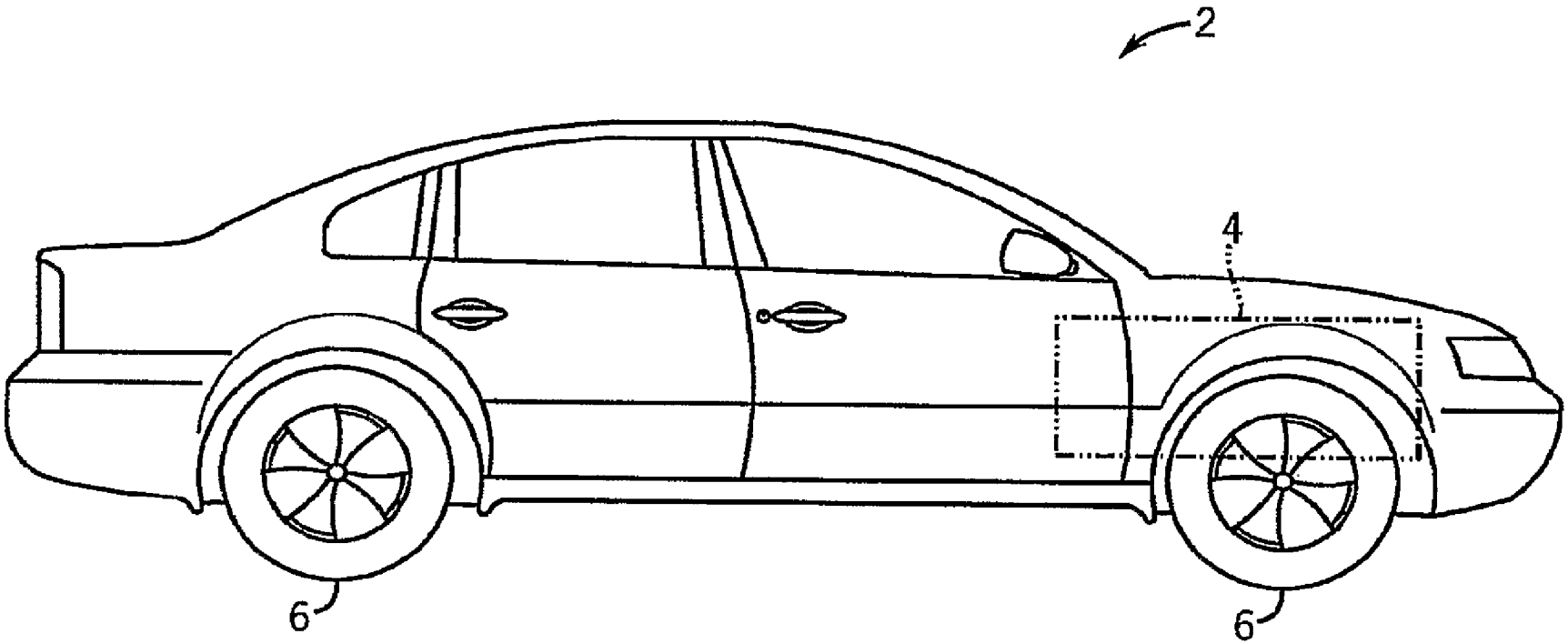
FIG. 1 is a side elevation view of an exemplary vehicle within which can be implemented a hydraulic engine in accordance with at least one embodiment of the present invention.

Referring to FIG. 1, an exemplary vehicle 2 is shown, within which can be implemented an engine 4 (shown in phantom) in accordance with one exemplary embodiment of the present invention. The vehicle 2 of FIG. 1, in particular, is shown to be an automobile capable of carrying one or more persons, including a driver, and having four wheels/tires 6 that support the vehicle relative to a road or other surface upon which the vehicle drives. Although FIG. 1 shows one exemplary vehicle, it should be understood that the present invention is applicable to a wide variety of different types of vehicles (e.g., automobiles, cars, trucks, motorcycles, all-terrain vehicles (ATVs), utility vehicles, boats, airplanes, hydrocraft, construction vehicles, farm vehicles, rideable lawnmowers, etc.), as well as other devices that do not necessarily transport people (e.g., walk-behind lawnmowers, snowblowers, pumping equipment, generators, etc.) that require or operate using one or more engines that operate based upon one or more different types of combustible fuels, such as gasoline, diesel fuel, biofuels, hydrogen fuel, and a variety of other types of fuel. Indeed, the present invention is generally applicable to internal combustion engines generally, regardless of whether they are implemented in vehicles and regardless of the purpose(s) for which the engines are used.

Figure 2:
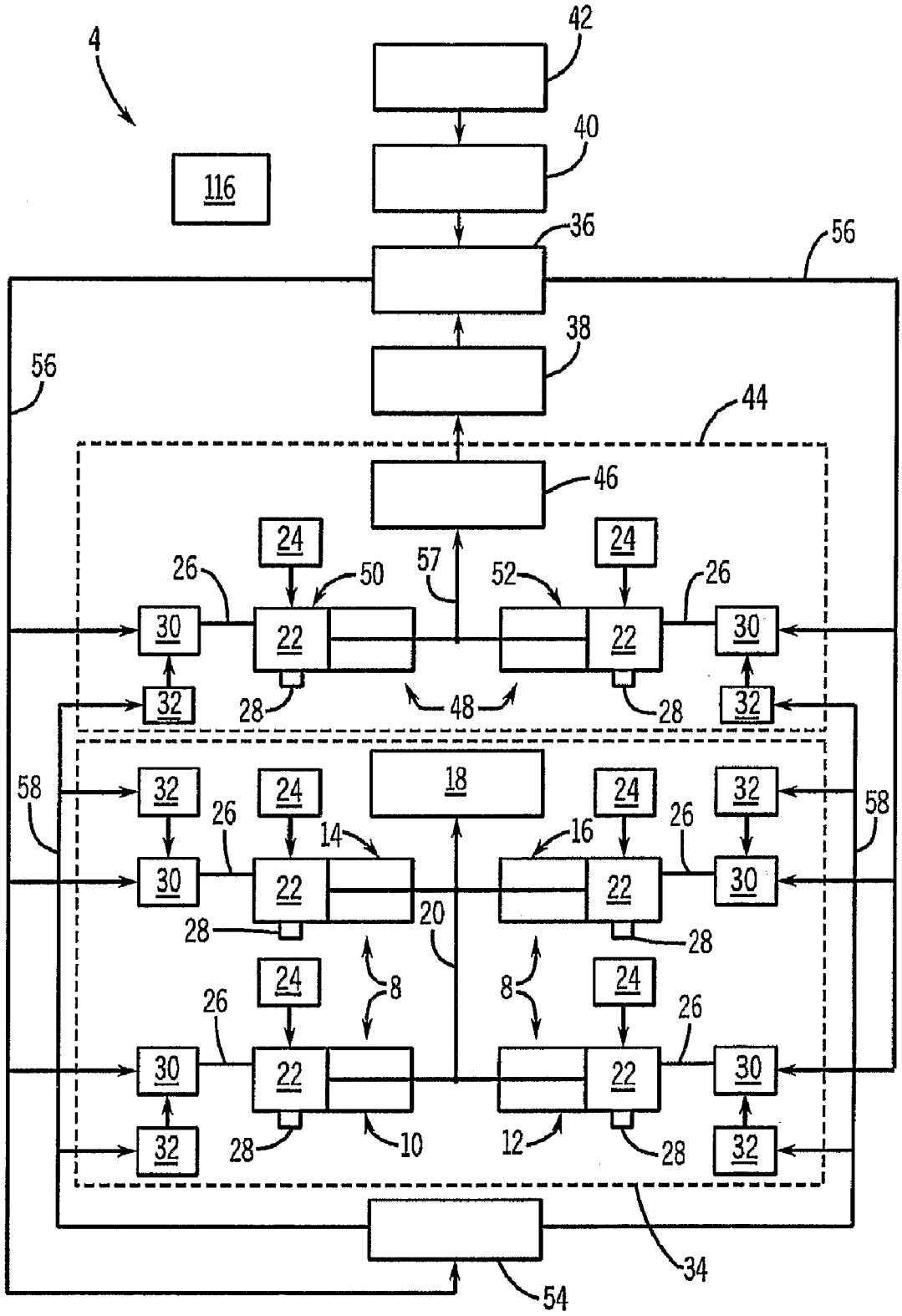
FIG. 2 is a schematic diagram of a hydraulic engine in accordance with at least one embodiment of the present invention, as can be employed in the vehicle of FIG. 1.

Turning to FIG. 2, various components of the engine 4 are shown in schematic form. As will be described in further detail below, the engine 4 has a design that is primarily (albeit not entirely) hydraulic in nature. More particularly as shown, the engine 4 in its present embodiment includes a first set of piston cylinders 8 that includes first, second, third and fourth cylinders 10, 12, 14 and 16, respectively. As will be described further below with respect to FIG. 3, the cylinders of the first set 8 are coupled physically with one another, as well as coupled hydraulically with one another and with a hydraulic wheel motor 18, as represented figuratively by way of links 20. Based upon power communicated hydraulically from the cylinders to the hydraulic wheel motor 18, the hydraulic wheel motor 18 is able to directly cause movement of one or possibly more than one of the wheels/tires 6 of the vehicle 2 or, in alternate embodiments not involving a vehicle, to otherwise output rotational power.

Further as shown, each of the cylinders 10, 12, 14 and 16 includes a respective combustion chamber 22 that interfaces several additional components. More particularly, each of the respective combustion chambers 22 interfaces a respective sparking device 24 that is capable of being controlled to provide sparks to the combustion chamber. Also, each of the respective combustion chambers 22 interfaces both a respective intake valve 26 and a respective exhaust valve 28. Each respective intake valve 26 is further coupled to a respective pressurized induction module 30, which in turn is also coupled to a respective fuel injector 32. As will be described further below, the sparking devices 24, intake and exhaust valves 26 and 28, induction modules 30 and fuel injectors 32 are typically mounted within a head portion of the cylinder. The intake and exhaust valves 26, 28 in the present embodiment are electronically-controlled, pneumatic solenoid valves and can, depending upon the embodiment, more particularly be 3-way, normally-open, solenoid valves or 4-way valves. The components 8-32 can generally be considered to constitute a core or main portion of the engine 4, as represented by a dashed line box 34.

As described further below with respect to FIG. 12, and as illustrated figuratively in FIG. 2, the engine 4 also includes electronic control circuitry 116 that governs the timing of operations of the various fuel injectors 32, intake valves 26, exhaust valves 28, and sparking devices 24. The electronic control circuitry 116 can take a variety of forms depending upon the embodiment including, for example, one or more electronic controllers or control devices such as microprocessors, or various other control device devices such as programmable logic devices (PLDs), or even discrete logic devices and/or hardwired circuitry. As illustrated more clearly in FIG. 12, the electronic control circuitry 116 is in communication with the fuel injectors 32, valves 26, 28 and sparking devices 24 (as well as additional components) by way of dedicated wired links or possibly other communication links (e.g., wireless communication links), by which the electronic control circuitry is able to provide control signals to those components and/or receive signals from those components that can be used for monitoring purposes or otherwise. In at least some embodiments it is even possible that the electronic control circuitry 116 will be located remotely from the remainder of the engine 4 and be in communication therewith by way of a wireless or even (particularly if the engine is stationary) wired network, including possibly an internet-type network.

During engine operation, as controlled by the electronic control circuitry 116, the pressurized induction modules 30 receive fuel from their respective fuel injectors 32 (which are located so as to direct fuel into the air induction modules directly behind the intake valves) and also receive pressurized air, as described further below. The fuel injection pulses can vary in their lengths, for example, from about 1-2 ms pulses to up to 25 ms pulses (the fuel injection pulses typically being at a higher pressure than the compressed air pressure). In turn, the respective intake valves 26 associated with the respective pressurized induction module 30 are controlled to allow the resulting fuel/air mixture to proceed into the respective combustion chambers 22 of the respective cylinders 10, 12, 14 and 16. Combustion events occur within the combustion chambers 22, in particular, after such fuel/air mixture has been added to the combustion chambers upon the occurrence of sparks from the respective sparking devices 24 (there is little or no possibility of pre-ignition prior to the sparking events). The combustion events taking place within the combustion chambers 22 cause movements of pistons within the piston cylinders 10, 12, 14 and 16, which in turn (due to the hydraulic/physical links 20) result in hydraulic power being communicated to the hydraulic wheel motor 18. Subsequent to the occurrences of the combustion events in the respective cylinders 10-16, exhaust gases exit the respective combustion chambers 22 by way of the respective exhaust valves 28, which also are controlled by the electronic control circuitry 116.

Still referring to FIG. 2, in addition to the components of the main portion 34 of the engine 4, the engine includes other components as well. Several of these components govern the provision of pressurized air to the pressurized induction modules 30, as well as the provision of fuel to the fuel injectors 32. Among these components are an air tank 36 (which in the present embodiment is a half gallon air tank), a main air compressor 38, an electric air compressor 40, a battery 42 (which can be, for example, a 12 volt battery, or possibly a higher voltage battery such as a 24 volt battery), an auxiliary power unit 44, and an air-powered fuel pump 54 (alternatively, a fuel pump that is battery driven or hydraulically driven can also be used). As shown, the air tank 36 is coupled to each of the main air compressor 38 and the electric air compressor 40, each of which can determine air pressure within the air tank (albeit the electric air compressor typically is only used in rare circumstances when the main air compressor is unable to operate). The main air compressor 38 is coupled to and powered by the auxiliary power unit 44, while the electric air compressor 40 is coupled to and powered by the battery 42. Depending upon the embodiment, the auxiliary power unit 44 (by way of a generator) also can charge the battery 42 and/or operate an air conditioning system of the vehicle 2, and/or provide electrical power to any of a variety of other electrically-operated components/systems of the vehicle (e.g., a radio, power-adjustable seats, power-adjustable windows, etc.).

The auxiliary power unit 44 includes an auxiliary power unit hydraulic motor/flywheel 46 and a second set of cylinders 48 that includes first and second additional cylinders 50 and 52, respectively. The cylinders 50 and 52 are coupled physically with one another, as well as coupled hydraulically with one another and with the auxiliary power unit hydraulic motor/flywheel 46, as represented figuratively by links 57. As was the case with each of the cylinders of the first set 8, each of the additional cylinders 50 and 52 includes a respective combustion chamber 22 that is in communication with each of a respective sparking device 24, a respective intake valve 26, and a respective exhaust valve 28. Further, each of the respective intake valves 26 of the respective cylinders 50 and 52 is coupled to a respective pressurized induction module 30, which in turn is coupled to a respective fuel injector 32. Again, each of the fuel injectors 32, valves 24, 26 and sparking devices 28 are controlled by the electronic control circuitry 116.

Additionally as shown, the pressurized induction modules 30 associated with each of the cylinders of the first and second sets of cylinders 8, 48 are provided with pressurized air from the air tank 36 by way of links 56. Further, the air powered fuel pump 54 also receives, and is driven by, pressurized air from the air tank 36 by way of the links 56. In response to receiving the pressurized air, the fuel pump 54 in turn supplies pressurized fuel to the fuel injectors 32 of each of the cylinders of the first and second sets of cylinders 8, 48, by way of additional links 58.

During normal operation of the engine 4, compression events occur within the cylinders 50, 52 of the auxiliary power unit 44 and, as a result, pistons within the cylinders 50, 52 move. Due to the movement of the pistons within the cylinders 50 and 52, hydraulic fluid is communicated through, and thereby causes rotation of, the auxiliary power unit hydraulic motor/flywheel 46, which in turn operates the air compressor 38 and thus generates pressurized air within the air tank 36. The pressurized air is communicated to the air powered fuel pump 54 as well as to each of the pressurized induction modules 30 associated with each of the cylinders of the first and second sets 8, 48 by way of the links 56, allowing for combustion events to occur within each of those cylinders. Additionally, even when the auxiliary power unit 44 is not experiencing combustion events, pressurized air can still (occasionally when appropriate) be generated within the air tank 36 and thus communicated to the pressurized induction modules 30 and air powered fuel pump 54, due to the operation of the electric air compressor 40 and the battery 42.

As indicated by the links 20 and 57 discussed above, the cylinders of the first and second sets 8, 48 within the engine 4 are hydraulically coupled to the hydraulic wheel motor 18 and the auxiliary power unit hydraulic motor/flywheel 46, respectively. Thus, in contrast to many conventional internal combustion engines, the engine 4 employs cylinders (and pistons therewithin) not to provide rotational torque to a crankshaft that in turn provides rotational output power, but rather to move hydraulic fluid through the links 20, 57 to the hydraulic wheel motor 18 and the auxiliary power unit hydraulic motor/flywheel 46 so as to generate rotational output power. That is, the flow of the hydraulic fluid causes rotational movement (and thus vehicle movement). Flow of the hydraulic fluid also is accompanied by pressure, where the amount of pressure is typically a function of the resistance to the flow by the load (the flow of hydraulic fluid provided by the engine is somewhat analogous to current provided by a current generator in an electric circuit, while the pressure resulting from the flow is analogous to a voltage that is created due to the resistance to that current flow arising from the load). Insofar as the pistons within the cylinders of the first and second sets 8, 48 are not tied to any crankshaft, those pistons can be considered "free pistons" having sliding motion that is not constrained by any such crankshaft.

Additionally, as will be described in further detail below with respect to FIGS. 6A-11, in contrast to many conventional engines in which cylinders operate in a 4 stroke (or 4 cycle) manner involving intake, compression, combustion and exhaust strokes, the cylinders of the first and second sets 8, 48 of the engine 4 instead are operated merely in a 2 stroke manner. More particularly, the cylinders of the first and second sets 8, 48 each are operated so as to only experience combustion strokes and exhaust strokes. It is just prior to the combustion strokes that fuel and air are forced into the combustion chambers 22 of the cylinders by way of the respective intake valves 26. No compression strokes need be performed by the cylinders in the present embodiment, since the combustion chambers 22 receive precompressed air directly from the pressurized induction modules 30. Also, in contrast to a 4 stroke engine, the input of fuel/air into the combustion chambers 22 is not performed during any strokes of the engine but rather occurs almost instantaneously prior to the combustion strokes.

Further with respect to the manner in which fuel and air is provided into the combustion chambers 22, it should be mentioned that it is generally desirable to maintain a substantially (or entirely) constant fuel-to-air ratio in the combustion chambers at all engine speeds (e.g., a 14.7 to 1 ratio of fuel to air by weight). Because electronically-controlled, pneumatic solenoid valves are used to actuate the intake valves 26, it can be assumed that varying the duration of the intake valve pulse (in conjunction with varying the duration of the fuel injection pulse) would be the most appropriate method for controlling the induction process. Such a method can be achieved through the use of intake valves that are 4-way, two position solenoid valves.

While such an implementation can be employed in some embodiments, through testing, it has been determined that it often is difficult to linearly control the induction when actuating the above-described solenoid valves in such a manner. More particularly, in testing it has been determined that the solenoid valves often take approximately 9 ms to begin to actuate, but if the valves are actuated for 12 ms or longer, the maximum charge of air will be swept into the combustion chamber. That is, due to the use of pressurized air from the air tank 36, air enters the combustion chambers 22 rapidly when the intake valves 26 are opened and, when the intake valves begin to open, the fuel/air mixture enters with such force and speed that it can sometimes be difficult to regulate the amount of the fuel/air mixture (and particularly the amount of air) that enters the combustion chamber.

As an alternative, through testing it has been found that the use of 4-way valves can allow for more positive control if controlled in a particular manner. The extra output port available in a 4-way valve can be used to pressurize a rear intake plunger chamber of the valve when the solenoid is energized, such that the vent hole used to vent that chamber can be (and must be) eliminated. When the solenoid is de-energized, the chamber is vented through the internal porting of the 4-way valve itself. Using such a valve, it has further been demonstrated that, in order to better regulate the amount of air (and fuel) entering the combustion chamber via such a valve, the intake valve should be actuated to open for a predetermined constant length of time (e.g., 12 ms) and to regulate the amount of air by varying the pressure of the induction air. The amount of fuel that is injected can still be controlled by varying the duration of the fuel injector pulse.

Although some embodiments of the present invention envision the use of a pressurized air supply such as the air tank 36 having a constant pressure (for example, at 150 to 175 psi), in other embodiments, regulation of the pressure of the induction air can be attained by varying the pressure at the air tank 36. In such embodiments, the pressure within the air tank 36 can be varied by controlling the main air compressor 38 (or the electric air compressor 40) in real time based upon various criteria, such as the degree to which an operator has depressed an accelerator pedal (as shown in FIG. 12). Given such an arrangement, when an accelerator pedal is lightly depressed, the air pressure within the air tank 36 can be regulated and maintained at a lower pressure (e.g., 40 psi) while, when the accelerator is depressed more fully, the air pressure can be regulated and maintained at a higher pressure (e.g., 160 psi), with the regulated pressure having an approximately linear relation to the amount of accelerator depression. Such an implementation involving varying air pressure is likely to be comparatively fuel-efficient, as energy need not be wasted in compressing induction air to a pressure higher than that needed for combustion.

Figure 3:
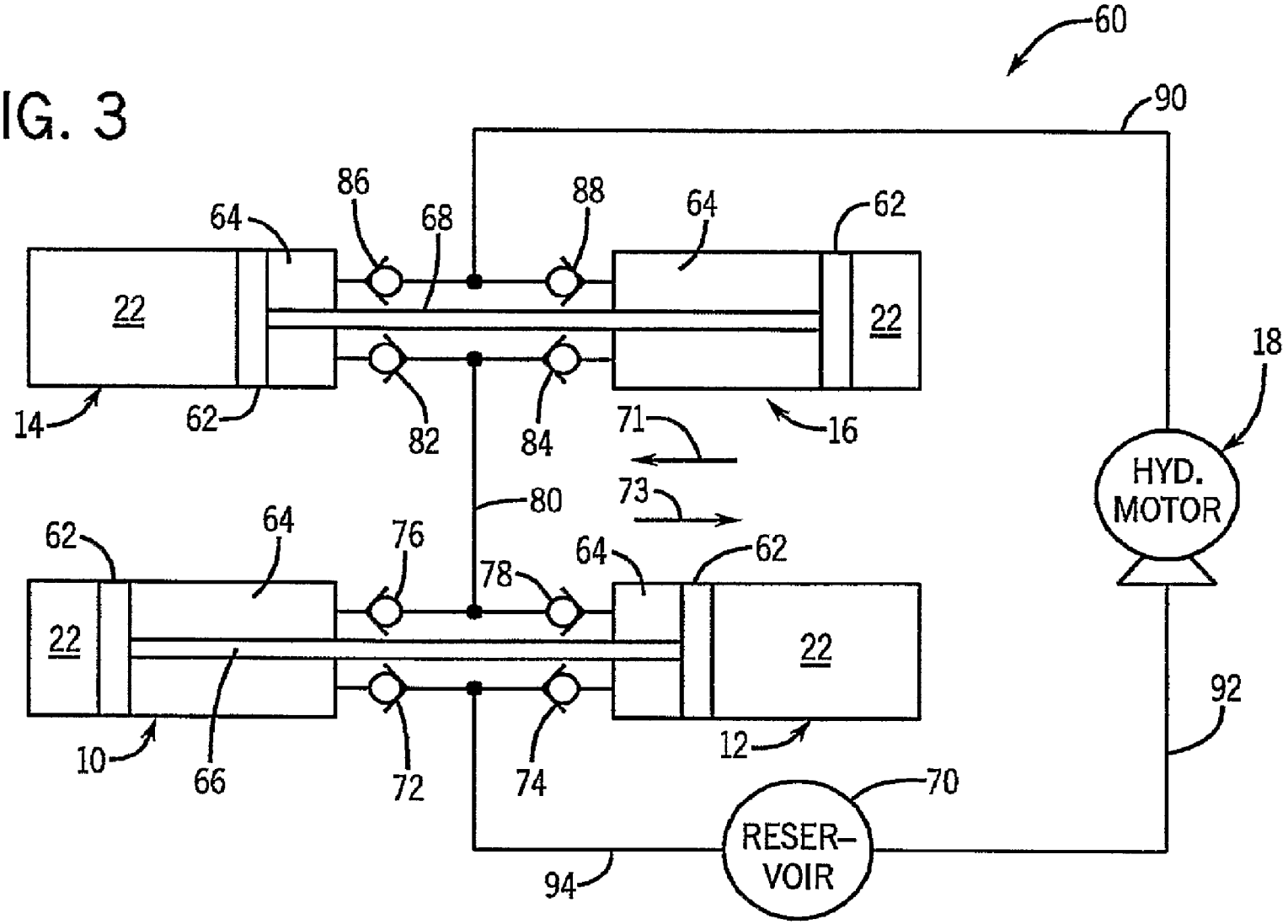
FIG. 3 is a schematic diagram showing in more detail several of the components of the hydraulic engine of FIG. 2, particularly several interrelated hydraulic and physical links among cylinders/pistons of the hydraulic engine.

Turning to FIG. 3, a further schematic diagram 60 shows in more detail the cylinders 10-16 and the hydraulic wheel motor 18 of the main portion 34 and the interrelationship among those components physically and hydraulically, as represented figuratively by the links 20 of FIG. 2. As shown, each of the cylinders 10-16, in addition to having its respective combustion chamber 22, also includes a respective hydraulic chamber 64 and a respective piston 62 separating the combustion and hydraulic chambers from one another. In the present embodiment, the first and second cylinders 10 and 12 are arranged coaxially, and likewise the third and fourth cylinders 14 and 16 are arranged coaxially. The pistons 62 of the first and second cylinders 10 and 12 are rigidly coupled to one another by a first piston connector tube 66, while the pistons of the third and fourth cylinders 14, 16 are rigidly connected to one another by way of a second piston connector tube 68. The two connector tubes 66, 68 are parallel (or substantially parallel) to one another and spaced apart such that the first cylinder 10 is adjacent to the third cylinder 14 and the second cylinder 12 is adjacent to the fourth cylinder 16. Although the present arrangement of the connector tubes 66, 68 in this manner is advantageous for engine balancing purposes, other arrangements can be employed that are equally (or substantially equally) beneficial for engine balancing including, for example, an X-shaped arrangement in which the axis of the first and second cylinders is perpendicular to the axis of third and fourth cylinders.

Further as shown, the first and second cylinders 10, 12 are arranged in an opposed manner such that the first piston connector tube 66 extends between the respective pistons 62 of the cylinders, the hydraulic chambers 64 of the respective cylinders are each positioned inwardly of the respective pistons within the cylinders along the connector tube, and the combustion chambers 22 of the respective cylinders are each positioned outwardly of the respective pistons within the cylinders. Likewise, the first and second cylinders 14, 16 are arranged in an opposed manner such that the second piston connector tube 68 extends between the respective pistons 62 of the cylinders, such that the hydraulic chambers 64 of the respective cylinders are each positioned inwardly of the respective pistons within the cylinders along the connector tube, and such that the combustion chambers 22 of the respective cylinders are each positioned outwardly of the respective pistons within the cylinders.

Given this arrangement, movement of the pistons 62 of the first and second cylinders 10, 12 are coordinated with one another, and the movements of the pistons of the third and fourth cylinders 14, 16 are coordinated with one another. However, because the cylinders 10 and 12 are oriented in the opposed, back-to-back manner, movement of the connector tube 66 with the pistons 62 of those cylinders in one direction tends to reduce the size (volume) of the combustion chamber 22 of one of the cylinders while expanding the combustion chamber of the other of those two cylinders, and movement of the connector tube and those pistons in the opposite direction tends to have the opposite effects on the respective combustion chambers of those cylinders. Likewise, movement of the connector tube 68 along with the pistons 62 of the third and fourth cylinders 14, 16 in one direction tends to reduce the size of one of the combustion chambers 22 of one of those cylinders while expanding the size of the other of the combustion chambers of those cylinders, while movement of the connector tube and those pistons in the opposite direction tends to have the opposite effects on the respective combustion chambers of those cylinders. It should further be noted that, when the combustion chambers 22 are expanding due to combustion events within those chambers, those chambers can be thought of as expansion chambers due to the adiabatic expansions that are occurring therein. In contrast, when the combustion chambers 22 are contracting (e.g., in response to combustion events that are occurring within others of the combustion chambers), those chambers can be thought as exhaust chambers, since at such times the exhaust valves 28 associated with those chambers are opened to allow the contents of those chambers to exit those chambers.

Additionally, as the connector tube 66 and its respective pair of pistons 62 move in a given direction so as to affect the sizes (volumes) of the combustion chambers of the cylinders 10 and 12, complementary changes in the sizes (volumes) of the respective hydraulic chambers 64 of those cylinders also occur. For example, as the connector tube 66 and its pistons 62 move in one direction, this tends to reduce the size of the hydraulic chamber 64 of one of the cylinders that is also experiencing an increase in the size of its combustion chamber 22, and tends to increase the size of the hydraulic chamber of the other of the cylinders that is simultaneously experiencing a reduction in the size of its combustion chamber. Likewise, as the connector tube 68 and its respective pair of pistons 62 move in a given direction so as to affect the sizes of the combustion chambers of the cylinders 14 and 16, complementary changes in the sizes of the respective hydraulic chambers 64 of those cylinders also occur.

For example, in the present view shown in FIG. 3, the connector tube 66 and corresponding pistons 62 of the first and second cylinders 10, 12 are shown to be in a substantially leftward position as indicated by an arrow 71. Given this to be the case, the combustion chamber 22 of the first cylinder 10 is smaller than the combustion chamber of the second cylinder 12, while the hydraulic chamber 64 of the first cylinder is larger than the hydraulic chamber of the second cylinder 12. In contrast, the connector tube 68 and corresponding pistons 62 of the third and fourth cylinders 14, 16 are shown to be in a substantially rightward position as indicated by an arrow 73. Consequently, the combustion chamber 22 of the third cylinder 14 is larger than the combustion chamber of the fourth cylinder 16, while the hydraulic chamber 64 of the third cylinder is smaller than the hydraulic chamber of the fourth cylinder.

Actuation of the various cylinders 10-16 causes back and forth movement of the connector tubes 66 and 68 and their respective pistons 62 in the directions represented by the arrows 71 and 73. In the present embodiment, it is generally preferred that, for engine balancing purposes, the connector tube 66 and its corresponding pistons 62 be operated to move in a manner that is consistently the opposite of the movements of the connector tube 68 and its corresponding pistons 62, and vice-versa. That is, when the connector tube 66 and its corresponding pistons 62 are actuated to move along the direction indicated by the arrow 71, the connector tube 68 and its pistons are actuated to move in the direction indicated by the arrow 73, and vice-versa. However, in alternate embodiments, such opposite, balanced movements of the pistons 62 and connector tubes 66, 68 associated with the two pairs of cylinders 10, 12 and 14, 16 need not occur, and rather the respective connector tubes and their corresponding pistons can move entirely independently of one another (indeed, it is possible for the engine 4 to operate even when the pistons 62 of only one of the pairs of cylinders 10, 12 and 14, 16 are moving).

As indicated above, the links 20 of FIG. 2 are intended to be representative of not only physical links between the cylinders 10-16 such as the connector tubes 66, 68, but also hydraulic links coupling the cylinders with one another and with the hydraulic wheel motor 18. In this regard, FIG. 3 further shows how the hydraulic chambers 64 of the cylinders 10-16 are coupled with one another and with hydraulic wheel motor 18 by way of multiple check valves that restrict the direction of fluid flow into and out of the hydraulic chambers. More particularly as shown, hydraulic fluid is provided from a hydraulic reservoir 70 by way of a link 94 to first and second check valves 72 and 74, respectively, which in turn are coupled to the hydraulic chambers 64 of the first and second cylinders 10 and 12, respectively. The check valves 72 and 74 only allow hydraulic fluid to flow into the respective hydraulic chambers 64 and not out of those chambers. Consequently, when one of the hydraulic chambers 64 of the first and second cylinders 10 and 12 tends to expand (e.g., during an exhaust stroke of that cylinder), then hydraulic fluid is drawn into (but does not flow out of) that hydraulic chamber (e.g., due to suction) via a given one of the check valves 72 and 74 that is associated with that chamber, but when that hydraulic chamber contracts (e.g., during a combustion stroke of that cylinder), then that given check valve prevents outflow of the hydraulic fluid back to the hydraulic reservoir 70.

In addition to the check valves 72 and 74, respectively, the respective hydraulic chambers 64 of the respective first and second cylinders 10 and 12 are also coupled to third and fourth check valves 76 and 78, respectively, which in turn are coupled to one another and also coupled to a link 80. The check valves 76 and 78 are respectively orientated to allow hydraulic fluid flow out of the respective hydraulic chambers 64 of the first and second cylinders 10 and 12, respectively, to the link 80, but not to allow backflow into those hydraulic chambers from that link. Further, fifth and sixth check valves 82 and 84, respectively, additionally couple the link 80 to the hydraulic chambers 64 of the third and fourth cylinders 14 and 16, respectively. The check valves 82, 84 are orientated to allow hydraulic fluid flow to proceed from the link 80 into the hydraulic chambers 64 of the cylinders 14, 16, but to preclude hydraulic fluid flow from those chambers back to that link.

Given the configuration of the check valves 76, 78, 82 and 84 and the link 80, when one of the hydraulic chambers 64 of the first and second cylinders 10 and 12 contracts, fluid flow proceeds from that contracting chamber by way of its respective one of the check valves 76, 78 through the link 80 to the check valves 82 and 84, by which the fluid is in turn able to enter the hydraulic chambers 64 of the third and fourth cylinders 14, 16. Typically, hydraulic fluid tends to flow into one (rather than both) of the hydraulic chambers 64 of a given pair of cylinders of a cylinder assembly that is expanding due to movement of the pistons 62 within those cylinders. It is additionally possible for hydraulic fluid to pass, via the check valves 72, 74, 76, 78, 82 and 84, from the reservoir 70 into the hydraulic chambers 64 of the cylinders 14, 16 even when the pistons 62 within the cylinders 10, 12 are not moving.

Finally, seventh and eighth check valves 86 and 88, respectively, are additionally coupled between the hydraulic chambers 64 of the third and fourth cylinders 14 and 16, respectively, and a link 90. The seventh and eighth check valves 86, 88 are both orientated to allow outflow of hydraulic fluid from the hydraulic chambers 64 of the cylinders 14, 16 to the link 90, and to preclude backflow from that link into those chambers. The link 90 as shown further couples the check valves 86, 88 to the hydraulic wheel motor 18, which in turn is coupled back to the hydraulic reservoir 70 by way of a link 92. Thus, hydraulic fluid flowing out of the hydraulic chambers 64 of the cylinders 14, 16 is directed to and powers the hydraulic wheel motor 18 and, after passing through that motor, then returns to the hydraulic reservoir 70.

Given the presently-described arrangement of the cylinders 10-16, pistons 62, connector tubes 66, 68, check valves 72-78 and 82-88, and links 80 and 90-94, the movement of one or both of the coupled pairs of pistons within the pairs of cylinders 10, 12 and 14, 16 causes hydraulic fluid flow to occur from the reservoir 70 through one or both of the hydraulic chambers 64 of one or both of the cylinders 10, 12 (the lower pressure pair of cylinders), then subsequently through one or both of the hydraulic chambers of the third and fourth cylinders 14, 16 (the higher pressure pair of cylinders) and ultimately to the hydraulic wheel motor 18, which then directs the hydraulic fluid back to the reservoir 70. During normal operation, when both the pistons 62 and connector tube 66 of the cylinders 10, 12 and the pistons and connector tube 68 of the cylinders 14, 16 are experiencing movement, hydraulic fluid in particular flows from the reservoir 70 through that one of the hydraulic chambers 64 of the cylinders 10, 12 that is expanding, then through that one of the hydraulic chambers of the cylinders 14, 16 that is expanding, and then to the hydraulic wheel motor 18 (and further back to the reservoir). Hydraulic fluid flow through the hydraulic chambers 64 of the cylinders occurs regardless of the particular motion of the pistons 62 and connector tubes 66, 68. That is, any movement tending to contract any one or more of the hydraulic chambers 64 tends to force hydraulic fluid to move through the system, even if the movement only relates to the pistons 62 and connector tube 66 or 68 of one of the pairs of cylinders 10, 12 and 14, 16.

In addition, simultaneous movements involving both of the connector tubes 66, 68 and all of the pistons 62 of all of the cylinders 10-16 tend to be additive. That is, equal movements occurring with respect to both of the pairs of cylinders 10, 12 and 14, 16 tend to produce double the effective hydraulic fluid pressure available to the hydraulic wheel motor 18 as would otherwise occur with movement occurring with respect to only one of the pairs of cylinders. Further, such hydraulic fluid flow occurring in response to movement with respect to both of the pairs of cylinders 10, 12 and 14, 16 occurs regardless of whether the pistons 62 and connector tube 66 of the first and second cylinders 10, 12 are moving in the same or opposite direction as the pistons 62 and connector tube 68 of the third and fourth cylinders 14, 16. Nevertheless, as mentioned above, engine balancing is best achieved when the pistons 62 and connector tube 66 of the first and second cylinders 10, 12 move in a direction that is opposite to the movement of the pistons and connector tube 68 of the third and fourth cylinders 14, 16.

Although a schematic diagram similar to that of FIG. 3 is not provided regarding the cylinders 50, 52, auxiliary power unit hydraulic motor/flywheel 46 and links 57 of the auxiliary power unit 44 to show in more detail the physical and hydraulic interrelationships among those components, it will nonetheless be understood that those components interact in a manner similar to that shown in FIG. 3. More particularly, the cylinders 50 and 52 like the cylinders 10 and 12 of FIG. 3 have respective pistons that are coupled by a respective connector tube linking those pistons, such that movement of the two pistons is coordinated. Further, each of the cylinders 50 and 52 includes, in addition to its respective combustion chamber 22, a respective hydraulic chamber corresponding to the hydraulic chambers 64 of the pistons 10 and 12 of FIG. 3. The cylinders 50, 52 again are arranged in an opposed manner such that, when one of the pistons of those cylinders 50, 52 moves in a direction tending to increase the size of the combustion chamber 22 of that cylinder, the hydraulic chamber of that cylinder tends to be reduced in size while the combustion chamber of the opposite cylinder tends to decrease in size and the hydraulic chamber of that opposite cylinder tends to increase in size.

Additionally, since the auxiliary power unit 44 includes only the two cylinders 50, 52, the auxiliary power unit only includes four check valves. First and second of the four check valves correspond to the check valves 72 and 74 of FIG. 3 and allow hydraulic fluid flow to proceed, by way of a link (not shown), only from a hydraulic reservoir (not shown) into the respective hydraulic chambers of the cylinders 50 and 52. Additionally, third and fourth of the four check valves correspond to the check valves 86 and 88 of FIG. 3 and only allow hydraulic fluid flow to proceed from the respective hydraulic chambers of the cylinders 50 and 52, by way of another link (not shown), to the auxiliary power unit hydraulic motor/flywheel 46, which in turn is coupled to the hydraulic reservoir. Typically, the hydraulic reservoir providing hydraulic fluid to the cylinders 50 and 52 of the auxiliary power unit 44 is the same hydraulic reservoir 70 as is used with the components of the main portion 34 of the engine 4.

In alternate embodiments, neither the main portion 34 of the engine 4 nor the engine's auxiliary power unit 44 need have the particular numbers of cylinders and pistons shown in FIGS. 2 and 3 and/or otherwise described above. For example, in some alternate embodiments, just as the auxiliary power unit 44 is capable of operating through the use of only a single pair of oppositely-orientated cylinders 50 and 52, the main portion 34 can similarly employ only a single pair of oppositely-orientated cylinders rather than the set of four cylinders shown. Further, in some alternate embodiments, the auxiliary power unit 44 can likewise have two pairs of cylinders as does the main portion 34. Additionally, in some alternate embodiments, one or both of the main portion 34 of the engine 4 and the auxiliary power unit 44 can have more than two pairs of oppositely-orientated cylinders. For example, the main portion 34 can employ four pairs of cylinders. Such an embodiment can provide enhanced balancing to the extent that the pistons of the two innermost pairs of cylinders are driven to move in a direction opposite to the movements of the pistons of the two outermost pairs of cylinders. Also, in at least some embodiments, no auxiliary power unit is needed at all, for example, if there is an alternate source of pressurized air.

Although it is possible that in some alternate embodiments there will be one or more cylinders with pistons that are not coupled respectively to oppositely-orientated pistons (e.g., by way of connector tube(s)), such embodiments are not preferred. By employing oppositely-orientated, coupled pairs of pistons as described above, movement of a given piston due to a combustion event can be readily controlled and limited by actuation of (e.g., by causing a combustion event at) the other, oppositely-orientated piston that is coupled to the given piston, or at least controlled and limited by the physical confines of the cylinders and other associated components, some of which are described further below in more detail with respect to FIGS. 4 and 5A. Relatedly, by employing oppositely-orientated, coupled pairs of pistons, a given piston experiencing a combustion event can often be easily returned to its initial position prior to the combustion event by actuating the other, oppositely-orientated piston to which the given piston is coupled.

Figure 4:
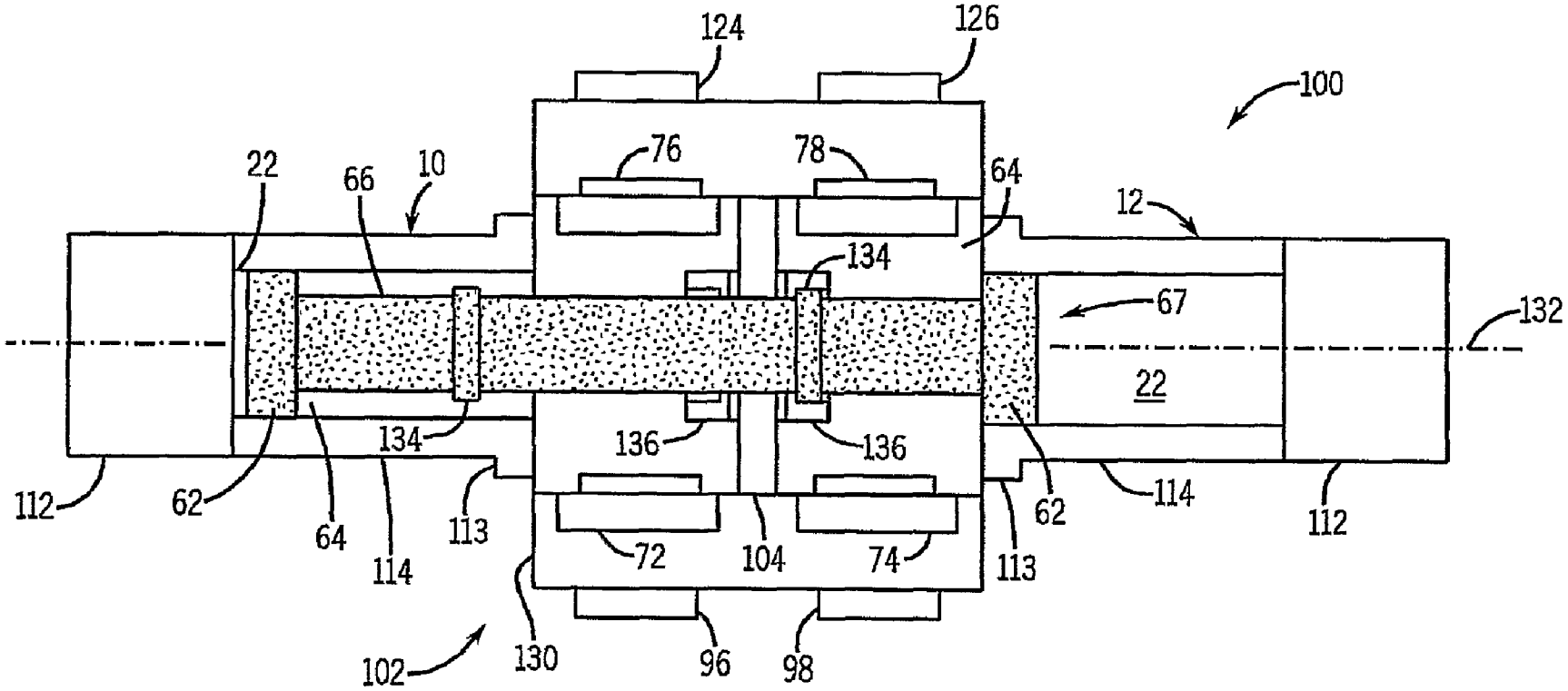
FIG. 4 is a cross-sectional view of an assembly including a pair of oppositely-oriented cylinders, a pair of interconnected pistons that are capable of movement within those cylinders and associated hydraulic valves, as can be employed within the hydraulic engine of FIGS. 2-3.

While FIGS. 2-3 show components of the engine 4 in schematic form, FIG. 4 in contrast shows an exemplary cross-sectional view of a cylinder assembly 100 including a pair of interconnected cylinders of that engine, along with associated components. More particularly, FIG. 4 shows the cylinders 10, 12 and associated components of FIGS. 2 and 3, including the connector tube 66 linking the pistons 62 within those cylinders and the check valves 72, 74, 76 and 78 associated with those cylinders. The combination of the connector tube 66 and associated pistons 62 in particular can be referred to as a piston assembly 67. Although intended to be representative of the cylinders 10, 12 and associated components, FIG. 4 is equally representative of any of the pairs of oppositely-orientated cylinders and associated components of the engine 4 as described above with respect to FIGS. 2 and 3. Thus, FIG. 4 also is representative of the cylinders 14, 16, the connector tube 68, and the check valves 82, 84, 86 and 88 within the main portion 34 of the engine 4, as well as the cylinders 50, 52 and associated connector tube and check valves of the auxiliary power unit 44 of the engine.

As described above and further shown in FIG. 4, each of the respective cylinders 10, 12 has its respective combustion chamber 22 and its respective hydraulic chamber 64, where the two chambers of each cylinder are separated by its respective piston 62. The outer walls of each of the respective cylinders 10, 12 are formed by a main engine housing 102, respective cylinder heads 112 at opposite ends of the assembly 100, and respective cylindrical sleeves 114 that are positioned between the respective cylinder heads and the main engine housing. Further as shown, in the present embodiment, each of the cylindrical sleeves 114 includes a respective mounting flange 113 by which the sleeve is specifically in contact with the main engine housing 102. The hydraulic chambers 64 of the two cylinders 10, 12 are separated from one another by way of a center bulkhead 104 of the main engine housing 102. Although not shown in FIG. 4, it will be understood that the respective cylinder head 112 of each cylinder 10, 12 has formed therewithin an intake valve such as the intake valves 26 of FIG. 2, an exhaust valve such as the exhaust valves 28 of FIG. 2, and a sparking device such as the sparking devices 24 of FIG. 2. Also, the fuel injectors 32 and the pressurized induction modules 30 likewise are supported by the cylinder heads 112. Such components provided within the cylinder head 112 are shown in more detail in FIG. 5B.

Further as shown in FIG. 4, the check valves 72, 74, 76 and 78 are respectively connected to ports 96, 98, 124 and 126, respectively, each of which is formed within the main engine housing 102. By virtue of the respective ports 96 and 98, the respective check valves 72 and 74 are connected to the link 94 (see FIG. 3), and by virtue of the respective ports 124 and 126, the respective check valves 76 and 78 are connected to the link 80 (see FIG. 3). In such embodiments, the link 94 can be a branched (e.g., Y-shaped) hose coupled at one end to the reservoir 70 and at its other two ends to the ports 96 and 98. Also, the link 80 can likewise be a hose having two branches so as to connect to the ports 124 and 126. Further, if alternatively FIG. 4 is understood to represent the cylinders 14, 16 and associated components, the ports within the main engine housing 102 instead can link the check valves with the link 80 and the link 90. Likewise, if alternatively FIG. 4 is understood to represent the cylinders 50, 52 and associated components, the ports within the main engine housing 102 instead can link check valves associated with those cylinders with links to the auxiliary power unit hydraulic motor/flywheel 46 and hydraulic fluid reservoir in conjunction with which those cylinders are operated, as discussed above.

Notwithstanding the particular embodiment of FIG. 4, the components of a cylinder assembly of the engine can take many other forms as well. For example, in some alternate embodiments, both of the check valves 72 and 74 are linked internally to one another and to a single port (e.g., either the port 96 or the port 98). Likewise, in some alternate embodiments, both of the check valves 76 and 78 are linked internally to one another and to a single port (e.g., either the port 124 or the port 126). In such embodiments, the hose-type links that are coupled to the ports of the cylinder assembly need not be branched. Indeed, in some embodiments, hose-type links can be largely or entirely dispensed with (and incorporated into a hydraulic manifold), to the extent that some or all of the links among the various check valves of the various cylinder assemblies and other check valves are formed within the main engine housings 102 of the respective cylinder assemblies and adjacent engine structures. For example, in one alternate embodiment, a portion 130 of the engine could be increased in terms of its volume and could serve as the reservoir 70 of the engine 4.

When combustion events occur within the combustion chambers 22 of the cylinders 10, 12 shown in FIG. 4, the piston assembly 67 including the connector tube 66 and associated pistons 62 moves back and forth along a central axis 132. In the exemplary view of FIG. 4, the piston assembly 67 has been shifted towards the cylinder 10 (and away from the cylinder 12), which typically will be the case when the most recent combustion event occurring within the pair of cylinders 10, 12 occurred within the combustion chamber 22 of the cylinder 12. Although the piston assembly 67 could potentially be restricted in terms of its overall side-to-side movement by the cylinder heads 112 (with the movements to either side being constrained when the pistons physically encountered the cylinder heads), restriction of such movement by the cylinder heads would not be preferable since the relatively large momentum of the piston assembly could cause wear upon the cylinder heads and/or the pistons due to the impacts between those structures. Also, while the piston assembly 67, as it moves toward a particular one of the combustion chambers 22 following a combustion event, can be pneumatically braked due to compression of any contents within that combustion chamber, such pneumatic braking is typically inadequate to slow and stop such movement of the piston assembly 67.

Rather, in the present embodiment, the connector tube 66 is fitted with a pair of connector tube collars 134, where one of the connector tube collars is positioned along the connector tube 66 within each of the respective cylinders 10 and 12, respectively. Additionally, the main engine housing 102 includes a pair of dashpot assemblies 136 that, as shown, are located on opposite sides of the center bulkhead 104 at the innermost ends of the hydraulic chambers 64, respectively. As will be described in further detail with respect to FIG. 5A, the respective connector tube collars 134 are capable of sliding inwardly into the respective dashpot assemblies 136 depending upon the position of the piston assembly 67. In the present view shown, for example, the connector tube collar 134 associated with the cylinder 12 has slid into the dashpot assembly 136 associated with that cylinder due to the movement of the piston assembly 67 toward the cylinder 10.

Due to the presence of the connector tube collars 134 and the dashpot assemblies 136, movement of the piston assembly 67 typically is restricted not by way of the cylinder heads 112, but rather due to the interfacing of the connector tube collars with the dashpot assemblies (albeit, in some circumstances, movement of the piston assembly 67 can also be limited due to restrictions on the flow of hydraulic fluid out of the hydraulic chambers 64, such as when there are large loads on the engine 4). Entry of each respective connector tube collar 134 into its respective dashpot assembly 136 results in a rapid slowing-down and stopping of movement of the respective connector tube collar toward the center bulkhead 104, and thus results in a rapid slowing-down and stopping of the movement of the piston assembly 67 in that direction. For example, entry of the connector tube collar 134 of the second cylinder 12 into the respective dashpot assembly 136 of that cylinder as shown in FIG. 4 presumably resulted in the slowing and stopping of movement of the piston assembly 67 to the left. Additionally, due to the particular configuration of the dashpot assemblies 136 and the connector tube collars 134, the manner in which these components interface one another allows for effective slowing-down and stopping of the movement of the piston assembly 67 without damaging impacts and correspondent wear upon those components or upon the cylinder heads 112 of the cylinders 10, 12.

Figure 5A:
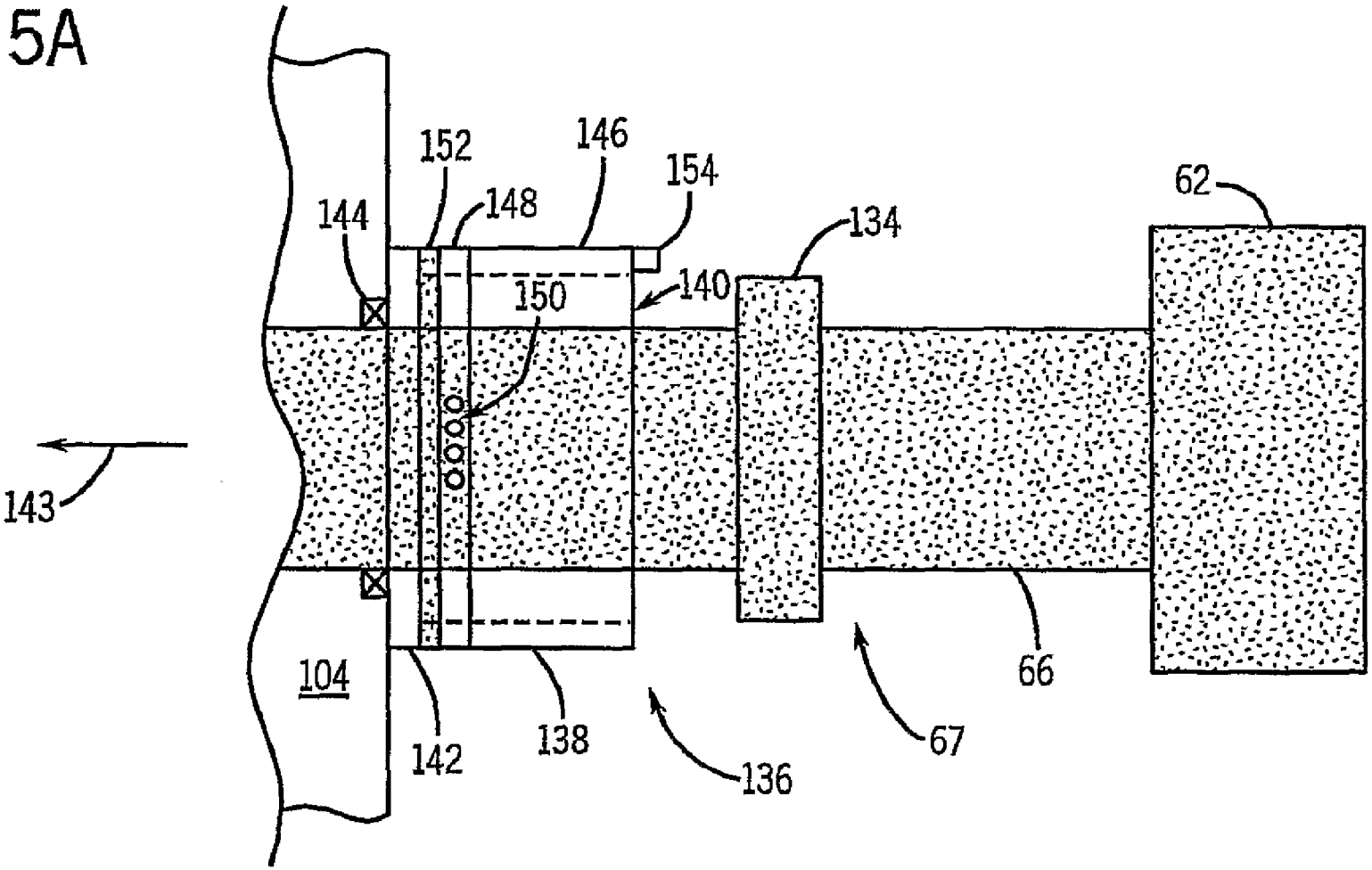
FIG. 5A is a partially cross-sectional partially cut away side elevation view of certain portions of the assembly of FIG. 4, with particular components of the assembly shown in more detail than in FIG. 4.

Referring further to FIG. 5A, a partially cross-sectional, partially cut away side elevation view of certain portions of the assembly 100 of FIG. 4 reveals certain features of the assembly in more detail. More particularly, FIG. 5A provides a side elevation view of a portion of the piston assembly 67 within the cylinder 12, along with the dashpot assembly 136 associated with that cylinder. Additionally, FIG. 5A provides a cross-sectional view of a portion of the center bulkhead 104 of the main engine housing 102 that surrounds the portion of the piston assembly 67 extending therewithin. It will be understood that the features shown in FIG. 5A with respect to the dashpot assembly 136 associated with the cylinder 12 are equally present with respect to the dashpot assembly of the cylinder 10, as well as with respect to dashpot assemblies associated with each of the other cylinders 14, 16, 50 and 52 of the engine 4 shown in FIG. 2. It will further be recognized that FIG. 5A shows the piston assembly 67 to be in a somewhat different position than that shown in FIG. 4, such that the connector tube collar 134 associated with the cylinder 12 is no longer positioned within the dashpot assembly 136 of that cylinder, but rather is shifted to the right of that dashpot assembly.

As shown in FIG. 5A, the dashpot assembly 136 includes several substructures. First among these is a cylindrical capacitor case or sleeve 138 within which is formed a cylindrical cavity 140, having an inner diameter that is slightly greater than an outer diameter of the connector tube collar 134 (e.g., by approximately eighteen thousandths of an inch). Thus, as the piston assembly 67 moves in a direction illustrated by an arrow 143, the connector tube collar 134 associated with the cylinder 12 is able to slide into the cavity 140. Further as shown, the cylindrical capacitor case 138 is supported upon an oil seal cover 142 that in turn is supported upon the center bulkhead 104. Additionally, an annular oil seal 144, which can be an o-ring, is mounted along the interface between the dashpot assembly 136 and the center bulkhead 104, and can be considered to be part of the dashpot assembly. Further, although not shown, it will be understood that typically one or more sealing rings (for example, metallic rings) are typically mounted around the exterior cylindrical surface of the piston 62, to prevent or limit leakage of hydraulic fluid from the hydraulic chamber 64 on one side of that piston to the combustion chamber 22 on the other side of that piston (as well as to prevent or limit leakage of fuel/air and combustion byproducts from the combustion chamber into the hydraulic chamber). In one embodiment, such sealing rings should limit the amount of hydraulic fluid that is capable of leaking into the combustion chamber 22 of the cylinder (from the opposite side of the piston) to only about 0.05% by volume of the hydraulic fluid within the cylinder. A return mechanism can be provided within the combustion chamber allowing hydraulic fluid that has leaked into the combustion chamber to be returned to the reservoir 70.

The oil seal cover 142, like the capacitor case 138, is a cylindrical/annular structure. However, the oil seal cover 142 has an inner diameter that is less than the inner diameter of the capacitor case 138 and in particular is only about the same as (or slightly greater than) the outer diameter of the connector tube 66, which is narrower than the outer diameter of the connector tube collar 134. Consequently, while movement of the connector tube 66 is not prevented by the oil seal cover 142, the connector tube collar 134 is completely precluded from advancing past the oil seal cover farther toward the center bulkhead 104. Further, because of the relative sizes of the inner diameter of the oil seal cover 142 and the outer diameter of the connector tube 66, and also because of the sealing provided by the oil seal 144, the passage of hydraulic fluid from the hydraulic chamber 64 of the cylinder 12 through the center bulkhead 104 to the opposite cylinder 10 is entirely or at least substantially precluded.

It should be further noted that the particular outer and inner diameters of the connector tube 66 and the oil seal cover 142, respectively, can vary depending upon the embodiment. Also, the connector tube 66 can vary in its diameter along its length. Often it is desirable to have the diameter of the connector tube 66 be fairly large, particularly near the piston 62, such that its diameter is not much less than the outer diameter of the piston. Through the use of such an arrangement, any pressure applied to the surface of the piston 62 facing the combustion chamber 22 during combustion is magnified or leveraged within the corresponding hydraulic chamber 64, since the annular surface of the piston facing the hydraulic chamber 24 is significantly smaller in area than the surface of the piston facing the corresponding combustion chamber 22.

Although the connector tube collar 134 cannot pass beyond the oil seal cover 142, in practice the connector tube collar never (or seldom) reaches the oil seal cover due to the operation of the dashpot assembly 136 in relation to the connector tube collar. More particularly as shown, the capacitor case 138 can be understood as encompassing a first cylindrical portion 146 that is located farther from the center bulkhead 104 and a second cylindrical portion 148 that is located closer to the center bulkhead. Further, the second cylindrical portion 148, as shown, includes one or more (in this case, four) dashpot orifices 150 extending through the wall of the capacitor case 138. The dashpot orifices 150 allow hydraulic fluid to exit the cavity 140 as the connector tube collar 134 moves into the cavity 140 and proceeds toward the oil seal cover 142. While allowing hydraulic fluid to exit from the cavity 140, the dashpot orifices 150 also serve as a restriction on the rate at which the hydraulic fluid is able to exit the cavity, such that there is a natural back pressure applied against the connector tube collar 134 counteracting the pressure that is being exerted by that collar as it proceeds in the direction of the arrow 143 (presumably due to a combustion event). The amount of back pressure applied against the connector tube collar 134 is generally a function of piston speed (the higher the piston velocity, the higher the pressure), and consequently the flow through the dashpot orifices 150 acts as a speed brake.

Often, the restriction upon hydraulic fluid flow provided by the dashpot orifices 150 is sufficient to completely stop movement of the connector tube collar 134 along the direction of the arrow 143 before the collar reaches the dashpot orifices. However, when the piston speed is sufficiently high (e.g., when the force applied to the piston 62 within the cylinder 12 is particularly large), the connector tube collar 134 can proceed far enough into the cavity 140 such that it begins to pass by the dashpot orifices 150 or even completely passes by those orifices. As this occurs, for hydraulic fluid to exit the cavity 140, the hydraulic fluid first flows from the cavity between the outer diameter of the connector tube collar 134 and the inner diameter of the capacitor case 138. The hydraulic fluid flowing within this narrow annular space then can exit either by way of the dashpot orifices 150 or by traveling entirely past the connector tube collar 134. Regardless of the particular flow path(s) that occur, it should be evident that, as the connector tube collar 134 moves partly or entirely over and past the dashpot orifices, significantly increased amounts of resistance to movement toward the oil seal cover 142 are experienced by the connector tube collar. Because of this increased resistance, it is almost never the case that the connector tube collar 134 actually reaches the oil seal cover 142.

Although in the present embodiment hydraulic fluid exiting the capacitor cases 138 by way of the dashpot orifices 150 remains within the cylinders 10, 12, in other embodiments the fluid exiting the dashpot orifices can be directed to other locations. For example, in at least some embodiments, the engine employs the same hydraulic fluid as is located within the cylinders and provided to the hydraulic wheel motor and auxiliary power unit hydraulic motor/flywheel also as coolant for the engine. That is, in some such embodiments, the engine does not employ any radiator or any separate fluid (such as ethylene glycol) to cool the engine, but rather utilizes as coolant the very same hydraulic fluid as is used to transmit power within the engine, and the movement of the pistons within the cylinders powers movement of the coolant through the cooling system. It will be understood that, in such embodiments, the dashpot orifices 150 are the initial segments of cooling channels extending within other portions of the engine body such as the main engine housing 102, cylinder heads 112, and cylindrical sleeves 114 of FIG. 4. The hydraulic fluid that is diverted by way of the dashpot orifices to the cooling system, after passing through the cooling system, is typically returned to the main reservoir (e.g., the reservoir 70). Notwithstanding the above description, it will further be understood that the present invention is intended to encompass a variety of engines having a variety of different types of cooling systems employing a variety of types of coolant, cooling devices (including and/or not including radiators, fans, and the like), passages, and other structures.

As will be described further below with respect to FIGS. 8-13, in the present embodiment, the timing of various components of the engine 4 is determined by the electronic control circuitry 116 that, at least in part, utilizes information regarding the positions of the pistons 62 (and associated piston assemblies, such as the piston assembly 67) to determine what actions to take or not take. In the present embodiment, to determine the positioning of the pistons 62, the electronic control circuitry 116 is provided with electrical signals from sensors associated with the dashpot assemblies 136 that are indicative of the positioning of the connector tube collars 134 relative to those dashpot assemblies, and thus further indicative of the positioning of the pistons 62 within the same respective cylinders relative to the dashpot assemblies of those cylinders. The electrical signals in particular are reflective of changes in capacitance that occur as the connector tube collars vary in their positions relative to their respective dashpot assemblies.

Further as shown in FIG. 5A, the dashpot assembly 136 includes an annular insulator 152 positioned between the second cylindrical portion 148 of the capacitor case 138 and the oil seal cover 142. As shown, the annular insulator 152 has the same inner diameter of the cylindrical portions 146 and 148. The annular insulator 152 can be, for example, a flat ring fabricated from a relatively high dielectric material such as G11 epoxy board, and be approximately 0.06 inches thick. The annular insulator 152 does not entirely separate the capacitor case 138 from the oil seal cover 142 insofar as fasteners (e.g., four screws) are used to attach the capacitor case to the oil seal cover, with the insulator in between. To ensure proper insulation, feed-thru bushings also made of G11 epoxy are used in the area where the fasteners travel through the oil seal cover 142.

Due to the annular insulator 152, an ambient capacitance exists between the capacitor case 138 and the oil seal cover 142, as well as between the capacitor case and the components forming the wall of the cylinder 12 (e.g., the main engine housing 102, cylinder head 112 of that cylinder, and cylindrical sleeve 114 of that cylinder as shown in FIG. 4). The connector tube 66 with its connector tube collar 134 can be considered to be in contact with an electrical ground formed by these components forming the wall of the cylinder 12, since the connector tube 66 generally has some electrical contact with the walls of the cylinder due to the piston rings that are in contact with the wall of the cylinder (again, the piston rings are typically metallic). At the same time, due to the presence of non-conductive hydraulic fluid within the hydraulic chamber 64 of the cylinder 12 that separates the connector tube 66 and its connector tube collar 134 from the capacitor case 138, the capacitor case in particular is insulated from the connector tube/connector tube collar. Consequently, the capacitor case 138 and connector tube collar 134 in particular are able to effectively form two plates of a variable capacitor, where the capacitance varies with movement of the collar relative to the capacitor case and in particular changes significantly as the collar enters and travels within the capacitor case (such process often taking less than 5 milliseconds). The sensed capacitance changes, which are indicative of piston location, can be sensed at an electrode locking clamp (or simply electrode) 154 on the capacitor case 138, which in turn is connected to the electronic control circuitry 116 as shown in FIG. 12.

Figure 5B:
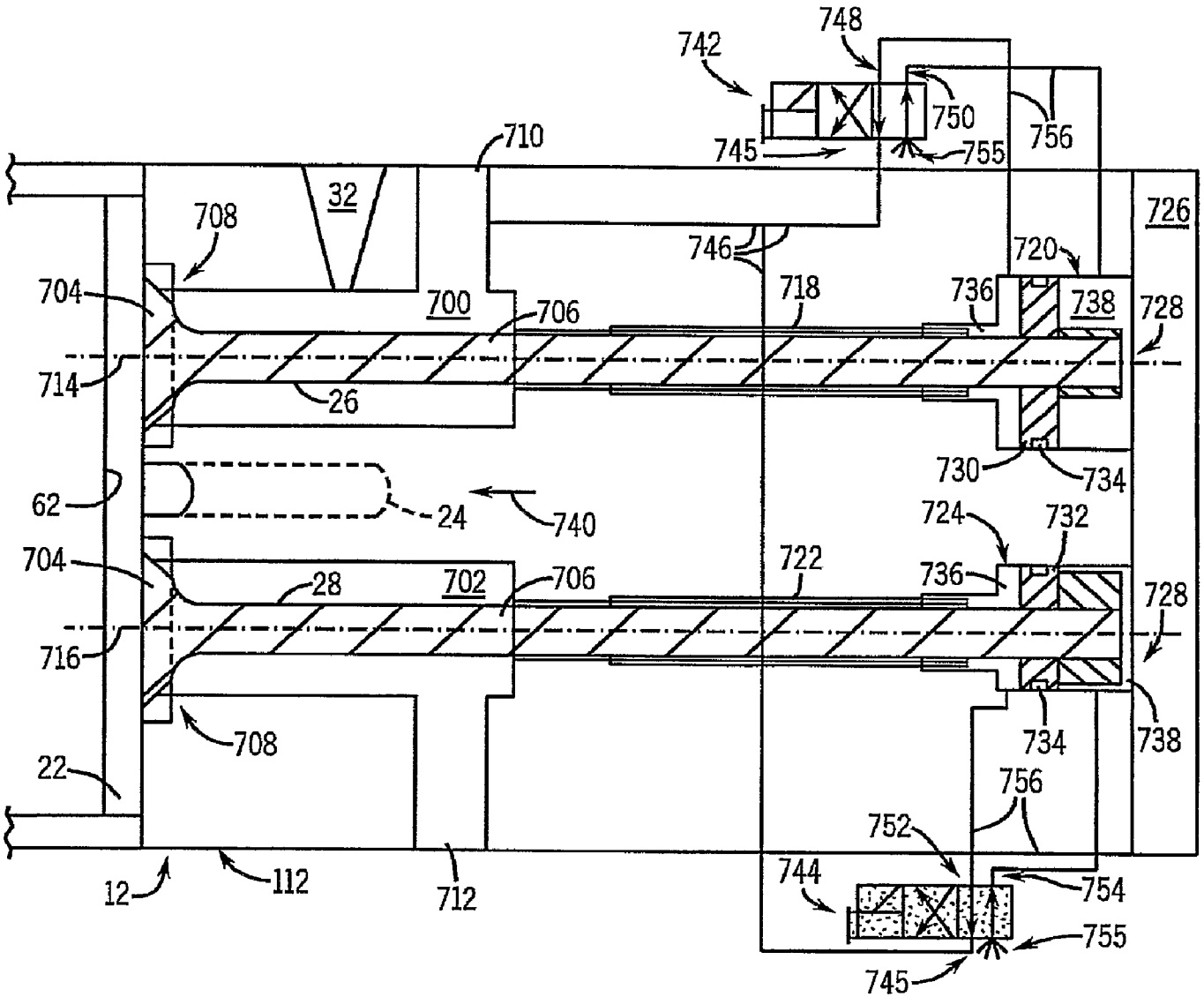
FIG. 5B is a partially cross-sectional, partially cut away (and partially schematic) side elevation view of portions of one of the cylinders shown in FIG. 4 (including the piston positioned therein), particularly an exemplary cylinder head and certain components associated with the cylinder head including a pressurized induction module, intake and exhaust valves, and a fuel injector (such as are shown in FIG. 2), as well as additional components employed to actuate the valves.

Turning to FIG. 5B, a partially cross-sectional, partially cut away (and partially schematic) side elevation view is provided showing portions of one of the cylinders 10 and 12 (namely, the cylinder 12), including one of the cylinder heads 112 of such cylinder along with associated components that can be mounted upon or within that cylinder head. Also, FIG. 5B shows the piston 62 within the cylinder 12 to be at a top dead center position, and the combustion chamber 22 formed within the cylinder by the piston and walls of the cylinder. Although FIG. 5B in particular is directed to the cylinder 12, it is equally representative of the cylinder head components associated with the other cylinders 10, 14, 16, 50 and 52 of the engine 4 of FIG. 2.

More particularly with respect to the components mounted upon/within the cylinder head 112, FIG. 5B shows the cylinder head 112 to include a respective one of the intake valves 26, a respective one of the exhaust valves 28, a respective one of the fuel injectors 32, and a respective one of the sparking devices 24. The cylinder head 112, and particularly a portion of the cylinder head in which is formed a main induction cavity 700, can be considered as the pressurized induction module 30 of the cylinder 12. Further as shown, in the present embodiment, each of the intake and exhaust valves 26 and 28 are poppet-type valves having respective valve heads 704 and respective valve stems 706. Each of the respective valve heads 704 is capable of resting against and in the present view is shown to be resting against, a respective valve seat 708 mounted within the cylinder head 112. Additionally, the main induction cavity 700 extends between the respective valve seat 708 associated with the intake valve 26 and an input port 710, by which the main induction cavity receives pressurized air from the air tank 36 by way of one of the links 56 (see FIG. 2). By contrast, an exhaust cavity 702 extends between the respective valve seat 708 associated with the exhaust valve 28 and an output port 712, which can lead to the outside environment or to an exhaust processing system (e.g., a catalytic converter).

Also as shown, the intake valve 26 extends through the main induction cavity 700 along an axis 714, and further extends beyond the main induction cavity through the cylinder head 112 via a valve guide/passageway 718 up to an intake plunger chamber 720 (the valve stem being slip-fit within the valve guide/passageway) formed within the cylinder head 112. Similarly, the exhaust valve 28 extends through the exhaust cavity 702 along an axis 716, and further extends beyond the exhaust cavity via a valve guide/passageway 722 up to an exhaust plunger chamber 724 (again with the valve stem being slip-fit within the valve guide/passageway) also formed within the cylinder head 112. A cover 726 of the cylinder head 112 serves as an end portion of the cylinder head and also serves to form end walls of the plunger chambers 720 and 724. In at least some embodiments, the valve guide/passageway 722 has a slightly larger diameter than the valve guide/passageway 718, to allow for greater heat expansion of the exhaust valve stem 706. Although the respective plunger chambers 720 and 724 are substantially sealed from the main induction cavity 700 and exhaust cavity 702, respectively, there can be some small amount of leakage between the respective cavities and chambers by way of the respective valve guides/passageways 718 and 722, respectively. Leakage of air in this manner can serve to cool the valves 26, 28, and generally does not undermine operation of the valves 26, 28.

Located within the respective plunger chambers 720 and 724, respectively, at respective far ends 728 of the intake and exhaust valves 26 and 28, respectively (which are opposite the respective valve heads 704 of those valves), are respective plungers 730 and 732 of those valves. The plungers 730, 732 are generally cylindrical structures having diameters greater than the valve stems 706 of the valves 26, 28. At least certain portions of the respective plungers 730, 732 have outer diameters that are substantially equal to (albeit typically slightly less than) corresponding inner diameters of the respective plunger chambers 720 and 724, respectively. O-rings 734 are fitted into circumferential grooves around the outer circumferences of the plungers 730, 732. Consequently, respective inner portions 736 of the respective plunger chambers 720, 724 are substantially sealed relative to respective outer portions 738 of those plunger chambers by the respective plungers 730, 732 with their O-rings 734. In the present embodiment, the plunger 730 of the intake valve 26 has a larger diameter than the plunger 732 of the exhaust valve 28, although in alternate embodiments the diameters can be the same (or even the plunger 732 can have the larger diameter).

In the view provided, the valves 26, 28 are both in closed positions such that the air/fuel mixture within the main induction cavity 700 cannot be delivered to the combustion chamber 22 within the cylinder 12, and such that any exhaust byproducts within the combustion chamber cannot be delivered from that chamber into the exhaust cavity 702. However, actuation of the respective valves 26, 28 causes those valves to open, more particularly, by moving along their axes 714, 716 in a direction indicated by an arrow 740.

In contrast to many conventional engines that employ camshafts and various valve train components, in the present embodiment the opening and closing of the valves 26, 28 is accomplished electronically and pneumatically. More particularly, pressurized air supplied to the main induction cavity 700 is further communicated to input ports 745 of both a first 4-way solenoid-actuated poppet valve 742 and a second 4-way solenoid-actuated poppet valve 744 (electronic control signals being provided to these valves from the electronic control circuitry 116) by way of lines 746. First and second output ports 748 and 750, respectively, of the first poppet valve 742 are coupled by lines 756 to the respective inner portion 736 and outer portion 738 of the intake plunger chamber 720, while first and second output ports 752 and 754, respectively, of the second poppet valve 744 are coupled by others of the lines 756 to the respective inner portion 736 and outer portion 738 of the exhaust plunger chamber 724. Based upon the position of the first poppet valve 742, the pressurized air is either supplied to the inner portion 736 or the outer portion 738 of the intake plunger chamber 720 and, complementarily, the outer portion or the inner portion of that plunger chamber is exhausted to the outside environment (by way of an exhaust port 755). Likewise, based upon the position of the second poppet valve 744, the pressurized air is either supplied to the inner portion 736 or the outer portion 738 of the exhaust plunger chamber 724 and, complementarily, the outer portion or the inner portion of that plunger chamber is exhausted to the environment.

FIG. 5B in particular shows both of the poppet valves 742, 744 to be positioned such that pressurized air is directed to the inner portions 736 of both of the plunger chambers 720, 724. Due to the interaction of this pressurized air with the plungers 730, 732, both the intake valve 26 and the exhaust valve 28 are in their closed positions as shown. Particularly with respect to the intake valve 26, the pressure exerted by the pressurized air within the main intake conduit 700 upon the valve head 704 tending to open the valve is outweighed by the pressure exerted by the pressurized air within the inner portion 736 of the intake plunger chamber 720, since in the present embodiment the plunger 730 has a surface area greater than the exposed portion of the valve head. Also, when the valves are closed, the pressures experienced at opposite ends of the valve guides/passageways (e.g., the pressures within the cavity 700 and the inner portions 736 of the plunger chambers 720, 724) are identical.

Upon actuating the first poppet valve 742 so as to direct the pressurized air to the outer portion 738 of the intake plunger chamber 720, however, the intake valve 26 is moved in the direction of the arrow 740 and forced open. Similarly, upon actuating the second poppet valve 744 so as to direct the pressurized air to the outer chamber 738 of the exhaust plunger chamber 724, the exhaust valve 28 is moved in the direction of the arrow 740 and force open. Actuation of the poppet valves 742, 744 causes the valves 26, 28 to open fast enough (e.g., within 10 ms or less), and leakage through the valve guides/passageways 718, 722 is typically slow enough, that no appreciable changes in the pressures within the inner portions 736 of the plunger chambers 720, 724 due to such leakage occurs through those guides/passageways. The relatively large diameter of the plunger 730 is advantageous insofar as it helps guarantee that the intake valve 26 will open. Further, although not necessarily the case, in the present embodiment the volume occupied by the plunger 732 within the exhaust plunger chamber 724 is relatively large (and larger than the volume occupied by the plunger 730 within the chamber 720) so that relatively little time is required to fill in the outer portion 738 of the chamber 724 with pressurized air, thus leading to a quicker response in the opening of the exhaust valve 28.

Particularly with respect to the intake valve 26, the speed with which the intake valve opens is further enhanced by the influence of the pressurized air within the main induction cavity 700 upon the valve head 704 of the intake valve 26. The speed of air (and fuel) entry is sufficiently great that the process can be termed "pressure wave induction", and the complete induction process can in some embodiments take less than 10 ms (or even a shorter time when operating the engine at less than full throttle). In at least some embodiments, the fuel injector 32 is energized slightly before the intake valve 26 opens, so that virtually all of the fuel injected for a given combustion stroke of the engine will be swept into the combustion chamber and used during that stroke. The time during which the second poppet valve 744 is actuated, which controls the opening of the exhaust valve 28, is generally longer than the time during which the first poppet valve 742 is actuated, and the timing of the former can be of particular significance in terms of causing appropriately-timed closing of the exhaust valve.

In general, because the induction of fuel/air into the combustion chamber 22 is accomplished electronically and pneumatically, any manner of timed actuation of the valves 26, 28 can be performed. Further, in comparison with some valves that are moved strictly electronically by way of solenoid actuation, the presently-described manner of actuating valves is advantageous in certain regards. In particular, because the valves 26, 28 in the present embodiment are piloted (controlled) electronically by the poppet valves 742, 744 but driven pneumatically as a result of the compressed air, actuation of the valves 26, 28 can be achieved in a manner that is not only rapid and easily controlled, but also requires only relatively low voltages/currents to drive the solenoids of the poppet valves. Additionally it should be further noted that, while actuation of the valves 26, 28 over times on the order of 10 ms is not particularly fast in terms of valve actuation, it is sufficient for the present embodiment of the engine 4. As will be described further below, the present embodiment of the engine is able to provide greater torque that many conventional engines. Because the engine has more torque, it can run slower than a comparable crankshaft-based engine. Further, although the embodiment of FIG. 5B shows the pressurized air to be applied to the surfaces of the plungers 730, 732 in order to actuate the valves 26, 28, in other embodiments pressurized air can alternatively be applied other components (e.g., components coupled to the valves) that in turn cause actuation of the valves.

Figure 6A:
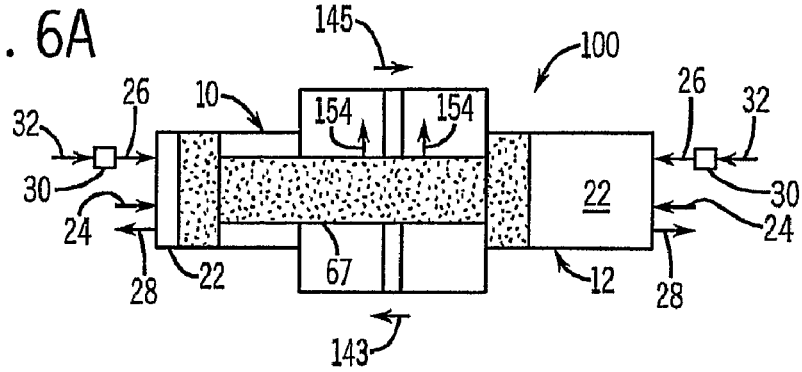
FIGS. 6A-6D respectively show in simplified schematic form an assembly including a pair of oppositely-oriented cylinders, a pair of interconnected pistons that are capable of movement within those cylinders and associated hydraulic valves and other components, as can be employed within the hydraulic engine of FIGS. 2-5B, where some of those components are shown to be in first, second, third and forth positions, respectively.
Figure 6B:
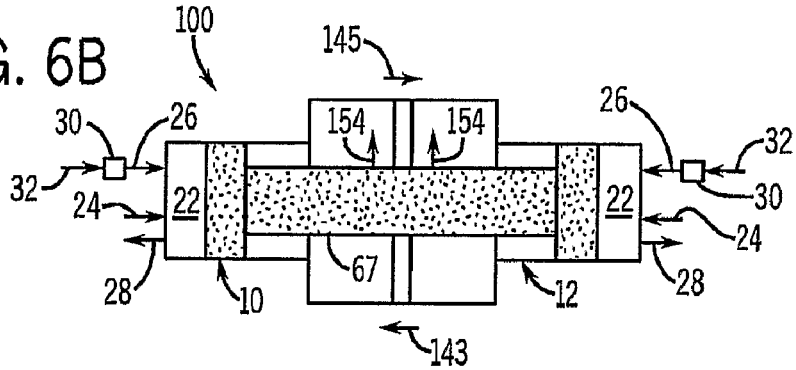
Figure 6C:
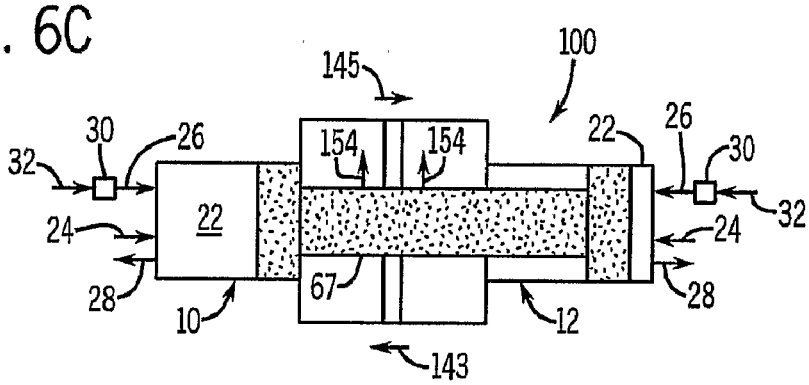
Figure 6D:
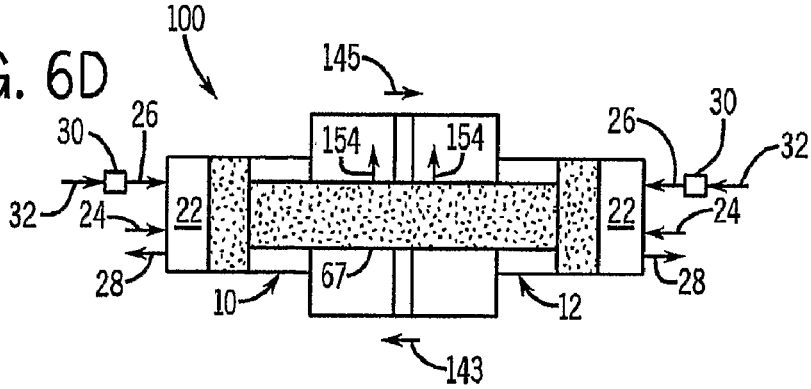

Turning to FIGS. 6A-6D, during normal operation of the engine 4, the piston assemblies within the engine 4 such as the piston assembly 67 such as that described with respect to FIGS. 4 and 5A (as well as the piston assemblies within the other pairs of cylinders 14, 16 and 50, 52) move back and forth between respective first and second end-of-travel (EOT) positions. FIGS. 6A-6D respectively provide four exemplary views of the cylinder assembly 100 as its piston assembly 67 arrives at, and moves between, such first and second EOT positions. More particularly, FIGS. 6A and 6C respectively show the piston assembly 67 to be at the first and second EOT positions, which in the present example are left and right EOT positions (albeit in any given arrangement those positions need not be described as being leftward or rightward relative to one another), while FIGS. 6B and 6D show the piston assembly 67 to be at intermediate positions moving from the left EOT position to the right EOT position and vice-versa, respectively.

Referring to FIG. 6A in particular, the piston assembly 67 as shown is at the left EOT position (similar to the position shown in FIG. 4), where the combustion chamber 22 associated with the first cylinder 10 is reduced in size and the combustion chamber of the second cylinder 12 is larger in size. By referring to this position of the piston assembly 67 as the left EOT position, this is not to say that the piston assembly 67 necessarily has moved to its maximum position towards the left (e.g., in the direction indicated by the arrow 143), such that the connector tube collar 134 within the second cylinder 12 reaches the oil seal cover 142 within the dashpot assembly 136 of that cylinder (as shown in FIG. 5A), much less that the piston 62 within the first cylinder 10 reaches the cylinder head 112 of that cylinder. Rather, in the present embodiment (albeit not necessarily in all embodiments), the left EOT position should be understood as encompassing a positional range in which the connector tube collar 134 within the cylinder 12 has proceeded far enough into the dashpot assembly 136 associated with that cylinder such that a threshold capacitance change has occurred as determined by the electronic control circuitry 116 based upon the signals received from that dashpot assembly via the electrode 154. For purposes of discussion below, each of the electrodes 154 associated with the two dashpot assemblies 136 of the cylinder assembly 100 can be considered a capacitance sensor and, more particularly, an EOT sensor.

In contrast to FIG. 6A, FIG. 6C shows the piston assembly 67 of the cylinder assembly 100 to have shifted to the opposite, right EOT position such that the combustion chamber 22 associated with the second cylinder 12 is reduced in size and the combustion chamber associated with the first cylinder 10 is expanded in size. Again, the attainment of the right EOT position does not necessarily require that the connector tube collar 134 associated with the first cylinder 10 necessarily be positioned so far into the dashpot assembly 136 of that cylinder such that the connector tube collar impacts the oil seal cover 142 of that dashpot assembly, or that the piston 62 within the second cylinder 12 impact the cylinder head 112 of that cylinder. Rather, in the present embodiment, the attainment of the right EOT position entails the positioning of the connector tube collar 134 of the first cylinder 10 far enough into the dashpot assembly 136 of that cylinder such that a threshold capacitance change as determined by the electronic control circuitry 116 has occurred. As for FIG. 6B, that figure shows the piston assembly 67 to be moving along a direction indicated by an arrow 145 to the right (opposite to the direction of the arrow 143), away from the left EOT position of FIG. 6A toward the right EOT position of FIG. 6C. In contrast, FIG. 6D shows the piston assembly 67 in progress as it is moving back from the right EOT position of FIG. 6C back toward the left EOT position of FIG. 6A, along the direction of the arrow 143.

In addition to showing various positions of the piston assembly 67, FIGS. 6A-6D also show in schematic form the various input and output devices employed in conjunction with the cylinder assembly 100 that can be controlled and/or monitored by the electronic control circuitry 116. More particularly, each of FIGS. 6A-6D show the sparking devices 24, the intake valves 26, the exhaust valves 28, and the fuel injectors 32 associated with each of the cylinders 10, 12 (particularly the cylinder heads) of the cylinder assembly 100. The respective fuel injectors 32 in particular are shown to be linked to the respective intake valves 26 by way of the respective pressurized induction modules 30 that, although not controlled devices themselves, nonetheless are configured to receive the fuel from the fuel injectors 30 as well as pressurized air from the links 56 (see FIG. 2) and to provide that fuel/air mixture to the respective intake valves 26. Further as shown in FIGS. 6A-6D, each of the cylinder assemblies 100 is shown to include the electrodes/EOT sensors 154 associated with the first and second cylinders 10 and 12, respectively. The EOT sensors 154 shown are intended to signify that output signals indicative of capacitance and particularly indicative of capacitance levels associated with movement of the piston assembly 67 to its right and left EOT positions can be provided from those sensors.

Given that a pair of each of the components 24-32 and 154 is shown to be implemented with respect to the cylinder assembly 100, and given that a first of each of those pairs of components is associated with the first cylinder 10 toward which the piston assembly 67 moves to attain the left EOT position while a second of each of those pairs of components is associated with the second cylinder 12 toward which the piston assembly moves to attain the right EOT position, henceforth for simplicity of description those first components associated with the first cylinder will be referred to as the respective "left" components of the cylinder assembly while those second components associated with the second cylinder will be referred to as the respective "right" components of the cylinder assembly. It should be noted that, given this convention, the "right" EOT sensor within the second cylinder 12 senses whether the piston assembly 67 has reached the left EOT position, while the "left" EOT sensor within the first cylinder 10 senses whether the piston assembly has reached the right EOT position.

Notwithstanding this convention employed in the present description, it should at the same time be understood that this convention is merely being employed for convenience herein, and that any given embodiment of the present invention need not in particular have pairs of components that are oriented in a leftward or rightward manner with respect to any arbitrary reference point. Indeed, regardless of any particular descriptive language used herein, the present invention is intended to encompass a wide variety of embodiments having components arranged relative to one another and to other reference points in a variety of manners, and not merely the particular arrangements shown herein.

Figure 7:
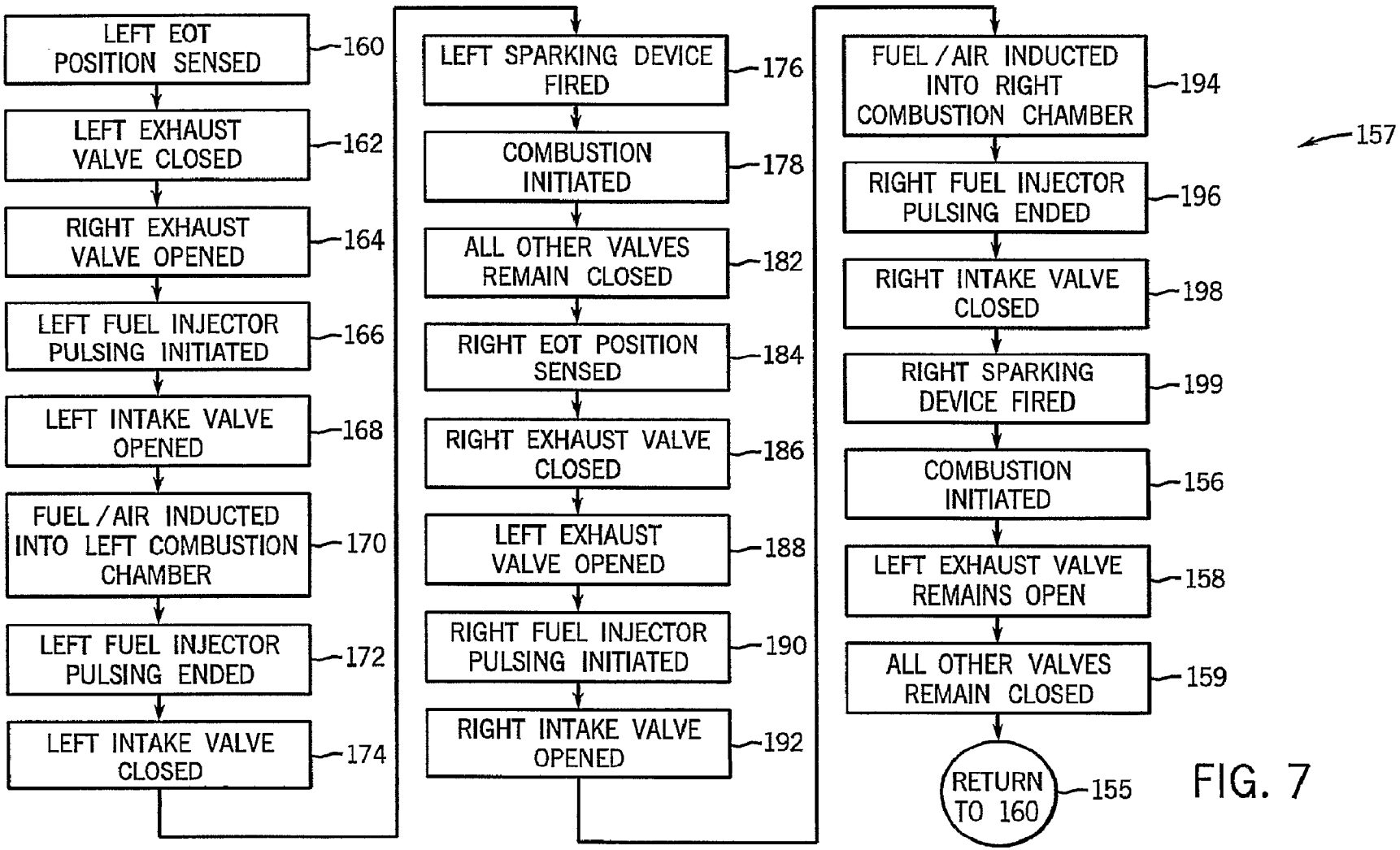
FIG. 7 is a flow chart illustrating a sequence of steps performed by components of the hydraulic engine of FIGS. 2-3 in moving the interconnected pistons of FIG. 6A-6D to and from the positions shown in those figures.

Turning to FIG. 7, a flow chart 157 shows exemplary steps of operation/actuation of the components 24-32 and 154 associated with the cylinder assembly 100 that are performed in order to move the piston assembly 67 therein between the left and right EOT positions as illustrated by the FIGS. 6A-6D. As shown, when the piston assembly 67 arrives at the left EOT position as represented by FIG. 6A, the arrival of the piston assembly at this position is sensed at a step 160 by way of the right EOT sensor 154 at the right dashpot assembly 136 when that dashpot assembly receives the right connector tube coupler 134 and consequently a threshold capacitance change occurs. Next, at a step 162, the left exhaust valve 28 is closed and further, at a step 164, the right exhaust valve 28 is opened. The exact timing of the closing of the left exhaust valve 28 relative to the arrival of the piston assembly 67 at the left EOT position in at least some embodiments depends on engine speed as determined via an engine speed sensor (as further described below with respect to FIG. 13).

Subsequently, at a step 166, the left fuel injector 32 is switched on to begin a pulsing of fuel into the left pressurized induction module 30. Then, at a step 168, the left intake valve 26 is opened and, at a step 170, the fuel/air mixture received by the left pressurized induction module 30 from the left fuel injector 32 and from the air tank 36 (by one of the links 56) is inducted into the left combustion chamber 22 at very high speeds. The timing difference between the time at which the fuel injector 32 begins spraying and the time at which the intake valve physically opens can be approximately 5 to 10 ms, and this delay is advantageous for allowing fuel to enter completely into the combustion chamber; nevertheless, in other embodiments this delay may be negligible or zero. Eventually, at a step 172, the left fuel injector 32 is switched off to stop pulsing fuel into the left pressurized induction module 30 and, at a step 174, the left intake valve 26 is closed. Once this has occurred, the appropriate amount of fuel/air mixture has been provided into the left combustion chamber 22. At this time the left sparking device 24 is fired at a step 176, as a result of which combustion is initiated as represented by a step 178. Once the combustion is initiated, the piston assembly 67 begins to move rightward in the direction of the arrow 145 as shown in FIG. 6B. During this time period, the right exhaust valve 28 remains open while all of the other valves (e.g., the left intake and exhaust valves as well as the right intake valve) remain closed, as indicated by a step 182.

As corresponds to FIG. 6C, the piston assembly 67 in the present example continues to move rightward until it arrives at the right EOT position. The arrival of the piston assembly 67 at this position is sensed by way of the left EOT sensor 154 associated with the left dashpot assembly 136 when that dashpot assembly receives the left connector tube collar 134 and consequently a threshold capacitance change occurs at that dashpot assembly, at a step 184. After the arrival at the right EOT position has been sensed, at steps 186 and 188 the right and left exhaust valves 28 are closed and opened, respectively. As with the left exhaust valve 28, the exact timing of the closing of the right exhaust valve relative to the arrival of the piston assembly 67 at the right EOT position in at least some embodiments depends on engine speed as determined via an engine speed sensor (as further described below with respect to FIG. 13). In any event, subsequent to the steps 186 and 188, at a step 190 the right fuel injector 32 is turned on, causing it to begin pulsing fuel into the right pressurized induction module 30. Next, at a step 192, the right intake valve 26 is opened such that, at a further step 194, the fuel/air mixture is inducted from the right pressurized induction module 30 into the right combustion chamber 22.

Eventually, at a step 196, the right fuel injector 32 is switched off and then, at a step 198, the right intake valve 26 is closed. Once this has occurred, the appropriate amount of fuel/air mixture has been provided into the right combustion chamber 22. Then, at a step 199, the right sparking device 24 is fired, thus causing combustion to begin within the right combustion chamber 22 at a step 156. Upon the initiation of combustion, the piston assembly 67 moves leftward as represented by the arrow 143 of FIG. 6D. During this time, the left exhaust valve 28 remains open as represented by a step 158, allowing exhaust products resulting from the previous combustion event of the step 178 to exit the left combustion chamber 22. Additionally during this time, all of the other valves (e.g., the right intake and exhaust valves as well as the left intake valve) remain closed, as represented by a step 159. After this time, the sequence of the flow chart 157 can return to the step 160 as the piston assembly 67 again reaches the left EOT position, as represented by a return step 155.

Figure 8:
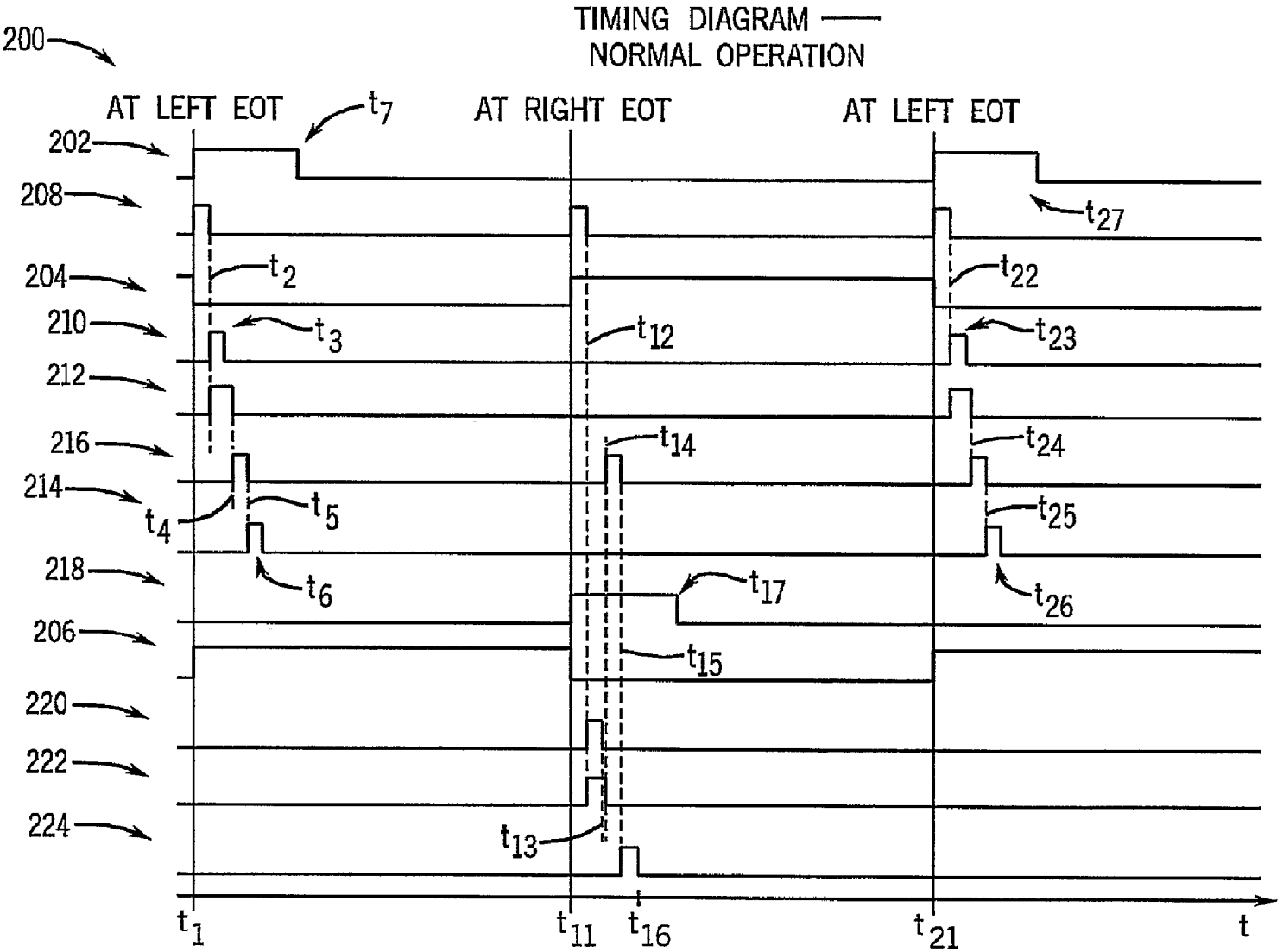
FIGS. 8-11 are timing diagrams illustrating four different manners of operation of the hydraulic engine of FIG. 2 in terms of influencing the positioning of a pair of interconnected pistons such as those of FIG. 4 and FIGS. 6A-6D.

Referring additionally to FIG. 8, a timing diagram 200 further illustrates exemplary timing of the actuation of the various components 24-32, 154 (and certain related timing characteristics) when those components are operated in the manner shown in FIGS. 6A-7 in which the piston assembly 67 is driven back and forth between the left and right EOT positions. The timing diagram 200 in particular shows twelve different graphs 202-224 that represent the various statuses of the components 24-32, 154 (as well as certain differences between those signals that are of interest). As shown, at a first time $T_1$ at which the piston assembly 67 arrives at the left EOT position, a left EOT position graph 202 is shown to switch from a low value to a high value indicating that the capacitance as sensed by the right EOT sensor 154 has reached a threshold. In the present embodiment when this occurs, a left exhaust valve graph 204 immediately switches off (e.g., switches from a high value to a low value), corresponding to a command that the left exhaust valve 28 be closed, and also a right exhaust valve graph 206 transitions on (e.g., switches from a low value to a high value), corresponding to a command that the right exhaust valve be opened.

Subsequent to the time $T_1$, at a time $T_2$, a left fuel injector graph 210 switches on, corresponding to the initiating of the pulsing of fuel into the left pressurized induction module 30 by the left fuel injector 32. Also at the time $T_2$, a left intake valve graph 212 switches on, indicating that the left intake valve 26 has been opened (or at least is beginning to open) such that the fuel/air mixture within the left pressurized induction module 30 can enter into the left combustion chamber 22. The difference between the times $T_2$ and $T_1$ is further illustrated by a left intake valve delay graph 208, and that difference in the times in particular is set so as to provide sufficient time to allow the left exhaust valve 28 to close (it does not do so instantaneously) prior to the opening of the left intake valve 26. Subsequently, at a time $T_3$, the left fuel injector graph 210 again switches off, corresponding to the cessation of pulsing of the left fuel injector 32. Then, at a time $T_4$, the left intake valve graph 212 also switches low, indicating that the left intake valve 26 has been closed such that no further amounts of fuel/air mixture can proceed into the left combustion chamber 22. Next, at a time $T_5$, a left sparking device graph 214 transitions from a low level to a high level, indicating that the left sparking device 24 has been actuated. A sparking delay graph 216 illustrates the amount of delay time that occurs between the times $T_4$ and $T_5$.

After transitioning high at the time $T_5$, the left sparking device graph 214 remains at a high level until a time $T_6$, at which time it returns to a low level, signifying that the left sparking device 24 has been switched off again. Although actuation of the left sparking device 24 within the time period between the times $T_5$ and $T_6$ can involve a single triggering of that device to produce only a single spark (e.g., at or slightly after the time $T_5$), in alternate embodiments the actuation of the left sparking device can involve repeated (e.g., periodic) triggering of that device to produce multiple sparks within that time period. This can be appropriate in at least some circumstances where the combustion event resulting from a single spark within the left combustion chamber 22 might leave a portion of the fuel/air mixture within the chamber uncombusted, but repeated sparks over a period of time better guarantees that all (or substantially all) of the fuel/air mixture within the left combustion chamber 22 has been combusted.

Regardless of the particular manner in which the left sparking device 24 is actuated, due to the sparking activity, combustion occurs within the left combustion chamber 22 and, as a result, the piston assembly 67 is moving to the right along the direction of the arrow 145 as shown in FIG. 6B. Consequently, at a time $T_7$, the piston assembly 67 has moved sufficiently far to the right that it is no longer in the left EOT position, and consequently the left EOT position graph 202 switches off. Subsequent to the time $T_7$, all of the graphs 202-216 remain at low levels until a time $T_{11}$, with the exception of the graph 206 representing actuation of the right exhaust valve 28, which remains high since the right exhaust valve 28 remains open. During this time period between the times $T_7$ and $T_{11}$, the piston assembly 67 continues to move in the direction 145.

At the time $T_{11}$, the left dashpot assembly 136 receives the left connector tube collar 134 to a sufficient degree that the left EOT sensor 154 produces a signal indicative of a capacitance that has increased above a threshold level. Thus, at this time, a right EOT position graph 218 transitions from a low level to a high level. Upon this occurring, also at the time $T_{11}$, the left exhaust valve graph 204 immediately is transitioned from a low level to a high level and the right exhaust valve graph 206 is transitioned from a high level to a low level, such that the left exhaust valve 28 is caused to open and the right exhaust valve is caused to close. Subsequently, at a time $T_{12}$ (which occurs after the time $T_{11}$ by an amount of time sufficient to allow the right exhaust valve to close, as shown by the intake valve delay graph 208), a right fuel injector graph 220 switches from a low level to a high level, indicating that the right fuel injector 32 begins the pulsing of fuel into the right pressurized induction module 30. Also at this time, a right intake valve graph 222 transitions from a low level to a high level, such that the fuel/air mixture within the right pressurized induction module 30 can enter the right combustion chamber 22 of the cylinder assembly 100.

Similar to the discussion regarding the left fuel injector and left intake valve graphs 210 and 212, respectively, the right fuel injector graph 220 is subsequently switched off at a time $T_{13}$ and the right intake valve graph 222 is switched off at a time $T_{14}$. Subsequently, at a time $T_{15}$, which occurs subsequent to the time $T_{14}$ by an amount indicated by the sparking delay graph 216, a right sparking device graph 224 is switched high and then switched low again at a time $T_{16}$, and thus the right sparking device 24 is switched on between those times. Due to the actuation of the right sparking device 24 (which again, as described above, can involve the production of only a single spark or, alternatively, multiple sparks), combustion occurs within the right combustion chamber 22. This in turn causes movement of the piston assembly 67 along the direction indicated by the arrow 143 as shown in FIG. 6D. This movement of the piston assembly 67 eventually moves the piston assembly sufficiently far that the right EOT position graph 218 switches from a high value to a low value at a time $T_{17}$. Further movement of the piston assembly 67 in this direction eventually returns the piston assembly back to the left EOT position at a time $T_{21}$. Beginning at that time $T_{21}$, the operations described as occurring at times $T_1$-$T_7$ again occur, respectively. That is, at times $T_{21}$-$T_{27}$, the operations that occurred at the times $T_1$-$T_7$ are repeated. Thus, the cycle of operation can repeat indefinitely.

While FIGS. 6A-8 envision that movement of the piston assembly 67 within the cylinder assembly 100 always will proceed in a manner such that the piston assembly moves back and forth between the right and left EOT positions in response to combustion events occurring in the combustion chambers 22 of the cylinder assembly, and while this is true normally, in some circumstances operation does not and/or cannot proceed in this manner. In particular, in some circumstances (e.g., when the load upon the hydraulic wheel motor 18 is great), a given combustion event will not impart sufficient force upon the piston assembly 67 so as to cause the piston assembly to proceed all of the way to the EOT position within the cylinder opposite the cylinder at which the combustion event occurred. For example, if a combustion event occurs within the left combustion chamber 22 within the first cylinder 10 and the load upon the hydraulic chamber 64 within that same cylinder is particularly great at that time, the piston assembly 67 in that circumstance may not successfully move all of the way to the right EOT position in response to that combustion event but otherwise may stop moving somewhere in advance of the right EOT position.

Indeed, in some circumstances, it is also possible that neither the left nor the right EOT positions will be attained by the piston assembly 67 even though the piston assembly continues to be moved back and forth within the cylinder assembly 100 as a result of combustion events. Alternatively, in still other circumstances, it is possible that the force imparted to the piston assembly 67 during a given combustion event will be too low even to move that piston assembly 67 out of the EOT position in which it currently resides. In each of these circumstances, the manner of movement experienced by the piston assembly 67 within the cylinder assembly 100 will differ from that shown in FIGS. 6A-6D, particularly insofar as, depending upon the type of movement, the piston assembly 67 will not experience one or both of the EOT positions shown in FIGS. 6A and 66, or will only experience one of the EOT positions of FIGS. 6A and 6C but not experience any of the other three positions shown in FIGS. 6A-6D. Further, in such operational circumstances, the sequence of events/timing will differ from that shown in FIGS. 7-8.

Figure 9:
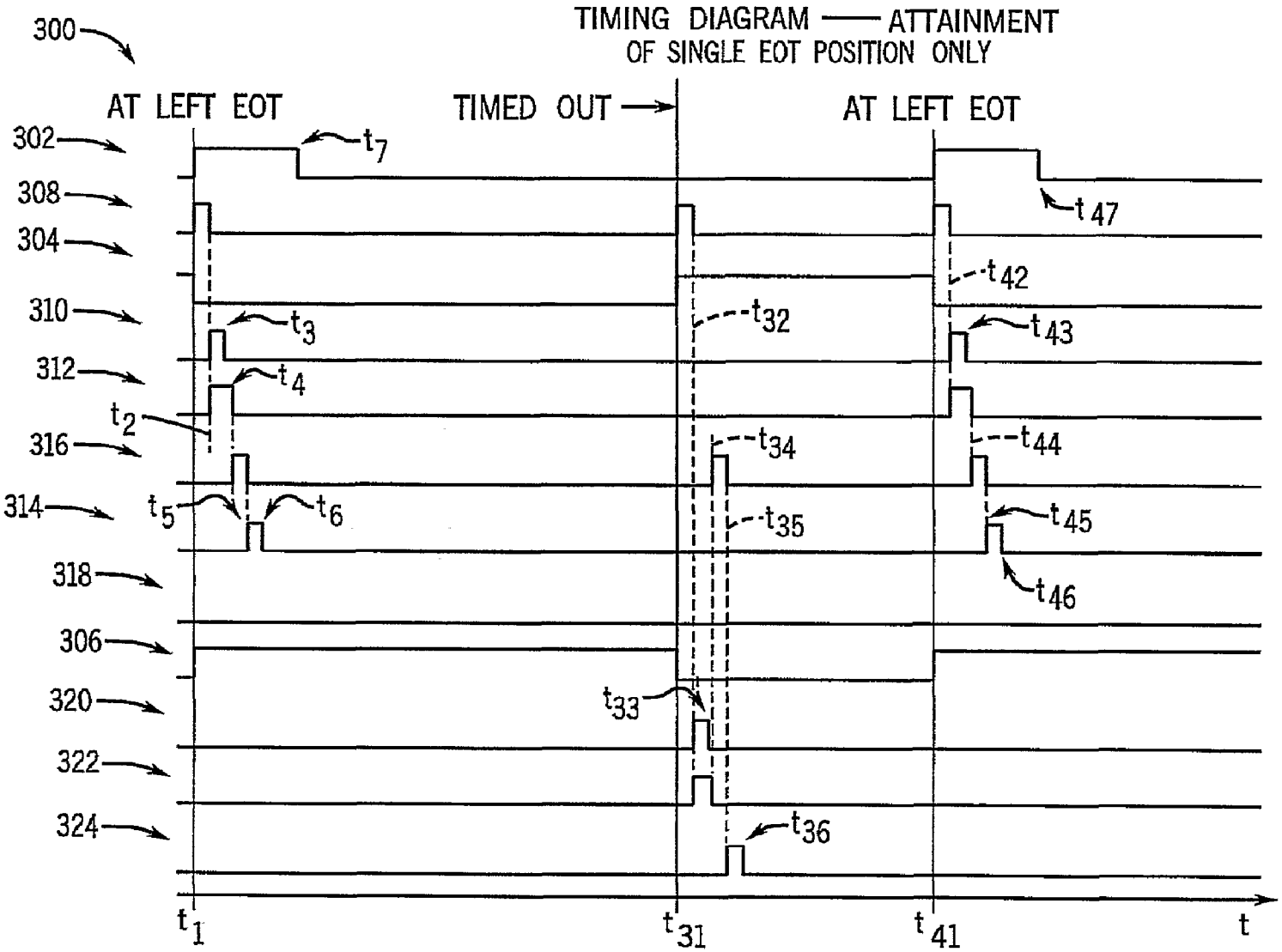
Figure 10:
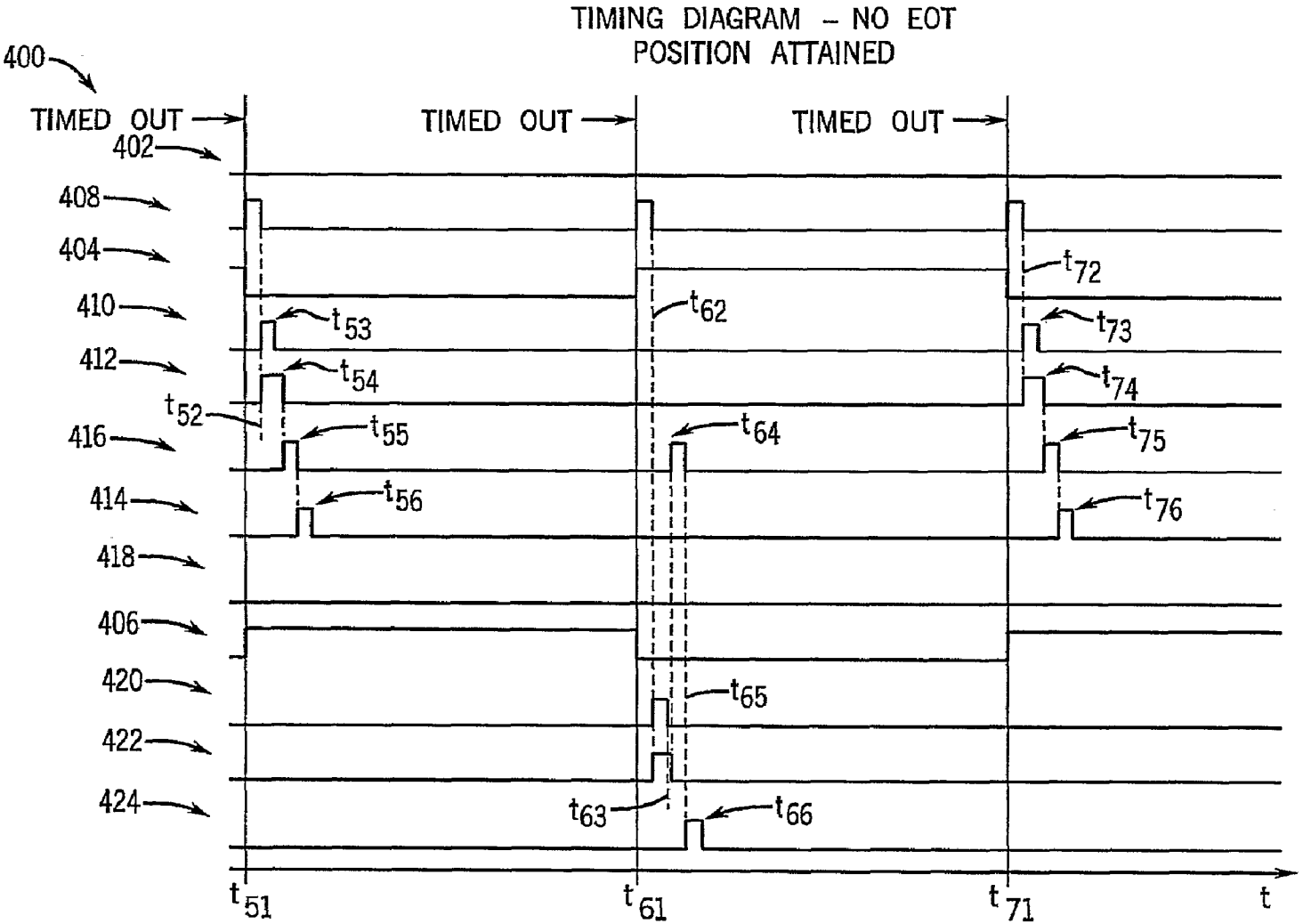
Figure 11:
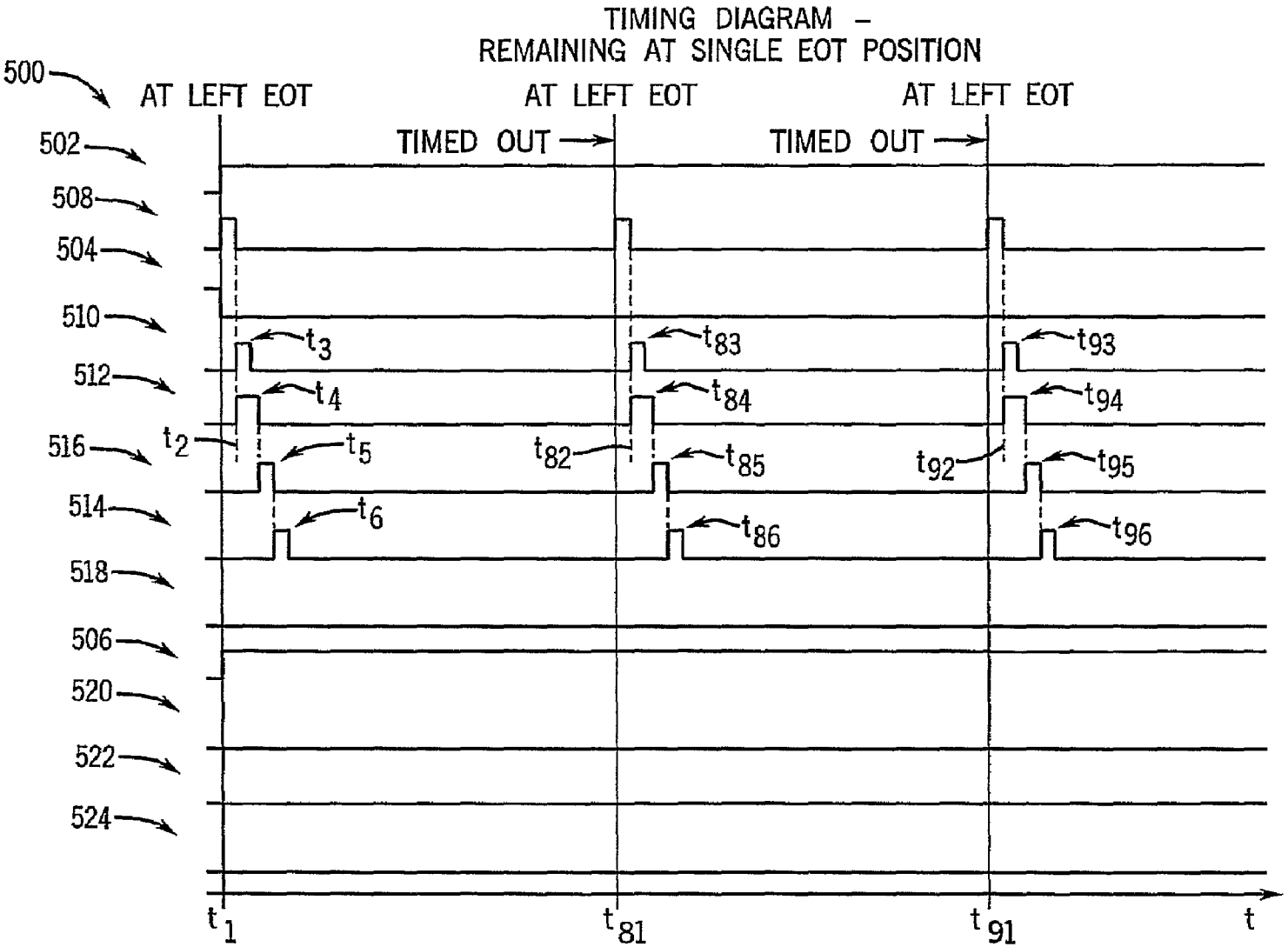

Referring to FIGS. 9-11, additional timing diagrams 300, 400 and 500, respectively, illustrate exemplary timing of the actuation of the various components 24-32, 154 (and certain related timing characteristics) when those components are operated in the three above-described "abnormal" modes of operation in which the piston assembly 67 fails to attain one or both of the EOT positions or remains within one of the EOT positions despite combustion events that should drive the piston assembly from that ROT position. Although the different manners of operation shown by FIGS. 9-11 are shown separately from one another and from the normal mode of operation of FIG. 8, it will be understood that the electronic control circuitry 116 is capable of controlling the engine 4 so that it operates to enter, exit from and switch between any of these modes of operation repeatedly and seamlessly, with no noticeable effect on operation.

Referring particularly to FIG. 9, the timing diagram 300 in particular illustrates exemplary timing of the actuation of the various components 24-32, 154 (and certain related timing characteristics) of the cylinder assembly 100 when the piston assembly 67 is able to attain and leave the left EOT position but is not able to attain the right EOT position. Although the timing diagram 300 shows exemplary operation in which the piston assembly 67 is capable of attaining and exiting the left EOT position but fails to attain the right EOT position, it will be understood that the manner of operation corresponding to the opposite manner of piston movement (e.g., where the piston assembly is capable of attaining and exiting the right EOT position but fails to attain the left EOT position) would be substantially the opposite of that described below.

More particularly, in the present example, when the piston assembly 67 attains the left EOT position at a time $T_1$, the operation initially proceeds in much the same manner as was the case in FIG. 8. That is, at the time $T_1$, a left EOT position graph 302 transitions from low to high when the cylinder assembly 67 has attained the left EOT position and consequently, at that time, a left exhaust valve graph 304 switches low so as to close the left exhaust valve 28 and a right exhaust valve graph 306 switches high so as to open the right exhaust valve 28. Then, at a time $T_2$ (which differs from the time $T_1$ by an amount of time shown by an intake valve delay graph 308), a left fuel injector graph 310 switches high, as does a left intake valve graph 312, thus turning on the fuel injector 32 and opening the left intake valve 26. Then, at a time $T_3$, the left fuel injector graph 310 switches low and at a time $T_4$ the left intake valve graph 312 switches low, so as to turn off the left fuel injector 32 and close the left intake valve 26, respectively. Further, at the times $T_5$ and $T_6$, a left sparking device graph 314 switches high and low, respectively, such that the left sparking device 24 is turned on and then off at those respective times (where the time $T_5$ occurs subsequent to the time $T_4$ by an amount of time indicated by a sparking delay graph 316). Finally, at the time $T_7$, the left EOT position graph 302 switches back to a low value as the combustion event resulting from the left sparking device 24 causes the piston assembly 67 to leave the left EOT position.

In contrast to the operation shown in FIG. 8, however, the timing diagram 300 does not show at a time $T_{11}$ the switching of a right EOT position graph 318 to a high level, since the piston assembly 67 in this example never attains that right EOT position. Rather, in this example, at a time $T_{31}$ the electronic control circuitry 116 determines that a period of time (in this example, equaling the difference between the times $T_{31}$ and $T_5$) has occurred since the beginning of the sparking performed by the left sparking device 24 and consequent commencement of a combustion event within the left combustion chamber 22. As a result, at this time $T_{31}$, the electronic control circuitry 116 causes the engine 4 to operate as if the right EOT position had been attained, even though it has not. Thus, at this time $T_{31}$, a right exhaust valve graph 306 switches to a low level such that the right exhaust valve 28 is closed, and additionally the left exhaust valve graph 304 switches to a high level such that the left exhaust valve is opened.

Subsequently, at a time $T_{32}$ (which differs from the time $T_{31}$ by an amount of time shown by the intake valve delay graph 308), a right fuel injector graph 320 switches from low to high and a right intake valve graph 322 likewise switches from low to high, thus, causing fuel to be injected into the right pressurized induction module 30 by the right fuel injector 32 and causing fuel/air mixture to be provided into the right combustion chamber 22 via the right intake valve 26. Next, at times $T_{33}$ and $T_{34}$, respectively, the right fuel injector graph 322 is switched to a low value and likewise the right intake valve graph 322 is switched to a low value, thus shutting off the right fuel injector 32 and then closing the right intake valve 26, respectively. Further, at a time $T_{35}$ (which occurs subsequent to the time $T_{34}$ by an amount of time indicated by the sparking delay graph 316), a right sparking device graph 324 switches from low to high, resulting in actuation of the right sparking device 24. This continues until a time $T_{36}$, at which the right sparking device graph 324 is again switched low. As a result of the actuation of the right sparking device 24, a combustion event within the right combustion chamber 22 occurs, and consequently the piston assembly 67 again returns to the left EOT position at a time $T_{41}$, at which time the left EOT position graph 302 again rises, the left exhaust valve graph 304 again falls and the right exhaust valve graph 306 again rises. Subsequent to the time $T_{41}$, the graphs 302-324 all operate in the same manner at respective times $T_{41}$-$T_{47}$ as occurred at the times $T_1$-$T_7$, respectively.

Referring next to FIG. 10, the timing diagram 400 illustrates exemplary timing of the actuation of the various components 24-32, 154 (and certain related timing characteristics) of the cylinder assembly 100 when the piston assembly 67 is operating in another abnormal mode in which, though the piston assembly may be experiencing movement, the piston assembly nevertheless fails to reach either the left EOT position or the right EOT position. As shown, when the piston assembly 67 is in this mode of operation, left and right EOT position graphs 402 and 418, respectively, both remain constant (e.g., at a low value) at all times, indicating that neither the left nor the right EOT positions are reached. Since the EOT positions are not reached, instead of basing the actuation of other components such as the valves 26 and 28, fuel injectors 32 and sparking devices 24 based upon the times at which the EOT positions are reached (as determined via signals from the EOT sensors 154), instead those components are actuated at other times determined by the electronic control circuitry 116.

More particularly, as shown in FIG. 10, the components 24, 26, 28 and 32 are actuated at times referenced to successive times determined by the electronic control circuitry 116 at which a timer has expired (timed out). Three such timed out conditions are shown in FIG. 10 to have occurred, namely, at times $T_{51}$, $T_{61}$ and $T_{71}$, albeit it will be understood that additional timed out conditions could occur indefinitely thereafter. In the example shown, the time $T_{51}$ begins a half cycle in which combustion occurs in the left combustion chamber 22 of the first cylinder 10. More particularly, at the time $T_{51}$, a left exhaust valve graph 404 is switched off and also a right exhaust valve graph 406 is switched on, corresponding to the closing and opening of the left and right exhaust valves 28, respectively. Subsequently, at a time $T_{52}$ (which differs from the time $T_{51}$ by an amount of time shown by an intake valve delay graph 408), each of respective left fuel injector and left intake valve graphs 410 and 412 are activated, resulting in opening of the left intake valve 26 and pulsing of the left fuel injector 32.

Subsequently, at a time $T_{53}$ the left fuel injector graph 410 transitions low, indicating the switching off of the left fuel injector 32, and at a time $T_{54}$ the left intake valve graph 412 also transitions low, indicating closure of the left intake valve 26. Finally, at a time $T_{55}$, a left sparking device graph 414 transitions high (with the time $T_{55}$ occurring subsequent to the time $T_{54}$ by an amount of time shown by a sparking delay graph 416), turning on the left sparking device 24, and then the left sparking device graph 414 transitions low at a time $T_{56}$, switching off the left sparking device. Thus, from this example, it is apparent that (at least in this embodiment) the actuation of the valves 26 and 28, fuel injector 32 and sparking device 24 subsequent to the time $T_{51}$ is identical to the manner in which those components are actuated subsequent to the time $T_1$ of FIGS. 8 and 9 when the piston assembly 67 is starting at the left EOT position. However, in the present case, the basis for actuating these components in this manner is not the arrival of the piston assembly 67 at the left EOT position, but rather is the arbitrary determination of the time $T_{51}$ by the electronic control circuitry 116.

Further as shown, because in the present embodiment the combustion event that results from the actuation of the left sparking device 24 between the times $T_{55}$ and $T_{56}$ does not result in movement of the piston assembly 67 all of the way to the right EOT position (and can in some circumstances not produce any movement at all), the time $T_{61}$ also is not determined based upon the arrival of the piston assembly at such position but rather is determined by the electronic control circuitry 116 as the expiration of a timer relative to the time $T_{55}$ (or, in alternate embodiments, some other time such as the time $T_{56}$). Nevertheless, once this time $T_{61}$ has been determined, the components 24, 26, 28 and 32 of the cylinder assembly 100 are actuated in substantially the same manner as was described above where the piston assembly 67 reached the right EOT position. That is, at the time $T_{61}$, the left exhaust valve graph 404 switches from a low level to a high level and the right exhaust valve graph 406 switches from a high level to a low level, thus opening the left exhaust valve 28 and closing the right exhaust valve.

Subsequently, at a time $T_{62}$, (which occurs subsequent to the time $T_{61}$ by an amount of time shown by the intake delay graph 408), a right fuel injector graph 420 is switched from low to high and also a right intake valve graph 422 is switched from low to high, thus causing the right fuel injector 32 to inject fuel into the right pressurized induction module 30 and causing the right intake valve 26 to be opened, respectively. Subsequently, at a time $T_{65}$, the right fuel injector graph 420 switches off, thus stopping the pulsing of the right fuel injector 32, and then later at a time $T_{64}$, the right intake valve graph 422 is shut off, thus closing the right intake valve 26. Finally, at times $T_{65}$ and $T_{66}$ (where the time $T_{65}$ follows by the time $T_{64}$ by an amount of time indicated by the sparking delay graph 416), the right sparking device graph 424 switches on and then subsequently switches off, corresponding to the switching on and off of the right sparking device 24. This actuation of the right sparking device 24 again produces a combustion event that tends to cause movement of the piston assembly 67 in the leftward direction (albeit, in some circumstances, little or no movement may actually occur, for example if the vehicle is situated up against an immovable object).

Insofar as FIG. 10 is intended to show continued movements of the piston assembly 67 back and forth between the first and second cylinders 10, 12, where the piston assembly never reaches an EOT position, beginning at a time $T_{71}$ the components 24, 26, 28 and 32 are again actuated in such a way as to cause a combustion event within the left combustion chamber 22 and cause movement of the piston assembly in the direction of the right combustion chamber. The time $T_{71}$ in particular again is determined by the electronic control circuitry 116 as a timing out of a timer relative to the time $T_{65}$ (or some other time). At and subsequent to the time $T_{71}$, the components 24, 26, 28 and 32 are actuated in the same manner as was described earlier with respect to the time $T_{51}$ and subsequent times thereafter. That is, the left exhaust valve and right exhaust valve graphs 404 and 406 again switch their respective statuses at the time $T_{71}$, the left exhaust valve and left fuel injector graphs 410 and 412 both are switched on at a time $T_{72}$ and then switched off at times $T_{73}$ and $T_{74}$, respectively, and further the left sparking device graph 414 switches on and then off at times $T_{75}$ and $T_{76}$. In the event that the piston assembly 67 never reaches an EOT position at either of the cylinders 10, 12, the operation shown in FIG. 10 can continue on indefinitely.

As for FIG. 11, the additional timing diagram 500 provides additional graphs 502-524 that illustrate exemplary timing of the actuation of the various components 24-32, 154 (and certain related timing characteristics) of the cylinder assembly 100 when the piston assembly 67 is operating in yet another abnormal mode. In this mode of operation, the piston assembly 67 remains at the left EOT position and, despite combustion events occurring within the left combustion chamber 22, is unable to leave that left EOT position. Although the timing diagram 500 shows exemplary operation in which the piston assembly 67 is unable to exit the left EOT position, it will be understood that the manner of operation corresponding to the opposite manner of operation (e.g., where the piston assembly is unable to exit the right EOT position) would be substantially the opposite of that described below.

As shown in FIG. 11, the graphs 502-524 respectively are a left EOT position graph 502, a left exhaust valve graph 504, a right exhaust valve graph 506, an intake valve delay graph 508, a left fuel injector graph 510, a left intake valve graph 512, a left sparking device graph 514, a sparking delay graph 516, a right EOT position graph 518, a right fuel injector graph 520, a right intake valve graph 522, and a right sparking device graph 524. In the present example, the piston assembly 67 first arrives at the left EOT position at the time $T_1$ (as was assumed in FIGS. 8 and 9) and then remains at that left EOT position, as indicated by a left EOT graph 502. Correspondingly, a right EOT graph 518 shows the piston assembly 67 to not be at the right EOT position during any of the time encompassed by the timing diagram 500 (albeit the piston assembly could have been at such position prior to the time $T_1$). Upon commencing operation at the time $T_1$, the components 24, 26, 28 and 32 are actuated in the same manner at that time and subsequent times $T_2$-$T_6$ as was described earlier with respect to FIGS. 8 and 9.

Because the piston assembly 67 never leaves the left EOT position as a result of the combustion event that occurs beginning at the time $T_5$, no switching of the left EOT position graph 502 occurs at any time $T_7$, but rather at a time $T_{81}$ the electronic control circuitry 116 determines that a time has expired and causes further actuation of the components of 24, 26, 28 and 32 of the cylinder assembly 100. In particular, beginning at the time $T_{81}$, the actions taken at the times $T_1$-$T_6$ described above are reperformed at times $T_{81}$-$T_{86}$, respectively (aside from the switching of the open/closed status of the exhaust valves 28, which stay in their current positions as indicated by the graphs 504 and 506). Then, since in the present example the piston assembly 67 continues to remain at the left EOT position, at a time $T_{91}$ the electronic control circuitry again recognizes that the piston assembly has not moved out of the left EOT position and as a result repeats, at times $T_{91}$-$T_{96}$, the operations already performed at the times $T_{81}$-$T_{86}$, respectively.

Figure 12:
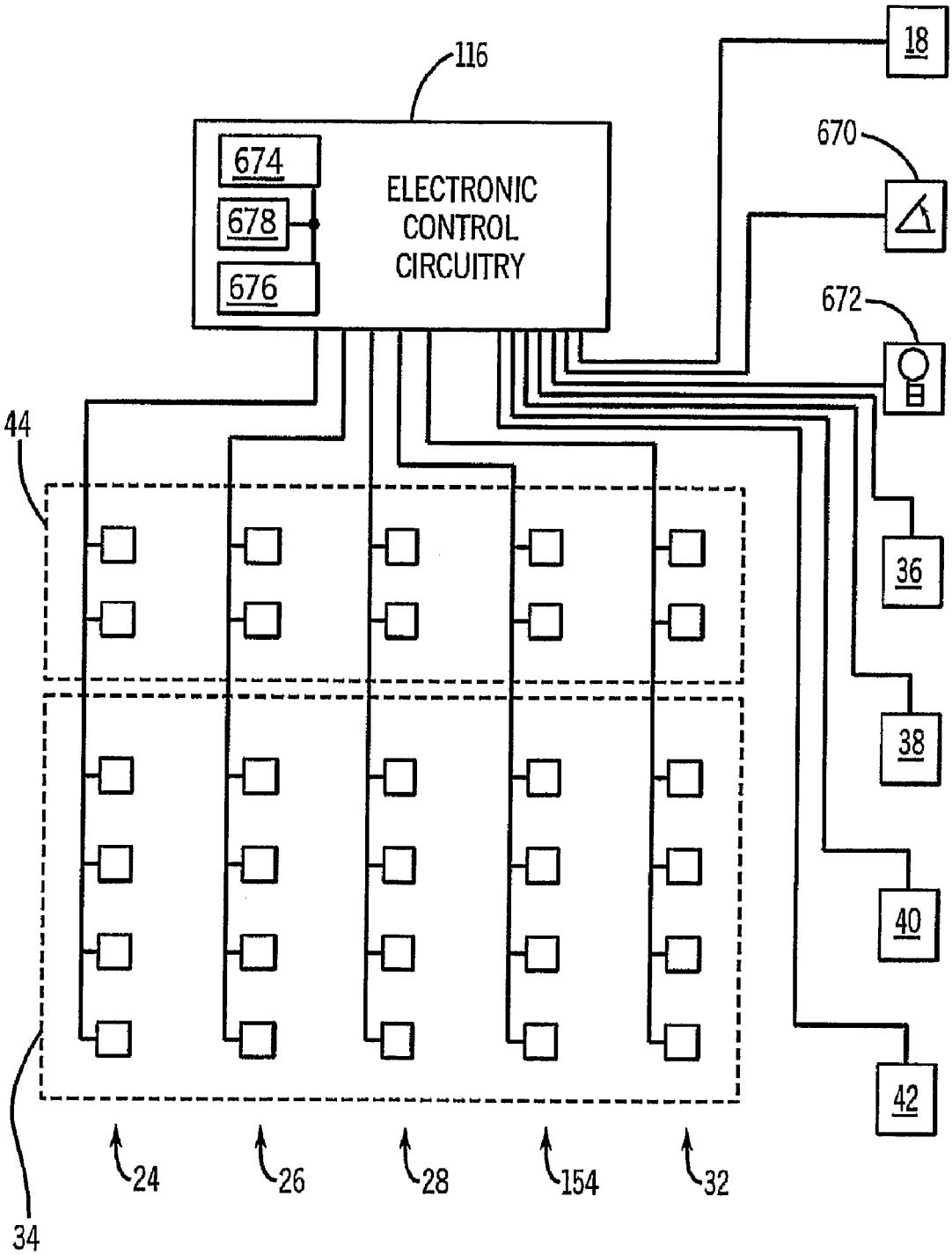
FIG. 12 is a schematic diagram illustrating exemplary interconnections among electronic control circuitry and various components of the engine of FIGS. 2-6D.

Turning to FIG. 12, exemplary communication links within the engine 4, particularly communication links between the electronic control circuitry 116 and various other components of the engine 4, are shown in more detail. Typically, links such as those shown in FIG. 12 are accomplished by way of electrical circuits, albeit other embodiments employing other manners of achieving such communication links are also intended to be encompassed within the present invention. In particular as shown, the electronic control circuitry 116 is coupled to an accelerator pedal 670 by which the electronic control circuitry detects an operator-commanded acceleration (or velocity) setting, as well as an ignition switch 672, by which the electronic control circuitry is able to determine whether an operator has commanded the engine 4 to be turned on or off (typically based upon the presence of a key within an ignition switch, albeit such command could also be provided by an operator's entry of an appropriate code or another mechanism).

Further, the electronic control circuitry 116 is coupled to the hydraulic wheel motor 18 (more particularly, to a sensor at that wheel motor), by which the electronic control circuitry is able to determine wheel (and thus vehicle) speed. Although the wheel speed is often of interest, that speed is not necessarily (or typically) the same as engine speed. Since engine speed is also of interest (for example, in determining the timing of the closing of the exhaust valves 28 as will be described further below), the electronic control circuitry 116 further includes certain additional circuitry as shown. In particular, the electronic control circuitry 116 includes an engine speed sensor 678 that measures the rate at which left and right latches 674 and 676 (which can be considered steering or toggling latches) within the electronic control circuitry are switching. As will be described further below with respect to FIG. 13, the switching of the states of the internal latches 674, 676 is indicative of the frequency with which combustion events are occurring in the opposing combustion chambers 22 of the cylinders 10 and 12 of the engine 4, and thus an indication of engine speed. Although FIG. 12 in particular shows the electronic control circuitry 116 as including two of the internal latches 674, 676, the actual number of latches can be greater, and in particular in at least some embodiments the electronic control circuitry 116 will include a pair of latches for every pair of cylinders in the engine.

Additionally as shown, the electronic control circuitry 116 is coupled to each of the air tank 36, the main compressor 38, the auxiliary compressor 40 and the battery 42, or more particularly, to sensors located at those devices, such that the electronic control circuitry is able to receive sensory signals indicative of the air pressure within the air tank 36, the operational status of the compressors 38 and 40, and the charging, voltage or other electrical status of the battery 42. Further, the electronic control circuitry 116 is coupled to numerous controllable devices and monitorable devices within the main portion 34 of the engine 4, as well as within the auxiliary power unit 44. More particularly as shown, the electronic control circuitry 116 is coupled to each of the respective sparking devices 24, intake valves 26, exhaust valves 28, and fuel injectors 32 associated with each of the cylinders 10-16 and 50, 52 of the main portion 34 of the engine 4 and the auxiliary power unit 44. Also, the electronic control circuitry 116 is coupled to each of the electrodes/EOT sensors 154 associated with the respective dashpot assemblies 136 within each of those cylinders. Notwithstanding FIG. 12, depending upon the embodiment, the electronic control circuitry 116 can also receive signals from other devices not shown, as well as provide control signals to other devices not shown.

Figure 13:
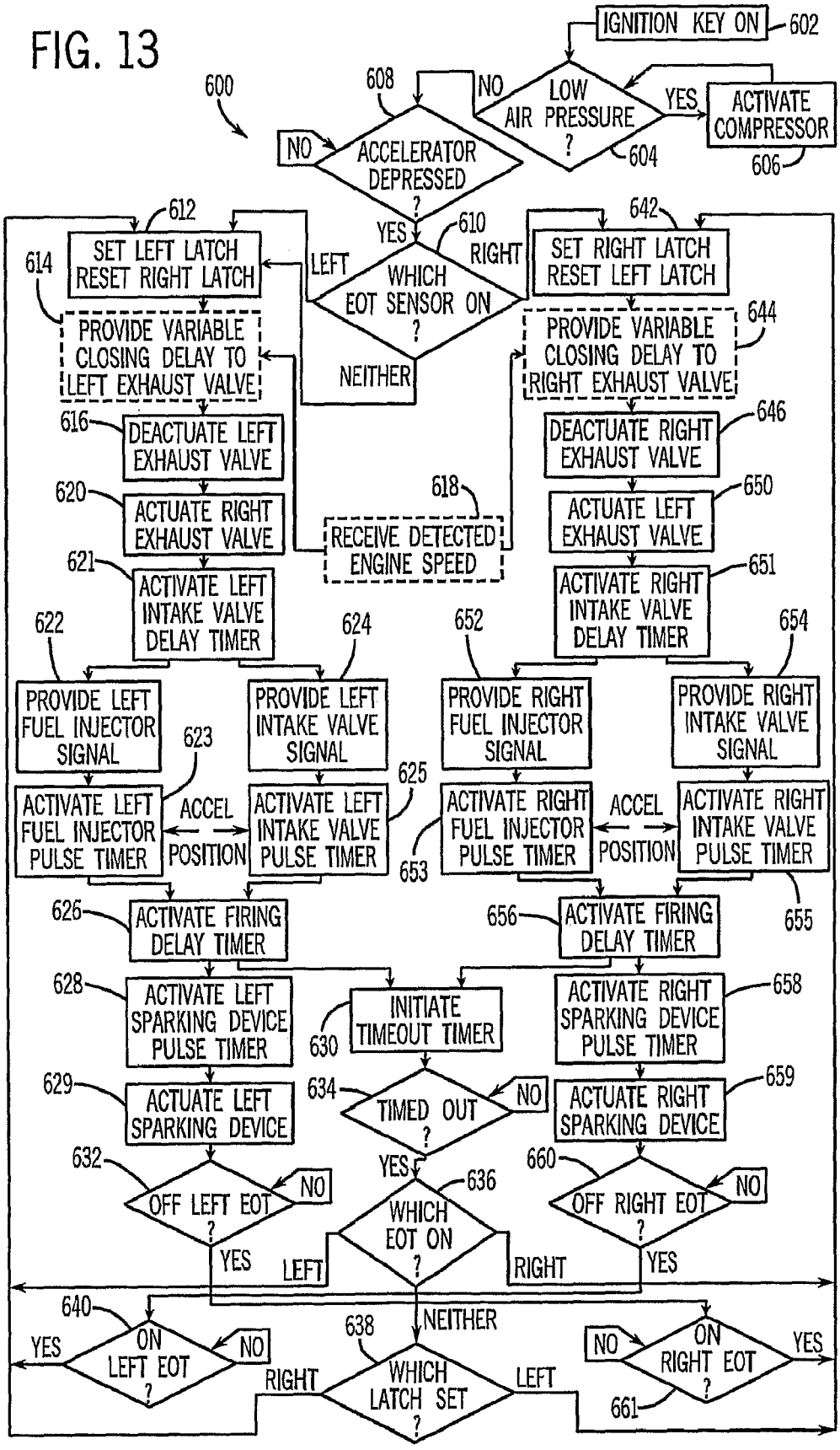
FIG. 13 is a flow chart showing exemplary steps of operation of the electronic control circuitry in monitoring and controlling various components of the engine of FIGS. 2-6D.

Referring to FIG. 13, given the connections between the electronic control circuitry 116 and other components as shown in FIG. 12, the electronic control circuitry is able to control operation of the engine 4 in accordance with a flow chart 600. The particular algorithm represented by FIG. 13 is intended to allow the electronic control circuitry 116 to operate the cylinders 10, 12 in any of the manners described above with respect to FIGS. 6A-11, and to allow switching among the different modes of operation described above in a seamless manner. Although intended for use particularly in controlling operations relating to the cylinders 10, 12 of the cylinder assembly 100 of the main portion 34 of the engine 4, the algorithm is equally applicable with respect to controlling operations relating to the cylinders 14, 16 of the main portion of the engine, as well as the cylinders 50, 52 of the auxiliary power unit 44, albeit it will be understood that it is seldom (if ever) the case that the cylinders of the auxiliary power unit will operate in any of the abnormal modes of operation described above in particular with respect to FIGS. 9-11.

As shown in FIG. 13, operation of the electronic control circuitry 116 can conveniently be thought of as beginning when an operator has commanded the engine 4 to be turned on, for example, when a signal is provided to the electronic control circuitry 116 indicating that the ignition switch 672 has been switched on, at a step 602. When such a command has been received, the electronic control circuitry 116 next at a step 604 determines whether the air pressure provided by the air tank 36 is too low. Typically this will not be the case. Assuming proper design of the air tank 36, the air tank should be able to maintain a given pressure level over a long period of time without leakage, and so the air tank should still be at a previously-set pressure level even after the engine 4 has been dormant for a long period of time (typically, when the engine is shut off, the auxiliary power unit continues to operate, typically for a few seconds, until the air tank is at its appropriate pressure setting). Therefore, since typically the air tank 36 will have been pre-pressurized to a high enough level due to operation of the engine at an earlier time, the air tank should normally be at a desired pressure level upon beginning engine operation.

Nevertheless, if the air pressure within the air tank 36 is determined to be too low at the step 604, then the electronic control circuitry 116 activates either the electric air compressor 40 or the main air compressor 38 (in which case the auxiliary power unit 44 is also activated), at a step 606. More particularly, if the air pressure within the air tank 36 is insufficient to allow proper operation of the auxiliary power unit 44 and the main air compressor 38, then the electric air compressor 40 is switched on (typically for a small air tank this will only take a few seconds). However, if the air pressure within the air tank 36 is sufficient to allow proper operation of the auxiliary power unit 44, or once the air pressure within the air tank becomes sufficient to allow such operation of the auxiliary power unit (e.g., after preliminary operation by the electric air compressor 40), then the auxiliary power unit and the main air compressor 38 become operational until the air tank 36 reaches the desired operational pressure (this can take, for example, about 4-10 seconds). Once either of the compressors 40 and 38 is operational, the system returns to the step 604. However, the electronic control circuitry 116 continues to cycle back and forth between the steps 604 and 606 until such time as the air pressure is sufficiently high within the air tank 36. Typically, by the time that the air pressure within the air tank 36 is high enough for proper operation of the main portion 34 of the engine 4, the auxiliary power unit 44 is also operating.

Next, at a step 608, the electronic control circuitry 116 detects whether the accelerator 670 has been depressed or otherwise a signal has been provided indicating that the engine should be activated. If the answer is no, then the system remains at step 608, and the main portion 34 does not yet begin operation (that is, no combustion events occur yet). If the answer is yes, then the system next proceeds to a step 610. At the step 610, the electronic control circuitry 116 determines based upon one or more signals received from the EOT sensors 154 whether a given piston assembly (such as the piston assembly 67 described above) is positioned at one of the left or right EOT positions associated with its respective cylinder assembly, or alternatively is not at any EOT position. As shown, if it is determined by the electronic control circuitry 116 that the piston assembly is located at a left EOT position or is at neither of the EOT positions, then the electronic control circuitry proceeds to a step 612. Otherwise, if it is determined that the piston assembly is at the right EOT position, then the electronic control circuitry 116 proceeds to a step 642. In alternate embodiments, if neither EOT position is achieved, instead of proceeding to the step 612, the electronic control circuitry can instead proceed to the step 642.

Further as shown, upon arriving at the step 612, the electronic control circuitry 116 sets (e.g., switches "on") the left latch 674 and resets (e.g., switches "off") the right latch 676, which as mentioned above are switches that are part of the electronic control circuitry 116 (see FIG. 12). The setting of the left latch 674 and resetting of the right latch 676 cause the electronic control circuitry 116 to proceed with performing a series of steps (e.g., steps 612-629) that result in a combustion event occurring at the first (left) cylinder 10. In contrast, upon arriving at the step 642, the electronic control circuitry 116 instead resets (e.g., switches "off") the left latch 674 and sets (e.g., switches "on") the right latch 676, which cause the electronic control circuitry 116 to proceed with performing a different series of steps (e.g., steps 642-659) that result in a combustion event occurring at the second (right) cylinder 10.

Assuming that the electronic control circuitry 116 has proceeded to the step 612, as shown in FIG. 13 the electronic control circuitry subsequently proceeds to perform each of steps 614, 616 and 620. The step 614, which is shown in dashed lines, represents an optional operation that can be performed in some implementations, and is described further below (this step does not correspond to the manner of operation shown in the timing diagrams 8-11). Assuming that the step 614 is not performed, the electronic control circuitry 116 advances from the step 612 to the step 616, at which it provides a control signal to the left exhaust valve 28 causing that valve to close, and to a step 620, at which it provides a control signal to the right exhaust valve causing that valve to open. Thus, the steps 616 and 620 correspond to the actions shown in FIG. 8 at the times $T_1$ and $T_{21}$, in FIG. 9 at the times $T_1$ and $T_{41}$, and in FIG. 11 at the times $T_1$ and $T_{91}$. Upon completion of the step 620, the electronic control circuitry 116 proceeds to a step 621, at which it activates a left intake valve delay timer so as to delay further advancement of the process for an amount of time sufficient to allow the left exhaust valve 28 to close (e.g., with respect to FIG. 8, the amount of time difference between the times $T_1$ and $T_2$).

After the delay associated with the step 621 has passed, the electronic control circuitry 116 then proceeds to steps 622 and 623, at which it provides a left fuel injector signal and also activates a left fuel injector pulse timer, respectively. Simultaneously with the steps 622 and 623, the electronic control circuitry 116 also performs steps 624 and 625, at which it provides a left intake valve signal and activates a left intake valve pulse timer, respectively. The performing of the steps 622 and 623 corresponds to the transitioning of the left fuel injector graph 210 at the time $T_2$, along with the continued maintaining of that high level signal until the time $T_3$, as shown in FIG. 8 (among other places). The performing of the steps 624 and 625 corresponds to the transitioning of the left intake valve graph 212 at the time $T_2$, along with the continued maintaining of that high level until the time $T_4$, also as shown in FIG. 8 (among other places). It will be noted that the lengths of each of the pulse timers employed in the steps 623 and 625 in the present embodiment are determined by the electronic control circuitry 116 based upon the sensed position of the accelerator pedal 670 as determined at the step 608. If the accelerator pedal 670 is depressed more greatly, indicating the operator's desire for greater engine power, the timers in the steps 622, 624 will adjust for a longer period of time calling for a greater injection of fuel and pressurized air into the left combustion chamber 22.

Upon the completion of the steps 623 and 625 (it will be noted that the step 623 usually completes earlier than the step 625), the electronic control circuitry 116 then proceeds to a step 626, at which it activates a firing delay timer that must be timed out prior to the firing of the left sparking device 24. Activation of the timer in the step 626 corresponds to the delay between times $T_4$ and $T_5$ as shown in the sparking delay graph 216 of FIG. 8 (among other places). Subsequent to the step 626, the electronic control circuitry 116 then performs a step 628, at which it activates a left sparking device pulse timer, and subsequently a step 629, at which it provides a signal to actuate the left sparking device 24. In addition to performing the steps 628 and 629, simultaneously with those steps the electronic control circuitry 116 further performs a step 630, at which the electronic control circuitry initiates a timeout timer. The left sparking device signal provided at the step 629 causes the switching on of the left sparking device 24, for example, at the time $T_5$ of FIG. 8 (among other places), while the expiration of the left sparking device pulse timer of the step 628 results in the cessation of the left sparking device signal such that the left sparking device is switched off, for example at the time $T_6$ shown in FIG. 8. Although not shown, in alternate embodiments it is also possible for the left sparking device signal to take a form that will cause the left sparking device to produce multiple, repeated sparks over the period of time determined by the left sparking device pulse timer (or over some other period of time, for example, during a period of time up until an EOT condition or timeout condition occurs).

Subsequent to the performance of the steps 629 and 630, several things happen simultaneously. Upon the performance of the step 629 in particular, at a step 632, it is determined whether the piston assembly is no longer positioned at the left EOT position. Simultaneously, upon initiating the timeout timer at the step 630, the electronic control circuitry 116 proceeds to a step 634 at which it continually revisits whether the timeout timer has expired (in at least one embodiment, the timeout timer is set to expire after 500 msec). The step 634 in particular continues to be re-executed until the timeout timer expires, unless the electronic control circuitry 116 at the step 632 determines that the piston assembly is no longer at the left EOT position and further, at a step 661, determines that the piston assembly has reached the right EOT position. To the extent that the timeout timer expires at the step 634 without the conditions of 632 and 661 being met, then the electronic control circuitry 116 proceeds to a step 636, at which the electronic control circuitry effectively makes a new determination of whether the piston assembly is located at either the left or right EOT positions or at neither of those positions, as was originally determined at the step 610.

If at the steps 632 and 661 it is determined that the piston assembly has migrated to the right EOT position, or if at the step 636 it is determined that the piston assembly is at the right EOT position, then the electronic control circuitry proceeds to the step 642. However, if alternatively at the step 636 it is determined that the piston assembly remains at the left EOT position, then the electronic control circuitry 116 proceeds back to the step 612. Also, if at the step 636 it is determined that the piston assembly is currently at neither of the EOT positions, then the electronic control circuitry 116 proceeds to a step 638 at which it determines which of the right or left latches is currently set (as opposed to reset). If the right latch is currently set (and correspondingly the left latch is currently reset), then the system returns to the step 612. Alternatively, if the left latch is currently set (and the right latch is currently reset), then the system proceeds to the step 642 instead.

If the electronic control circuitry 116 arrives at the step 642, either from the step 610 or alternatively from any of the steps 636, 638 or 661, it has arrived there either because the piston assembly 67 is at the right EOT position (as determined at the steps 610, 636 or 661) or alternatively because the piston assembly is in between the EOT positions but the left latch is currently set (as determined at the step 638). As mentioned above, upon arriving at the step 642, the electronic control circuitry 116 sets the right latch 676 and resets the left latch 674, and then proceeds to perform each of steps 644, 646 and 650. As with respect to the step 614, the step 644, which is shown in dashed lines, represents an optional operation that can be performed in some implementations, and is described further below (this step does not correspond to the manner of operation shown in the timing diagrams 8-11). Assuming that the step 644 is not performed, the electronic control circuitry 116 advances from the step 642 to the step 646, at which it provides a control signal to the right exhaust valve 28 causing that valve to close, and to a step 650, at which it provides a control signal to the left exhaust valve causing that valve to open. Upon completion of the step 650, the electronic control circuitry 116 proceeds to a step 651, at which it activates a right intake valve delay timer so as to delay further advancement of the process for an amount of time sufficient to allow the left exhaust valve 28 to close (e.g., with respect to FIG. 8, the amount of time difference between the times $T_{11}$ and $T_{12}$).

After the delay associated with the step 651 has passed, the electronic control circuitry 116 then proceeds to steps 652 and 653, at which it provides a right fuel injector signal and also activates a right fuel injector pulse timer, respectively. Simultaneously with the steps 652 and 653, the electronic control circuitry 116 also performs steps 654 and 655, at which it provides a right intake valve signal and activates a right intake valve pulse timer, respectively. The performing of the steps 652 and 653 corresponds to the transitioning of the right fuel injector graph 220 at the time $T_{12}$, along with the continued maintaining of that high level signal until the time $T_{13}$, as shown in FIG. 8 (among other places). The performing of the steps 654 and 655 corresponds to the transitioning of the right intake valve graph 222 at the time $T_{12}$, along with the continued maintaining of that high level until the time $T_{14}$, also as shown in FIG. 8 (among other places). As with the pulse times employed in the steps 623 and 625, the lengths of each of the pulse timers employed in the steps 653 and 655 in the present embodiment are determined by the electronic control circuitry 116 based upon the sensed position of the accelerator pedal 670 as determined at the step 608.

Upon the completion of the steps 653 and 655 (it will be noted that the step 653 usually completes earlier than the step 655), the electronic control circuitry 116 then proceeds to a step 656, at which it activates a firing delay timer that must be timed out prior to the firing of the right sparking device 24. Activation of the timer in the step 656 corresponds to the delay between times $T_{14}$ and $T_{15}$ as shown in the sparking delay graph 216 of FIG. 8 (among other places). Subsequent to the step 656, the electronic control circuitry 116 then performs a step 658, at which it activates a right sparking device pulse timer, and subsequently a step 659, at which it provides a signal to actuate the right sparking device 24. In addition to performing the steps 658 and 659, simultaneously with those steps the electronic control circuitry 116 again also performs the step 630, at which the electronic control circuitry initiates the timeout timer. The left sparking device signal provided at the step 659 causes the switching on of the right sparking device 24, for example, at the time $T_{15}$ of FIG. 8 (among other places), while the expiration of the right sparking device pulse timer of the step 658 results in the cessation of the right sparking device signal such that the right sparking device is switched off, for example at the time $T_{16}$ shown in FIG. 8.

As was the case subsequent to the performance of the steps 629 and 630 described above, several things also happen simultaneously subsequent to the performance of the steps 659 and 630. Upon the completion of the step 659 in particular, it is determined at a step 660 whether the piston assembly is no longer at the right EOT position. If the piston assembly still is at the right EOT position, the electronic control circuitry 116 remains at the step 660 while, if it has left the right EOT position, then the electronic control circuitry proceeds to a step 640, at which it is determined whether the piston assembly has reached the left EOT position. At the same time, while one or both of the steps 660 and 640 are being performed, the electronic control circuitry 116 also performs the step 634 in which it determines whether the timeout timer has expired.

If the electronic control circuitry 116 determines at the step 634 that the timeout timer has expired prior to determining that the piston assembly has both left the right EOT position at the step 660 and reached the left EOT position as determined at the step 640, then the electronic control circuitry proceeds from the step 634 to the step 636, at which it makes a new determination of the piston assembly position as described above. If, however, the requirements of the steps 660 and 640 are determined by the electronic control circuitry 116 to have been met prior to the expiration of the timeout timer of the step 634, then the electronic control circuitry returns to the step 612. In this manner, then, the electronic control circuitry 116 can cycle back to either the step 612 or the step 642 depending upon whether the piston assembly is determined as being at one of the left or right EOT positions, or in between those EOT positions.

FIG. 13 is intended particularly to show exemplary operation of the electronic control circuitry 116 in relation to one of the cylinder assemblies of the main portion 34 of the engine 4, namely, the cylinder assembly 100 with its cylinders 10 and 12 described above. From the above description, it should be particularly evident that, when the electronic control circuitry 116 operates in accordance with FIG. 13 (as well as when the engine operates in accordance with any of the timing diagrams of FIGS. 8-11), the electronic control circuitry 116 typically alternates, in a repeated manner, between operation in which the left latch 674 is set and combustion occurs in the left cylinder 10, and operation in which the right latch 676 is set and combustion occurs in the right cylinder 12. Thus, it should further be evident that, by monitoring the rate of switching of the states of the latches 674, 676, the engine speed sensor 678 is able to obtain a measure of the speed of operation of the engine, or at least the speed of operation of the cylinder assembly 100.

Such engine speed information can be particularly useful in certain embodiments (particularly embodiments differing somewhat from that described above), for example, embodiments in which the steps 614 and 644 mentioned above are performed. More particularly in this regard, it is not always desirable that the exhaust valves 28 be actuated (so as to be closed) immediately upon the piston assembly attaining one of the EOT positions as discussed above. In some circumstances, even though the piston assembly has attained one of the EOT positions (e.g., the left EOT position), it is nevertheless not desirable to immediately close the corresponding exhaust valve (e.g., the left exhaust valve) since such closure of the exhaust valve can prematurely limit the ability of the piston assembly to continue moving in the direction it was traveling (e.g., the left direction) due to pressure changes within its associated combustion chamber. This is particularly the case as the speed of the engine is reduced.

In such circumstances it can be desirable therefore to introduce a delay between the time at which the piston assembly reaches a given EOT position and the time at which the corresponding exhaust valve is closed. Further, it often is desirable that the amount of time delay should take into account engine speed, and particularly that the amount of time delay be increased as the engine speed is decreased, and vice-versa. Assuming this to be the case, therefore, the respective steps 614 and 644 of FIG. 13 can be implemented, between the steps 612 and 616 and the steps 642 and 646, respectively, to introduce such a delay. More particularly, the step 614 involves providing a variable closing delay to the left exhaust valve, and thereby delays the performance of the step 616 relative to the step 612, while the step 644 involves providing a variable closing delay to the right exhaust valve, and thereby delays the performance of the step 646 relative to the step 642. Further as shown, in each case, the providing of the variable closing delays is based upon received detected engine speed information, which is represented as being received at a step 618.

Although FIG. 13 for simplicity shows operation of the electronic control circuitry 116 as it pertains particularly to the cylinder assembly 100, it will further be understood that, insofar as the main portion 34 of the engine 4 of FIG. 2 includes two cylinder assemblies comprising two different pairs of cylinder 10, 12 and 14, 16, respectively, the electronic control circuitry 116 for this engine typically will perform, simultaneously, at least two such algorithms as that shown in FIG. 13, one with respect to each of the two different assemblies. In at least some such embodiments, the electronic control circuitry 116 will include another set of latches in addition to the latches 674, 676, as well as possibly another engine speed sensor in addition to the sensor 678, in order to detect the speed of operation associated with the cylinders 14 and 16. Also, insofar as it is typically desirable for the cylinder assembly 100 including the cylinders 10 and 12 to be operated in a manner that is opposite that of the cylinder assembly including the cylinders 14 and 16 so as to achieve engine balancing (and thereby achieve engine operation with less undesirable vibrations), the electronic control circuitry 116 in at least some embodiments will coordinate its operation in relation to the cylinders 10, 12 with its operation in relation to the cylinders 14, 16 so as to achieve such balanced operation.

Although not shown in FIG. 13, it should further be noted that, typically, it is desirable for the engine 4 to begin operation with its piston assemblies (e.g., the piston assembly 67) being located at EOT positions rather than somewhere in between EOT positions. This is desirable particularly since, if the piston assemblies are in such conditions at the commencement of engine operation, the piston assemblies therefore are ready to perform combustion events that will provide the most initial force. Typically, additional efforts will not need to be exerted for the piston assemblies to arrive at the EOT positions, insofar as the piston assemblies naturally tend to end up at their EOT positions (e.g., when the piston assemblies are successfully being operated in the manner described with respect to FIG. 8).

Figure 14:
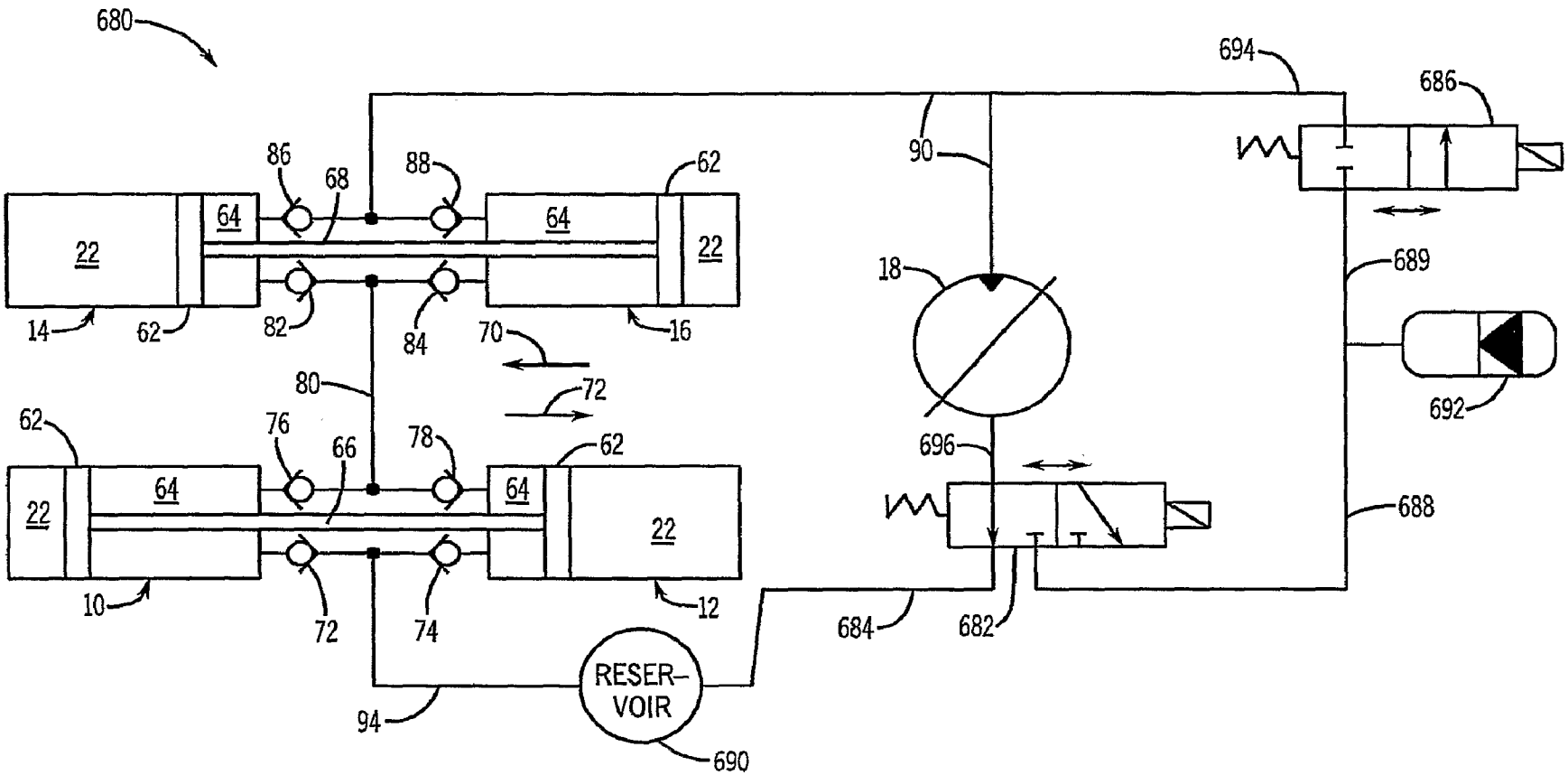
FIG. 14 is a schematic diagram showing in more detail several components of an alternate embodiment of the hydraulic engine of FIG. 2 in which the engine includes a regenerative braking capability.

Turning to FIG. 14, an additional schematic diagram 680 illustrates portions of an alternate embodiment of the engine 4 in which the cylinders 10, 12, 14 and 16 are hydraulically coupled not merely to the hydraulic motor 18 but also are coupled to additional components by which the engine is capable of providing regenerative braking functionality. As shown, the cylinders 10, 12, 14 and 16 have the same components and arrangement as shown in FIG. 3. That is, each of the cylinders 10, 12, 14 and 16 includes a respective combustion chamber 22, a respective hydraulic chamber 64, and a respective piston 62. Further, the pistons 62 of the cylinders 10 and 12 are linked by way of the connector tube 66 and the pistons of the cylinders 14 and 16 are linked by way of the connector tube 68. Additionally, check valves 72 and 74 are respectively coupled between the hydraulic chamber 64 of the first and second cylinders 10, 12 and links 94, by which those cylinders are connected to a reservoir, which in the present embodiment is shown as a reservoir 690. Further, the check valves 76 and 78 also linked to those respective hydraulic chambers 64 of the cylinders 10, 12 are linked to the check valves 82 and 84 by way of links 80, with the check valves 82 and 84 being respectively coupled to the hydraulic chambers 64 of the cylinders 14 and 16, respectively. Additionally, the further check valves 86 and 88 also are coupled to the hydraulic chambers 64 of the cylinders 14 and 16, respectively, are each coupled by way of links 90 to one another and to the hydraulic wheel motor 18, which can be a variable displacement hydraulic wheel motor.

As shown, in this embodiment, the hydraulic wheel motor 18 is not directly coupled back to the reservoir 690, but rather is coupled by way of a link 696 to the input terminal of a three-way, two-position proportional hydraulic valve, which can also be referred to as a braking valve 682. Typically the braking valve 682 is operated by way of a single solenoid (which can be controlled by the electronic control circuitry 116 described above), with a spring return, but it also can be pilot-operated. One of two selectable output terminals of the braking valve 682 (opposite the terminal connected to the link 696) is connected to the reservoir 690 by way of a link 684 such that, when the braking valve 682 is in the position shown in FIG. 14, hydraulic fluid passing through the hydraulic motor 18 returns to the reservoir 690 by way of the link 684. However, the other of the two selectable output terminals of the braking valve 682 is also connected, by way of links 688, to an accumulator 692. The accumulator 692 is further coupled, by way of links 689, to an additional re-acceleration valve 686, which in the present embodiment is a two-way, two-position proportional hydraulic valve. The re-acceleration valve 686 additionally is coupled between the links 689 and an additional link 694 that merge (e.g., is coupled to) the links 90 and thus is coupled to the hydraulic wheel motor 18.

Given the above-described arrangement, hydraulic fluid flow between the links 689 and 694 is prevented when the re-acceleration valve 686 is in a closed position (closed to fluid flow) as shown in FIG. 14. Thus, hydraulic fluid flow between the accumulator 692 (as well as the links 688) and the links 694 is also prevented when the re-acceleration valve 686 is closed. However, when the re-acceleration valve 686 is shifted (again by solenoid operation) to an open position so as to couple the links 689 and 694, hydraulic fluid can flow from the hydraulic accumulator 692 to the links 694 and thus to the hydraulic wheel motor 18 by way of the links 90.

The engine represented by the schematic diagram 680 operates as follows, when implemented in a vehicle such as that of FIG. 1. When the engine is operating (and combustion events are occurring within the engine cylinders) to drive hydraulic fluid toward the hydraulic wheel motor 18 in response to an operator's depressing of the accelerator pedal 670, the braking valve 682 directs the hydraulic fluid flow to the reservoir 690. At this time, hydraulic fluid is not allowed to proceed to the accumulator 692 since, if fluid was directed in that manner, fluid would accumulate in the accumulator and eventually the engine pistons would cease operating properly. Further, when the vehicle is moving (or the hydraulic wheel motor 18 is otherwise rotating) but the accelerator pedal 670 is released, hydraulic fluid continues to flow from the reservoir 690 through the engine check valves 72-78 and 82-88, through the hydraulic wheel motor 18 and back to the reservoir, even though the engine itself stops running whenever the accelerator is released (e.g., even though combustion events driving the pistons 62 no longer are occurring). In this operational state, the engine is free-wheeling.

However, when a brake is depressed by an operator (again, as sensed by the electronic control circuitry 116), the free-wheeling flow through the hydraulic wheel motor 18 is diverted away from the reservoir 690 and instead sent to the accumulator 692. More particularly, this occurs because the electronic control circuitry 116 actuates the solenoid of the braking valve 682 to move away from the position shown in FIG. 14 towards a position in which hydraulic fluid flow is directed from the links 696 to the links 688 and thus to the accumulator 692 rather than to the links 684. When this occurs, typically the re-acceleration valve 686 is in the closed position shown, that is, precluding the flow of fluid between the links 689 and the links 694. Consequently, the fluid is diverted into the hydraulic accumulator 692 causing the pressure therein to rise. As noted above, the braking valve 682 in the present embodiment is a proportional valve, such that the volume of fluid being redirected to the accumulator 692 at any given time need not include all of the fluid proceeding through the links 696 away from the hydraulic wheel motor 18. Further, the operation of the braking valve 682 can be modulated to ensure a smooth and appropriate braking function, based upon the amount of fluid/pressure in the accumulator 692.

Once the brake pedal is released, the braking valve 682 is controlled to return to its normal position in which hydraulic fluid is completely directed back to the reservoir 690. This also occurs if the accumulator 692 becomes filled, as there must be a place for hydraulic fluid to flow in this circumstance. Also, if the hydraulic accumulator 692 becomes completely filled, or if more aggressive braking is desired by the operator than can be achieved by diverting flow to the hydraulic accumulator by way of the regenerative braking system, then the electronic control circuitry 116 can cause normal braking (e.g., by way of brake pads interacting with wheels of the vehicle). When the vehicle is completely stopped, the braking valve 682 also returns to the normal position as shown.

When hydraulic fluid/pressure is accumulated within the hydraulic accumulator 692, it is possible to drive the hydraulic motor 18 with such fluid/pressure. In particular, when such pressure exists within the hydraulic accumulator 692, and the accelerator pedal 670 of the vehicle is depressed by the operator, the re-acceleration valve 686 is energized so as to shift from the normal, closed position shown in FIG. 14 to an open position such that hydraulic fluid can flow from the hydraulic accumulator 692 via the links 689 to the links 694, 90 and thereby to the hydraulic wheel motor 18. During this manner of operation, the braking valve 682 is maintained in its normal position such that all fluid is directed back to the reservoir 690. So that the reservoir can accommodate the increased volume of fluid that can be accumulated by the accumulator 692 during braking, the reservoir typically will be larger than the reservoir 70 of FIG. 3. It should be noted that the hydraulic fluid proceeding out of the re-acceleration valve 686 via the links 694 does not proceed into the hydraulic chambers 64 of the cylinders 14, 16, since the check valves 86 and 88 preclude such flow. The re-acceleration valve 686, as described above, is also of the proportional type, such that the electronic control circuitry 116 based upon the setting of the accelerator pedal 670 can smoothly control vehicle acceleration by modulating the rate of fluid output drawn from the accumulator 692.

It is typically the case that the engine will not be running (e.g., the cylinders 10-16 will not be experiencing combustion events) when the hydraulic wheel motor 18 is being driven by hydraulic fluid from the accumulator 692. Nevertheless, in some circumstances, it is possible that the hydraulic fluid driving the hydraulic wheel motor 18 will be provided to the motor from both the accumulator 692 and from the cylinders 10-16. In any event, once the pressure within the hydraulic accumulator 692 drops to a point where it can no longer sustain desired vehicle acceleration/speed, the engine begins running (again, that is, the cylinders 10-16 experience combustion events) such that hydraulic fluid is supplied to the hydraulic wheel motor by way of the links 90. At this point, the re-acceleration valve 686 is de-energized, and the regenerative braking system is effectively inactivated until the next braking event occurs.

Embodiments of the present invention including one or more of those described above are advantageous relative to conventional internal combustion engines in one or more regards. First, embodiments of the present inventive engine are fully capable of commencing operation, and continuing operation, without any starter (e.g., a battery driven electrical motor) or any flywheel (or other device for maintaining momentum). Conventional engines that employ a crankshaft driven by one or more pistons typically require a starter because the force derived from any given combustion stroke(s) of any given piston(s) is insufficient to rotate the crankshaft and move its associated piston(s) sufficiently far that the positions) of those piston(s) are appropriate for additional combustion stroke(s) to occur. Rather, during the starting process, before or after one or more combustion stroke(s) have occurred, the engine components can shift to a "dead" position in which it is not yet appropriate for any further combustion stroke(s) to occur. The existence of such dead positions particularly occurs because, in between successive combustion strokes, it is necessary to perform compression strokes that both take time and sap rotational momentum from the system. Because of the existence of these dead positions, it is necessary for an outside force (e.g., the starter) to further move the engine components beyond these positions to different positions in which it is appropriate for further combustion stroke(s) to occur In contrast, because embodiments of engines in accordance with the present invention employ pairs of aligned, oppositely-directed pistons, and because these embodiments receive compressed air from the air tank rather than perform any compression strokes to generate compressed air, these engines and their piston assemblies never move to or become stuck at dead positions. Rather, because at any time a new supply of compressed air (and fuel) can be provided to any given combustion chamber without the performance of any compression stroke, it is always possible to cause another combustion event to occur with respect to a given piston assembly, no matter what the position of the piston assembly happens to be. Additionally, because embodiments of the present invention employ pairs of aligned, oppositely-directed positions, every combustion stroke tends to drive the piston assembly directly toward a position at which it is appropriate to cause a combustion stroke directed in the opposite direction. That is, operation of the engine naturally drives the piston assemblies in such a manner that, after any given combustion stroke, the piston assembly is reset to a position that is appropriate for another combustion stroke to take place.

At the same time, even if a given combustion event in a given combustion chamber of a cylinder assembly fails to drive the piston assembly sufficiently far so as to move the piston assembly to a position where it is appropriate for the next combustion event to be performed in the other combustion chamber of the cylinder assembly (e.g., the piston assembly remains at a given EOT position as shown in FIG. 11), additional combustion strokes can still be performed repeatedly in the same combustion chamber (again as shown in FIG. 11). Again, this is because, regardless of the piston assembly position, compressed air (and fuel) sufficient for enabling a combustion stroke can always be inducted into any combustion chamber associated with any given cylinder assembly of the engine at any given time. Thus, every combustion event within these embodiments of the present invention tends to positively direct the engine toward a state, or at least leaves the engine in a state, in which a further combustion event is possible and appropriate.

Given these considerations, no starter (e.g., electric starter, pneumatic starter, hydraulic starter, hand crank starter or other starting means or structure for performing a starting function) is required by at least some embodiments of the present invention in order to allow the engine to begin operating, that is, no starter is required by these embodiments to allow combustion events within the engine to begin occurring and continue occurring in a sustainable or steady-state manner. Regardless of whether or when the last combustion event in the engine has occurred, or how long the engine has been "off", the engine is always ready to begin performing combustion events in response to an operator signal (e.g., depressing of an accelerator) or otherwise. Operation of the engine is always either in an "on" state where combustion events are occurring (with high levels of force/torque), or in an "off" state where combustion events are not occurring, but never in a "start" state where a separate, starter mechanism is helping to drive the engine so that it can attain a steady "on" state of operation.

It should further be mentioned that, because no starter is required, such embodiments of engines are capable of operating or running (that is, experiencing successive combustion events) at a variety of speeds, and in particular are capable of running at very low speeds (including at zero speed and near-zero speeds) that would be unstable for many conventional four stroke and two stroke crankshaft-based engines. Further, in embodiments in which regenerative braking is employed (such as that described in FIG. 14), it is further possible to achieve initial output momentum without even beginning operation of the engine (that is, without the occurrence of any combustion events), simply by directing some of the stored fluidic energy within the accumulator to the hydraulic wheel motor (or other output device).

The fact that embodiments of the present invention have no need for a starter goes hand-in-hand with the additional attribute that embodiments of the present invention have no need for a flywheel. In conventional engines involving a crankshaft, whether those engines are four stroke or two stroke engines, it is typically necessary to employ a flywheel so that sufficient rotational momentum of the crankshaft can be maintained to overcome the resistive force that is generated within the engines after a given combustion event has occurred and the piston(s) of the engine are only serving to compress and/or exhaust contents within their combustion chambers, so as to allow the engine to return to a state at which further combustion event(s) can occur.

By comparison, and as already discussed, embodiments of the present invention employing pairs of aligned, oppositely-directed pistons never face a situation in which further combustion event(s) cannot be performed. Rather, no matter what the position of a given piston assembly, it is always possible to cause an additional combustion event to occur in one (or possibly either) of its associated combustion chambers. Further, because the vehicle (or other load) itself can serve as a flywheel due to inertia, the vehicle itself can serve to balance or smooth out any variations in torque, pressure and/or volumetric fluid flow that occur as combustion events occur, pass, and then are repeated. Thus, even though no engine flywheel is present in the above-described embodiments, noticeable variations in vehicle velocity normally still will not occur due to the alternation of combustion events followed by the absence of such events.

Equally if not more significantly, the vehicle movement and associated momentum serves also to provide a phenomenon that can be referred to as "thermodynamic freewheeling" behavior. Such behavior occurs particularly when pistons are able to fully complete their travel down the entire lengths of their cylinder bores during combustion strokes (prior to the exhaust strokes) while continuing to perform net work throughout those movements, which in turn maximizes energy output of the engine (that is, all possible heat energy from each combustion stroke is squeezed out of the engine and available for performing work). Due to the "thermodynamic freewheeling" behavior provided by the engine, fuel efficiency is further enhanced. It should further be noted that inclusion of an accumulator (or other source of backpressure) within the hydraulic circuit formed from the engine's hydraulic cylinders, hydraulic wheel motor and reservoir would tend to negate this benefit (albeit use of an accumulator as described above in connection with regenerative braking, where the accumulator is separate from the hydraulic circuit formed from the engine cylinders, wheel motor and reservoir, does not entail this same difficulty).

Embodiments of the present invention further are advantageous by comparison with many conventional engines given their arrangement of aligned, oppositely-directed pistons that are operated in a 2 stroke manner in terms of the amount of torque that can be generated by these embodiments. In a conventional 4 stroke engine employing a crankshaft, force and corresponding torque are generated by a given piston only once every four times it moves. In contrast, embodiments of the present invention such as those described above employ pistons 62 that, given their 2 stroke manner of operation, generate force and corresponding torque once every two times the piston moves. Further, because each of the pistons 62 of a given piston assembly such as the piston assembly 67 is linked to and aligned with a complementary, oppositely-directed piston, each piston assembly generates force and corresponding torque with every single movement of that piston assembly.

Additionally, because embodiments of the present invention such as those described above produce torque by way of hydraulic fluid movement rather than by way of driving a crankshaft, the torque generating capability of these embodiments is further enhanced relative to engines with crankshafts. In particular, while engines with crankshafts are only able to achieve varying levels of torque as the angles of the connecting rods linking the pistons of such engines with the crankpins of the crankshaft vary, the embodiments of the present invention never experience any such torque variation since movements of the pistons are converted into rotational movement by way of hydraulic fluid rather than by way of any mechanical linkages. Further, while engines with crankshafts are often unable to achieve significant or desired levels of torque immediately when combustion events occur due to the particular angular positioning of the connecting rods (e.g., when a piston is at a "top dead center" position), embodiments of the present invention are always immediately capable of generating torque upon the occurrence of a combustion event since the force resulting from the combustion event is equally able to be converted into torque by way of hydraulic fluid movement regardless of piston position. Indeed, for all of these reasons, it is envisioned that certain embodiments of the present invention may be able to output two times or even three times the overall net torque generated by a comparable-weight 4 stroke crankshaft-based internal combustion engine.

Additionally, particularly insofar as embodiments of the present invention are capable of generating superior levels of torque, at least some embodiments of the present invention are able to drive the wheels of a vehicle (or other load) directly as shown in FIG. 2, without any intermediary devices being employed for the purpose of torque conversion. In particular, while many conventional crankshaft-based internal combustion engines need to employ (or desirably employ) transmissions and/or differential gear (and/or running gear) arrangements by which engine output torque levels are converted into desired torque levels at the wheels of the vehicle (or other output devices), at least some (if not all) embodiments of the present invention are capable of delivering desired torque levels to the wheels (or other output devices) entirely without any such transmissions or gear arrangements. In such embodiments, it is possible to achieve additional torque multiplications (e.g., about four times the amount of torque) simply by way of the variable displacement hydraulic wheel motor 18.

In addition to generating superior levels of torque, at least some embodiments of the present invention are able to operate at a significantly higher level of efficiency than many if not all conventional internal combustion engines. One reason for this is that the embodiments of the present invention are able to achieve a significantly higher compression ratio (or "expansion ratio") than many conventional engines, where the compression ratio is understood as the ratio of the largest, expanded volume of the combustion chambers of the engine cylinders (e.g., at a "bottom dead center" position at the end of the combustion stroke), to the smallest, reduced volume of those combustion chambers (e.g., at a "top dead center" position just prior to combustion). More particularly, in many conventional 4 stroke, crankshaft-driven engines, the compression ratio is somewhat limited (e.g., to a factor of 9 or 10) due to the geometry of the engine cylinders, crankshaft, pistons, and connecting rods linking those pistons to the crankshaft, which produce a risk of pre-ignition with high compression ratios.

In contrast, embodiments of the present invention can attain a higher compression (expansion) ratio (e.g., a factor greater than 14, for example, a factor of 21 or even higher), and thus attain higher fuel efficiencies (e.g., about 17% to 21% higher fuel efficiencies) for that reason. The configuration of these embodiments of engines entails a reduced risk of pre-ignition, such that it is not necessary to always utilize high octane fuel, and rather it is possible to utilize a relatively lower grade, lower octane (e.g., 80 octane) fuel. It should be further noted that this ratio in relation to embodiments of the present invention is more aptly termed an "expansion ratio" rather than a "compression ratio" since no compression strokes are performed in these embodiments (again, compressed air is supplied from the air tank instead).

Embodiments of engines in accordance with the present invention provide greater fuel efficiency than many conventional engines for additional reasons as well besides their greater compression (expansion) ratios. First, as already discussed above, embodiments of the present invention do not (or do not need to) employ any crankshaft or connecting rods, camshafts or associated components (e.g., timing chains), or conventional valve train components, and also can be implemented without any transmissions, differential gears, running gears, or other components that are often employed to enhance torque output. Given the absence of these components, embodiments of the present inventive engine can be significantly lighter in weight relative to conventional engines that employ such components, and consequently can be more fuel efficient for this reason.

Additionally as discussed above, embodiments of engines in accordance with the present invention can begin operation (begin performing repeated combustion events) without any starter. Thus such engine embodiments can start and stop operation immediately at will without any significant delay, and also are capable of delivering torque even in the absence of any movement (e.g., at zero speed), similar to the behavior of an electric vehicle (e.g., a golf cart). When a vehicle implementing such an engine is at a standstill or is coasting, the engine need not be on or operational at all (that is, no combustion events need be taking place). Consequently, engine embodiments of the present invention need not operate the engine in any low or idling mode where combustion events are occurring even though the power generated as a result of those combustion events is wasted. Thus, engine embodiments of the present invention can save all of the energy that is otherwise wasted during idling operation by conventional engines during standstill or coasting operation of the vehicle, which can be significant (e.g., a 20% energy savings). Further, as described above, at least some embodiments of the present invention can also employ regenerative braking techniques, which further can save on energy that otherwise would be wasted when the vehicle is braked in a conventional manner with brake pads.

It should further be noted that embodiments of the present invention further are advantageous relative to electric cars and hybrid vehicles (that employ both internal combustion engines and electric power systems). Although (as discussed above) embodiments of the present invention share certain operational characteristics with electric cars, the embodiments of the present invention do not require the same battery power levels that are required by such cars, and consequently do not have the weight associated with the batteries used to provide such battery power. Further, while at least some embodiments of the present invention are capable of operating in a regenerative manner, which helps to conserve power, unlike conventional hybrid vehicles these embodiments do not require two complicated power systems (e.g., involving both an internal combustion engine and a complicated electric system including an electric motor). Thus, such embodiments of the present invention are less complicated than hybrid vehicles.

Notwithstanding the above description, the present invention is intended to encompass numerous other embodiments that employ one or more of the features and/or techniques described herein, and/or employ one or more features and/or techniques that differ from those described above. For example, while the above-described embodiments envision the use of conventional hydraulic fluid such as oil within the hydraulic chambers 64 of the cylinders and other engine components, in alternate embodiments other fluids can be utilized. For example, in some embodiments, water and/or a water-based compound can be used as the hydraulic fluid within the engine. Also, while the above-described engine embodiments generate rotational power by driving hydraulic fluid through a hydraulic wheel motor (e.g., a motor that generates rotational output), in alternate embodiments it would be possible to generate linear output power. Additionally, while the above-described engine embodiments employ capacitance sensors (e.g., as formed using the dashpot assemblies 136 with their capacitor cases 138, and the connector tube collars 134), in other embodiments other types of position/motion sensor can be employed, such as magnetic sensors, magnetoresistive sensors, optical sensors, inductive proximity sensors and/or other types of proximity sensors.

Further, while the above-described cylinder assemblies and piston assemblies envision the use of pairs of aligned, oppositely-directed pistons, in alternate embodiments it would be possible to utilize a group of pistons that, though oppositely (or substantially oppositely) directed, were not aligned with one another but rather were staggered in position relative to one another (e.g. the pistons travel along axes that are parallel with, but out of alignment with or offset from, one another). Additionally, various embodiments of the present inventive engine designs can be employed with a variety of vehicles, for example, various two-wheel drive vehicles (with front wheels driven or rear wheels driven), vehicles with limited slip mechanisms, four-wheel drive vehicles, and others. In some embodiments, for example, in a front-wheel drive vehicle, the engine can be implemented in such a manner that no hoses are needed to couple the engine housing to the hydraulic wheel motor.

Also, in some embodiments, more than one EOT sensor or other position sensor can be provided in any given cylinder to allow detection of multiple positional locations of the piston/piston assembly, as well as information that can be derived from such sensed location information including, for example, velocity and/or acceleration. Additionally, in some alternate embodiments, two of the four check valves coupled between the two pairs of cylinders (e.g., either the check valves 76 and 78, or the check valves 82 and 84 of FIG. 3) are eliminated. For beneficial operation of the engine without those two check valves, the two piston assemblies should be operated so that the first piston assembly is substantially exactly timed to move directly opposite to the movements of the second piston assembly. Also, in some embodiments (or circumstances) it is advantageous to only operate one of the two piston/cylinder assemblies of the engine (e.g., only cause combustion events to occur in one of the two piston assemblies, e.g., within the combustion chambers 22 of the cylinders 10 and 12). This can be desirable, for example, for fuel savings. Also, in some embodiments, the number of pistons, piston assemblies, cylinders and cylinder assemblies in the engine (and/or the auxiliary power unit) can vary from that describe above.

Further, while the above-described embodiments envision implementation in vehicles and the like, embodiments of the present inventive engine can also be employed in other devices that require rotational output power or other types of output power and, indeed, can be utilized to drive other energy conversion devices, such as electric generators. Additionally, while various advantages associated with certain embodiments of the present invention are discussed above, the present invention is intended to encompass numerous embodiments that achieve only some (or none) of these advantages, and/or achieve other advantages.

It is specifically intended that the present invention not be limited to the embodiments and illustrations contained herein, but include modified forms of those embodiments including portions of the embodiments and combinations of elements of different embodiments as come within the scope of the following claims.

I claim:

1. An internal combustion engine comprising:

first and second cylinders having first and second hydraulic chambers, respectively, first and second combustion chambers, respectively, and first and second intake valves, respectively, the intake valves being capable of governing flow into the respective combustion chambers;

first and second pistons positioned within the first and second cylinders, respectively, the first and second pistons being rigidly coupled to one another in a manner such that the pistons are substantially aligned with one another and oppositely-directed relative to one another;

at least one hydraulic link at least indirectly connecting the first and second hydraulic chambers with a hydraulic motor so as to convey hydraulic fluid driven from the first and second hydraulic chambers by the first and second pistons to the hydraulic motor; and at least one source of compressed air that is linked at least indirectly to the first and second combustion chambers by way of the respective intake valves, the compressed air being provided to the combustion chambers in anticipation of combustion strokes, whereby, due to the providing of the compressed air from the at least one source, the first and second pistons need not perform any compression strokes in order for combustion events to occur therewithin.

2. The internal combustion engine of claim 1, wherein the first and second cylinders additionally have first and second exhaust valves, respectively, and first and second sparking devices, respectively.

3. The internal combustion engine of claim 2, wherein the first and second intake valves are respectively coupled at least indirectly to both the at least one source and to first and second fuel injectors, respectively.

4. The internal combustion engine of claim 1, wherein the at least one source is a pressurized air tank.

5. The internal combustion engine of claim 4, wherein respective fuel injectors associated with the first and second cylinders each receive pressurized fuel from a fuel pump, wherein the fuel pump is at least one of battery driven, driven by the compressed air from the air tank, and hydraulically driven.

6. The internal combustion engine of claim 1, further comprising at least one of a battery-driven electric air compressor and an additional air compressor, wherein the at least one compressor provides the compressed air to the air tank.

7. The internal combustion engine of claim 6, wherein the engine includes the additional air compressor and further includes an auxiliary power unit capable of driving the additional air compressor.

8. The internal combustion engine of claim 7, wherein the auxiliary power unit includes:

third and fourth cylinders having third and fourth hydraulic chambers, respectively, third and fourth combustion chambers, respectively, and third and fourth intake valves, respectively, the intake valves being capable of governing flow into the respective combustion chambers;

third and fourth pistons positioned within the third and fourth cylinders, respectively, the third and fourth pistons being coupled to one another in a manner such that the pistons are substantially aligned with one another and oppositely-directed; and at least one additional hydraulic link at least indirectly connecting the third and fourth hydraulic chambers with an additional hydraulic motor so as to convey additional hydraulic fluid driven from the third and fourth hydraulic chambers by the third and fourth pistons to the additional hydraulic motor, wherein additionally some of the compressed air from the at least one source is provided at least indirectly to the third and fourth combustion chambers by way of the respective intake valves, the compressed air being provided to the respective combustion chambers in anticipation of combustion strokes, wherein the additional hydraulic motor drives the additional air compressor.

9. The internal combustion engine of claim 7, wherein the auxiliary power unit further powers at least one additional device selected from the group consisting of a battery, an air conditioning unit, a radio, and another electrical device.

10. The internal combustion engine of claim 1, wherein the first and second pistons are at least one of:

aligned coaxially along a cylinder axis extending through each of the first and second cylinders; and offset from one another in a direction perpendicular to directions of travel of the pistons within the cylinders, such that the directions of travel of the pistons are parallel but axes along which the pistons travel are out of alignment.

11. The internal combustion engine of claim 1, further comprising:

third and fourth cylinders having third and fourth hydraulic chambers, respectively, third and fourth combustion chambers, respectively, and third and fourth intake valves, respectively, the intake valves being capable of governing flow into the respective combustion chambers;

third and fourth pistons positioned within the third and fourth cylinders, respectively, the third and fourth pistons being coupled to one another in a manner such that the pistons are substantially aligned with one another and oppositely-directed, wherein the at least one source of compressed air is further linked at least indirectly to the third and fourth combustion chambers by way of the respective intake valves, the compressed air being provided to the combustion chambers in anticipation of combustion strokes within those chambers.

12. The internal combustion engine of claim 11, wherein first and second check valves associated with the first and second hydraulic chambers, respectively, are coupled between those chambers and an intermediary hydraulic link, wherein third and fourth check valves associated with the third and fourth hydraulic chambers, respectively, are also coupled between those chambers and the intermediary hydraulic link, wherein the intermediary link and the check valves are respectively configured to allow hydraulic fluid to only flow from each of the first and second hydraulic chambers to each of the third and fourth hydraulic chambers.

13. The internal combustion engine of claim 12, wherein fifth and sixth check valves associated with the third and fourth hydraulic chambers, respectively, are also coupled at least indirectly between those chambers and the hydraulic motor, and wherein the fifth and sixth check valves are configured to allow hydraulic fluid to only flow from the third and fourth hydraulic chambers to the hydraulic motor.

14. The internal combustion engine of claim 13, wherein seventh and eighth check valves associated with the first and second hydraulic chambers, respectively, are coupled between those chambers and a hydraulic reservoir, wherein the hydraulic motor is additionally coupled to the hydraulic reservoir, wherein the seventh and eighth check valves are configured to allow hydraulic fluid to only flow from the hydraulic reservoir to the first and second hydraulic chambers, and wherein the at least one hydraulic link includes the first, second, third, fourth, fifth and sixth valves, as well as the intermediary link and at least one of the third and fourth hydraulic chambers.

15. The internal combustion engine of claim 11, wherein the first and second cylinders are aligned along a first axis and the third and fourth cylinders are aligned along a second axis, and wherein the first and second axis are at least one of parallel to one another and perpendicular to one another.

16. The internal combustion engine of claim 1, further comprising first and second sensing devices associated with the first and second cylinders and capable of outputting first and second signals, respectively, that are indicative of when the respective first and second pistons are within first and second positional ranges, respectively.

17. The internal combustion engine of claim 16, wherein the sensing devices are selected from the group consisting of proximity sensors, capacitance sensors, magnetic sensors, and optical sensors.

18. The internal combustion engine of claim 1, wherein the first and second pistons are rigidly coupled to one another by way of a connector tube that extends between the pistons and into each of the first and second cylinders.

19. The internal combustion engine of claim 18, wherein the connector tube includes first and second connector tube collars that are positioned along first and second portions of the connector tube so as to be located within the first and second cylinders, respectively, and wherein the first and second cylinders further include first and second dashpot components configured to receive the first and second connector tube collars, respectively, depending upon movement of the connector tube.

20. The internal combustion engine of claim 19, wherein the first and second dashpot components include first orifices and second orifices, respectively, and wherein, when the first and second connector tube collars respectively enter the respective first and second dashpot components, the respective first and second connector tube collars drive at least some of the hydraulic fluid within the respective first and second hydraulic chambers of the respective first and second cylinders through the respective first and second orifices of the respective first and second dashpot components.

21. The internal combustion engine of claim 20, wherein the hydraulic fluid driven into the first and second orifices is supplied to a cooling system of the engine.

22. The internal combustion chamber of claim 18, wherein the first hydraulic chamber is linked to the second hydraulic chamber by an intermediate passageway through which extends the connector tube, and wherein the first hydraulic chamber is sealed from the second hydraulic chamber at least in part by at least one sealing ring positioned between an exterior surface of the connector tube and an interior surface of the intermediate passageway.

23. The internal combustion engine of claim 18, wherein first and second capacitance signals indicative of capacitances existing between the respective first and second dashpot components and the respective first and second connector tube collars are output from the first and second dashpot components, respectively, the capacitances varying with relative distances between the corresponding connector tube collars and the dashpot components.

24. The internal combustion engine of claim 22, wherein the respective first and second dashpot components are insulated relative to remaining portions of the first and second cylinders by way of first and second insulating rings, respectively, and insulated relative to the respective connector tube collars by way of the hydraulic fluid.

25. The internal combustion engine of claim 1, further comprising electronic control circuitry configured to control timing of combustion events within the engine.

26. The internal combustion engine of claim 25, wherein the electronic control circuitry is further configured to monitor position sensing signals relating to positioning of at least one of the first and second pistons within the first and second cylinders, and to control the actuation of the intake valves, exhaust valves, fuel injectors and sparking devices based upon the position sensing signals.

27. The internal combustion engine of claim 26, wherein the position sensing signals are generated when first and second dashpot components of the first and second cylinders receive first and second connector tube collars positioned on a connector tube linking the first and second pistons, and wherein the position sensing signals thereby are indirectly indicative of the positioning of the first and second pistons at respective end-of-travel (EOT) positions.

28. The internal combustion engine of claim 25, wherein the electronic control circuitry includes at least one of a microprocessor, a programmable logic device (PLD), and discrete logic devices.

29. The internal combustion engine of claim 25, wherein the electronic control circuitry includes first and second latches, wherein, when the first latch is set and the second latch is reset, the electronic control circuitry causes engine operation that entails a combustion event in the first cylinder, and wherein, when the first latch is reset and the second latch is set, the electronic control circuitry causes engine operation that entails a combustion event in the second cylinder.

30. The internal combustion engine of claim 25, further comprising an air tank, wherein the electronic control circuitry only commences operation of the engine upon determining that a desired level of air pressure exists in the air tank, and upon receiving an operator command to commence operation.

31. The internal combustion engine of claim 1, wherein the hydraulic fluid is selected from the group consisting of oil, water and another substantially-incompressible fluid.

32. The internal combustion engine of claim 1, wherein an expansion ratio of the pistons exceeds a factor of 14.

33. The internal combustion engine of claim 1, wherein the engine is capable of operating without at least one of a starter and a flywheel.

34. The internal combustion engine of claim 1, wherein the hydraulic motor includes input and output terminals, wherein the input terminal of the hydraulic motor is coupled to the at least one hydraulic link, wherein the output terminal of the hydraulic motor is coupled to a braking valve, which in turn is coupled to each of a hydraulic reservoir and a hydraulic accumulator, and wherein a re-acceleration valve further is coupled at least indirectly between the accumulator and the input terminal of the hydraulic motor.

35. The internal combustion engine of claim 34, wherein electronic control circuitry of the engine causes the braking valve to direct the hydraulic fluid to flow into the hydraulic accumulator for storage therein in response to receiving an operator braking command, and wherein the electronic control circuitry causes the re-acceleration valve to direct the hydraulic fluid stored within the hydraulic accumulator back to the input terminal of the motor in response to receiving an operator acceleration command.

36. The internal combustion engine of claim 1, wherein opening of the first intake valve is achieved by actuating an electrically-actuated solenoid valve so as to allow some of the compressed air to contact a portion of the first intake valve and consequently cause movement of the first intake valve.

37. A vehicle comprising the internal combustion engine of claim 1.

38. An internal combustion engine comprising:

a first piston provided within a first cylinder, wherein a first combustion chamber is defined within the cylinder at least in part by a face of the piston;

a first intake valve within the first cylinder capable of allowing access to the first combustion chamber; and a source of compressed air, wherein the source is external of the first cylinder and is coupled to the cylinder by way of the first intake valve, wherein the first piston does not ever operate so as to compress therewithin an amount of uncombusted fuel/air mixture, whereby the engine is capable of operating without a starter.

39. The internal combustion engine of claim 38, wherein a first hydraulic chamber is defined within the first cylinder at least partially by a side of the first piston opposite the face of the piston, and wherein movement of the first piston results in at least one of hydraulic fluid to be drawn into the hydraulic chamber or forced out of the hydraulic chamber.

40. The internal combustion engine of claim 39, further comprising a second cylinder and a second piston within the second cylinder, wherein a second combustion chamber and a second hydraulic chamber are formed within the second cylinder, wherein the second piston is positioned between the second combustion chamber and the second hydraulic chamber, and wherein the second piston is coupled to the first piston by way of a connector tube in a back-to-back manner such that enlargement of the first combustion chamber in response to a combustion event therewithin causes corresponding enlargement of the second hydraulic chamber and reductions in sizes of the first hydraulic chamber and the second combustion chamber.

41. The internal combustion engine of claim 38, further comprising means for powering a compressor by which the source receives compressed air.

42. The internal combustion engine of claim 41, further comprising an electrically-controllable valve that governs communication of the compressed air from the source to a plunger associated with the first intake valve, and wherein actuation of the electrically-controllable valve causes the compressed air to be applied to the plunger and thereby cause a movement of the first intake valve.

43. In an internal combustion engine, the method comprising:

(a) providing a cylinder assembly having first and second cylinders and a piston assembly including first and second pistons that are coupled to one another by rigid structure and positioned within the first and second cylinders, respectively, wherein inner and outer chambers are formed within each of the first and second cylinders, the inner chambers being positioned inwardly of the respective pistons along the rigid structure and outer chambers being positioned outwardly of the respective pistons relative to the inner chambers, and wherein the inner chambers are configured to receive hydraulic fluid while the outer chambers are configured to receive amounts of fuel and air;

(b) causing a first exhaust valve associated with the outer chamber of the first cylinder to close and a second exhaust valve associated with the outer chamber of the second cylinder to open;

(c) opening a first intake valve associated with the outer chamber of the first cylinder to open;

(d) providing compressed air along with fuel into the outer chamber of the first cylinder upon the opening of the first intake valve;

(e) closing the first intake valve; and (f) causing a combustion event to occur within the outer chamber of the first cylinder, the combustion event tending to drive the piston assembly in a manner tending to expand the outer chamber of the first cylinder.

44. The method of claim 43, further comprising actuating a fuel injector to pulse the fuel into the outer chamber of the first cylinder while the first intake valve is opened.

45. The method of claim 44, wherein a manner in which the fuel injector is actuated depends upon an operator command regarding desired engine output power.

46. The method of claim 43, wherein the combustion event is caused to occur by actuating a sparking device associated with the first cylinder after the first intake valve has been closed.

47. The method of claim 43, wherein the causing of the first exhaust valve occurs at or after a time at which it is determined that one of the first and second pistons has reached an end-of-travel (EOT) position.

48. The method of claim 47, wherein a signal intended to cause the first exhaust valve to close is provided subsequent to the time at which it is determined that the one piston has reached the EOT position, by an amount of time determined based at least in part upon engine speed.

49. The method of claim 43, wherein the engine is capable of determining whether the first piston has reached a first EOT position and whether the second piston has reached a second EOT position, and wherein (c)-(f) occur if at least one of the following is true:

(i) it is determined that the second piston is now at the second EOT position;

(ii) it is determined that the first piston is not currently at the first EOT position and the second piston is not currently at the second EOT position, and further determined that a predetermined amount of time following an activation of a sparking device has passed.

50. The method of claim 43, wherein (c)-(f) are repeated if it is determined that the second piston is now at the second EOT position and was previously at the second EOT position prior to initially performing (c)-(f).

51. The method of claim 43, further comprising:

(g) causing the first exhaust valve associated with the outer chamber of the first cylinder to open and the second exhaust valve associated with the outer chamber of the second cylinder to close;

(h) opening a second intake valve associated with the outer chamber of the second cylinder to open;

(i) providing compressed air along with fuel into the outer chamber of the second cylinder upon the opening of the second intake valve;

(j) closing the second intake valve; and (k) causing a combustion event to occur within the outer chamber of the second cylinder, the combustion event tending to drive the piston assembly in a manner tending to expand the outer chamber of the second cylinder.

52. The method of claim 51, wherein the internal combustion engine includes electronic control circuitry including right and left latches, and wherein (g) occurs following a switching of statuses of the right and left latches.

53. The method of claim 43, further comprising sensing an EOT position by way of a capacitance signal received from an electrode associated with a dashpot assembly.

54. The method of claim 43, wherein the opening and closing of the first intake valve is determined by applications of the compressed air to at least one of the first intake valve and a component coupled to the first intake valve, the applications of the compressed air being controlled by an electrically-actuated valve.

* * * * *